US006045956A

United States Patent [19]

Kato et al.

[11] Patent Number: 6,045,956

[45] Date of Patent: Apr. 4, 2000

[54] METHOD OF FORMING COLOR IMAGE

[75] Inventors: Eiichi Kato; Yusuke Nakazawa, both of Shizuoka, Japan

[73] Assignee: Fuji Photo Film Co., Ltd., Kanagawa, Japan

[21] Appl. No.: 09/365,412

[22] Filed: Aug. 2, 1999

Related U.S. Application Data

[63] Continuation of application No. 08/969,568, Nov. 13, 1997, abandoned, which is a continuation of application No. 08/533,660, Sep. 25, 1995, abandoned.

[30] Foreign Application Priority Data

Oct. 18, 1994 [JP] Japan ..... 6-277183

[51] Int. Cl.[7] ..... G03G 13/01

[52] U.S. Cl. ..... 430/47; 430/126; 430/132

[58] Field of Search ..... 430/47, 126, 132

[56] References Cited

U.S. PATENT DOCUMENTS 4,292,120 9/1981 Nacci .
5,501,929 3/1996 Kato et al. .
5,582,941 12/1996 Kato et al. .
5,648,190 7/1997 Kato et al. .
5,689,785 11/1997 Kato et al. .

*Primary Examiner*—Christopher D. Rodee
*Attorney, Agent, or Firm*—Sughrue, Mion, Zinn, Macpeak & Seas, PLLC

[57] ABSTRACT

A method of forming a color image comprising forming at least one color toner image on an electrophotographic light-sensitive element whose surface has releasability by an electrophotographic process, forming a peelable transfer layer on the electrophotographic light-sensitive element bearing the toner image by an electrodeposition coating method using thermoplastic resin grains each containing a resin (AH) having a glass transition point of from 10° C. to 140° C. or a softening point of from 35° C. to 180° C. and a resin (AL) having a glass transition point of not more than 45° C. or a softening point of not more than 60° C. and its glass transition point or softening point is at least 2° C. lower than that of the resin (AH), transferring the toner image together with the transfer layer onto a primary receptor, and then transferring the toner image together with the transfer layer from the primary receptor onto a receiving material.

The method can provide color images of high accuracy and high quality without color shear in a simple and stable manner irrespect of the kind of receiving material. The color duplicate obtained has good retouching and sealing properties and is excellent in storage stability.

14 Claims, 4 Drawing Sheets

METHOD OF FORMING COLOR IMAGE

This is a continuation of application Ser. No. 08/969,568 filed Nov. 13, 1997, abandoned which is a continuation of application Ser. No. 08/533,660 filed Sep. 25, 1995, now abandoned, the disclosure of which is incorporated herein by reference.

FIELD OF THE INVENTION

The present invention relates to a method of forming a color image, and more particularly to a method of forming a color image using an electrophotographic process which is applicable to the field of color copy, color print, color proof, color check and the like.

BACKGROUND OF THE INVENTION

Methods of forming color printings, color duplicates or color proofs (proofs for printing) which comprises conducting development with electrophotographic developing agents to form a plurality of overlapping color toner images directly on the surface of electrophotographic light-sensitive element and transferring at once the resulting color images onto a receiving material such as printing paper are known.

The developing methods include a so-called dry type developing method and wet type developing method. Color images obtained by the wet type developing method are preferred because of little color shear and good resolution as compared with those formed with dry toners. However, it is very difficult to directly transfer wet type toner images entirely from the surface of the light-sensitive element to printing paper.

In order to solve this problem, a transfer technique in which a non-aqueous solvent is supplied between a light-sensitive element and a receiving material and then transfer is electrostatically performed is described in JP-A-2-272469 (the term "JP-A" as used herein means an "unexamined published Japanese patent application").

Also, a method in which a transparent film is first laminated on the surface of a light-sensitive element, wet type toner images are formed by an electrophotographic process on the film, and then the film bearing the toner images is separated from the light-sensitive element and stuck on plain paper, thereby forming transferred images is described in JP-A-2-115865 and JP-A-2-115866. According to the method, the film to be laminated has suitably a thickness of 9 $\mu$m. However, the production and handling of a film having such thickness is very troublesome and it is necessary to arrange a special system for them.

Further, in JP-B-2-43185 (the term "JP-B" as used herein means an "examined Japanese patent publication"), a method in which imagewise exposure through a transparent electrophotographic light-sensitive element and development are conducted repeatedly to form overlapping color separation images on a dielectric support releasably provided on the light-sensitive element and the dielectric support bearing the images is transferred to a receiving material is described. Since the imagewise exposure is performed from the side of substrate for the light-sensitive element according to this method, the substrate is required to be transparent. This is disadvantageous in view of a cost.

On the other hand, an electrophotographic transfer method using a so-called dry type developing method in which a releasable transfer layer is provided on the surface of a light-sensitive element, toner images are formed on the transfer layer and the toner images are transferred together with the transfer layer to printing paper is described in JP-A-1-112264, JP-A-1-281464 and JP-A-3-11347.

However, in order to employ the light-sensitive element repeatedly in the techniques hitherto known, a special operation is required at the time of transfer or difficulties in the formation of transfer layer are encountered. On the other hand, the method using a light-sensitive element having a transfer layer (or a releasable layer) previously formed thereon is disadvantageous in point of cost since the light-sensitive element used is inevitably thrown.

Moreover, in JP-A-2-264280 a method in which toner images on a light-sensitive layer are transferred onto a primary intermediate transfer medium having high smoothness and then transferred onto a final receiving material is described. Also, a method in which a special transfer medium is used in order to obtain final color images of good quality even when wet type toner is employed is proposed in JP-A-3-243973 and JP-A-4-9087.

It appears that tone images are transferred without being affected by irregularities on the surface of receiving material according to these methods. However, since toner images are first transferred onto the primary intermediate transfer medium and then further transferred onto the final receiving material, a lack of toner image, particularly a lack of fine images such as fine lines and fine letters and unevenness in image density are observed in the resulting color images.

Further, toner images remain on the surfaces of light-sensitive element and primary intermediate transfer medium after the transfer process. Therefore, it is necessary to clean the surfaces of light-sensitive element and primary intermediate transfer medium when they are repeatedly employed. This is disadvantageous in that a device for cleaning must be provided and in that the surfaces of light-sensitive element and primary intermediate transfer medium is damaged by cleaning.

As described above, conventional color image forming methods using an intermediate transfer medium have problems in that fully satisfactory color images can not be obtained, in that since the property of intermediate medium is changed, it is difficult to maintain stably its performance over a long period of time, when the intermediate medium is repeatedly used, in that disposable materials must be employed to maintain its performance, and in that a special transfer medium is required.

SUMMARY OF THE INVENTION

The present invention is intended to solve the above-described various problems associated with conventionally known method for forming an electrophotographic color transfer image.

An object of the present invention is to provide a method of forming a color image via an electrophotographic process using an intermediate receptor which method provides simply and stably a color image of high accuracy and high quality without color shear irrespective of the kind of final receiving material to be employed.

Another object of the present invention is to provide a method of forming a color transfer image in which a toner image is wholly transferred together with a transfer layer onto a final receiving material via an intermediate receptor even when the transfer layer has a reduced thickness or the transfer conditions are varied for example, when temperature or pressure for transfer is decreased or a transfer speed is increased.

Other objects of the present invention will become apparent from the following description and examples.

It has been found that the above described objects of the present invention are accomplished by a method of forming a color image comprising forming at least one color toner image on an electrophotographic light-sensitive element whose surface has releasability by an electrophotographic process, forming a peelable transfer layer on the electrophotographic light-sensitive element bearing the toner image by an electrodeposition coating method using thermoplastic resin grains each containing a resin (AH) having a glass transition point of from 10° C. to 140° C. or a softening point of from 35° C. to 180° C. and a resin (AL) having a glass transition point of not more than 45° C. or a softening point of not more than 60° C. and its glass transition point or softening point is at least 2° C. lower than that of the resin (AH), transferring the toner image together with the transfer layer onto a primary receptor, and then transferring the toner image together with the transfer layer from the primary receptor onto a receiving material.

BRIEF DESCRIPTION OF THE ACCOMPANYING DRAWINGS

Figure 5A:
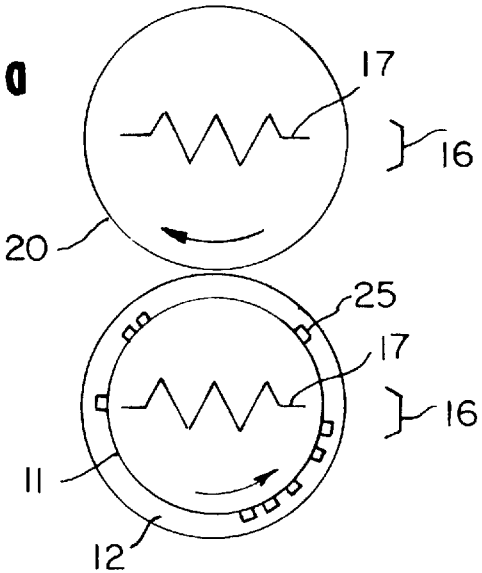
Figure 5B:
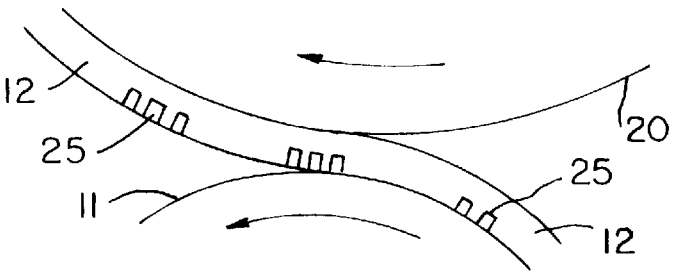

FIGS. 5*a* and 5*b* are partially schematic views of a step for transferring a toner image together with a transfer layer onto a primary receptor.

Figure 6:
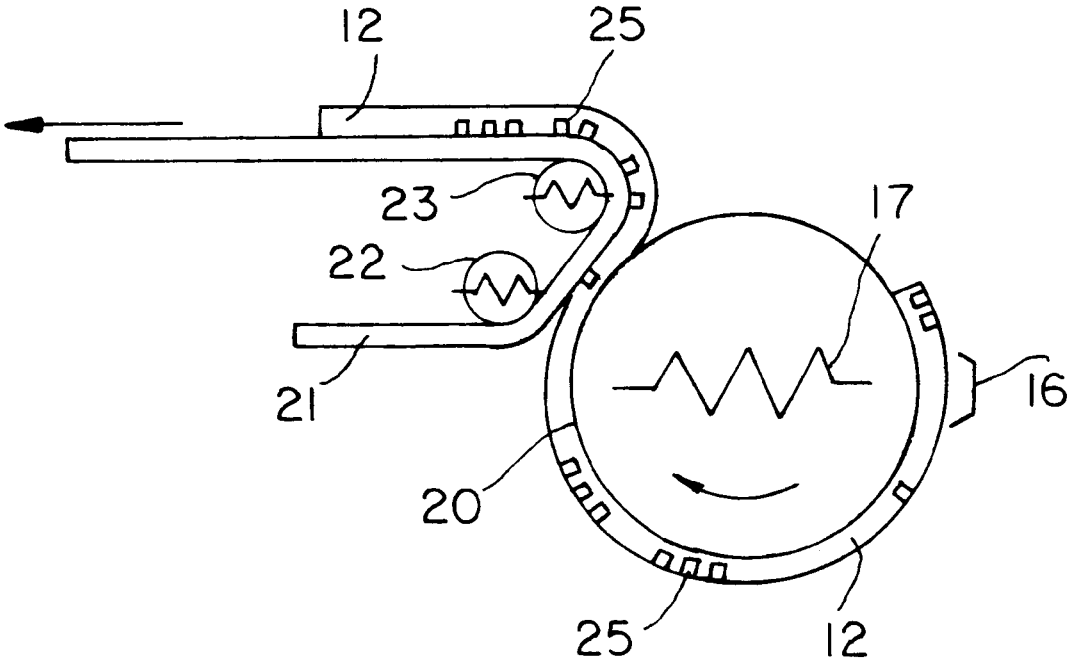

FIG. 6 is a partially schematic view of a step for transferring a toner image together with a transfer layer from a primary receptor onto a receiving material.

Figure 7:
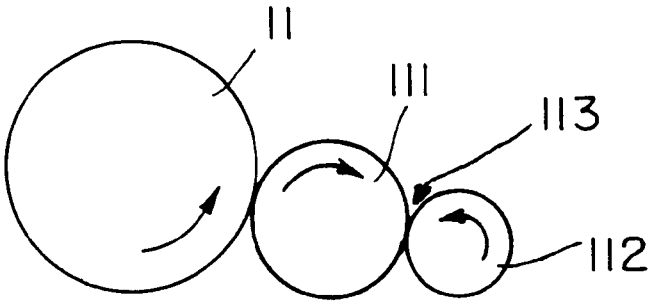

FIG. 7 is a partially schematic view of a device for applying Compound (S).

Explanation of the Symbols

| | |
|---|---|
| 1 | Support |
| 2 | Light-sensitive layer |
| 10 | Applying device of compound (S) |
| 11 | Light-sensitive element |
| 12 | Transfer layer |
| 12a | Dispersion of thermoplastic resin grain |
| 14 | Liquid developing unit set |
| 14y | Yellow liquid developing unit |
| 14m | Magenta liquid developing unit |
| 14c | Cyan liquid developing unit |
| 14k | Black liquid developing unit |
| 15 | Suction/exhaust unit |
| 15a | Suction part |
| 15b | Exhaust part |
| 16 | Heating means |
| 17 | Temperature controller |
| 18 | Corona charger |
| 19 | Exposure device |
| 20 | Primary receptor |
| 21 | Receiving material |
| 22 | Backup roller for transfer |
| 23 | Backup roller for release |
| 25 | Toner image |
| 50 | Electrodeposition unit of thermoplastic resin grain |

-continued

| | |
|---|---|
| 111 | Transfer roll |
| 112 | Metering roll |
| 113 | Compound (S) |

DETAILED DESCRIPTION OF THE INVENTION

The method of forming a color image according to the present invention will be diagrammatically described with reference to FIG. 1 of the drawings.

Figure 1:
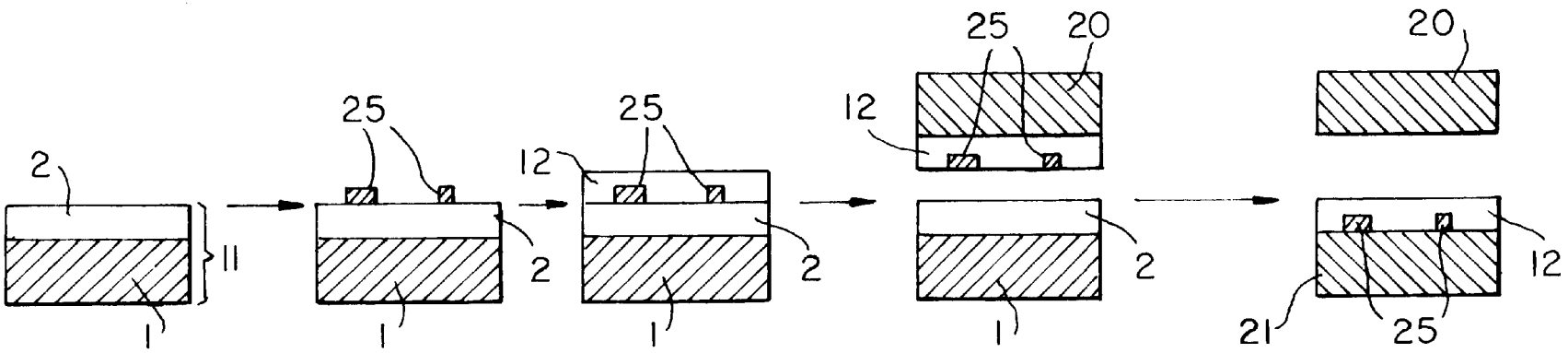
FIG. 1 is a schematic view for explanation of the method according to the present invention.

As shown in FIG. 1, the method of forming a color image comprises forming at least one color toner image 25 on an electrophotographic light-sensitive element 11 having at least a support 1 and a light-sensitive layer 2 by a conventional electrophotographic process, providing a peelable transfer layer 12 on the light-sensitive element 11 bearing the toner image 25 by an electrodeposition coating method using thermoplastic resin grains, transferring the toner image 25 together with the transfer layer 12 onto a primary receptor 20, and then transferring the toner image 25 together with the transfer layer 12 onto a receiving material 21 to form a color duplicate.

The present invention is characterized in that the thermoplastic resin grains (hereinafter referred to as resin grains (ARW) sometimes) employed for forming the transfer layer contains at least two kinds of resins having glass transition points or softening points different from each other.

According to the present invention, a toner image formed on a light-sensitive element is easily and completely transferred onto a final receiving material via a primary receptor since on the light-sensitive element bearing the toner image is provided a transfer layer and then the toner image is transferred together with the transfer layer. The method of the present invention provides a color duplicate using a transfer device of a simple structure without specifically selecting the kind of receiving material. Because the toner image transferred together with the transfer layer provided thereon onto the primary receptor and then onto the final receiving material, a color duplicate of high accuracy and high quality free from color shear can be obtained in a simple and stable manner.

Further, the surface of electrophotographic light-sensitive element is not brought into direct contact with the final receiving material since the surface of light-sensitive element is covered with the transfer layer and the toner image is once transferred onto the primary receptor. Therefore, damage of the surface of light-sensitive element is reduced and thus the light-sensitive element can be repeatedly employed for a long period of time.

Moreover, excellent transferability of toner image and transfer layer can be achieved, and a color duplicate having good quality and preservability can be obtained by providing the transfer layer on the light-sensitive element bearing the toner image with the electrodeposition method using the resin grains (ARW).

Now, the transfer layer which can be used in the present invention will be described in greater detail below.

The transfer layer of the present invention comprising the thermoplastic resin is light-transmittive. Specifically, it is not particularly limited as far as hue of toner image formed thereon is distinguishable. The layer may be colored. In a case wherein a duplicated image formed on a receiving material is a color image, particularly a full-color image, a colorless and transparent transfer layer is usually employed.

The transfer layer is preferably peelable under a transfer condition of temperature of not more than 180° C. or a pressure of not more than 20 kgf/cm$^2$. When the transfer layer only peelable under condition exceeding the above described value is used, there may arise a difficult problem for practical purpose in that a device for releasing and transferring the transfer layer from the surface of light-sensitive element onto a primary receptor and from the primary receptor onto a receiving material must be large-sized in order to maintain the desired heat capacity and pressure therefor or in that a transfer speed must be very lowered to conduct sufficiently the transfer. While there is no particular lower limit thereof, ordinarily it is preferred to use the transfer layer which is peelable at temperature of not less than room temperature or at a pressure of not less than 100 gf/cm$^2$.

The thermoplastic resins including the resin (AH) and resin (AL) which are mainly employed for the formation of transfer layer are generally referred to as resins (A) hereinafter sometimes.

As described above, both the resin (AH) having a relatively high glass transition point or softening point and the resin (AL) having a relatively low glass transition point or softening point are employed in combination in the thermoplastic resin grain (ARW) used for the formation of transfer layer. The resin (AR) has a glass transition point of suitably from 10° C. to 140° C., preferably from 30° C. to 120° C., and more preferably from 35° C. to 90° C., or a softening point of suitably from 35° C. to 180° C., preferably from 38° C. to 160° C., and more preferably from 40° C. to 120° C., and on the other hand, the resin (AL) has a glass transition point of suitably not more than 45° C., preferably from −40° C. to 40° C., and more preferably from −20° C. to 33° C., or a softening point of suitably not more than 60° C., preferably from 0° C. to 45° C., and more preferably from 5° C. to 35° C. The difference in the glass transition point or softening point between the resin (AH) and the resin (AL) used is at least 2° C., preferably at least 5° C., and more preferably in a range of from 10° C. to 50° C. The difference in the glass transition point or softening point between the resin (AH) and the resin (AL) means a difference between the lowest glass transition point or softening point of those of the resins (AH) and the highest glass transition point or softening point of those of the resins (AL) when two or more of the resins (AH) and/or resins (AL) are employed. According to the present invention, the thermoplastic resin grain (ARW) can be composed by appropriately selecting the resin (AH) and resin (AL) so as to fulfill the above described conditions on the glass transition point or softening point.

The resin (AH) and resin (AL) are preferably present in the resin grain (ARW) in a suitable weight ratio of resin (AH)/resin (AL) ranging from 10/90 to 95/5. In the above described range of weight ratio of resin (AH)/resin (AL), the excellent transferability of transfer layer and the good storage stability of a color duplicate, for example, good filing aptitude, in that the transfer layer is not peeled off when the color duplicate has been filed between plastic sheets and piled up can be achieved. A more preferred weight ratio of resin (AH)/resin (AL) is from 30/70 to 90/10.

Two or more kinds of the resin (AH) and resin (AL) may be present in the state of admixture or may form a layered structure such as a core/shell structure composed of a portion mainly comprising the resin (AH) and a portion mainly comprising the resin (AL) in the resin grain (ARW) of the present invention. In case of core/shell structure, the resin constituting the core portion is not particularly limited and may be the resin (AH) or the resin (AL).

A weight average molecular weight of each of the resin (AH) and resin (AL) is preferably from $1\times10^3$ to $5\times10^5$, more preferably from $3\times10^3$ to $8\times10^4$. The molecular weight herein used is measured by a GPC method and calculated in terms of polystyrene.

The resins (A) which can be used in the transfer layer include thermoplastic resins and resins conventionally known as adhesive or stick. Suitable examples of these resins include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, olefin-styrene copolymers, olefin-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring (the heterocyclic ring including, for example, furan, tetrahydrofuran, thiophene, dioxane, dioxofuran, lactone, benzofuran, benzothiophene and 1,3-dioxetane rings), cellulose resins, fatty acid-modified cellulose resins and epoxy resins.

Specific examples of resins are described, e.g., in *Plastic Zairyo Koza Series,* Vols. 1 to 18, Nikkan Kogyo Shinbunsha (1981), Kinki Kagaku Kyokai Vinyl Bukai (ed.), *Polyenka Vinyl,* Nikkan Kogyo Shinbunsha (1988), Eizo Omori, *Kinosei Acryl Jushi,* Techno System (1985), Ei-ichiro Takiyama, *Polyester Jushi Handbook,* Nikkan Kogyo Shinbunsha (1988), Kazuo Yuki, *Howa Polyester Jushi Handbook,* Nikkan Kogyo Shinbunsha (1989), Kobunshi Gakkai (ed.), *Kobunshi Data Handbook* (Oyo-hen), Ch. 1, Baifukan (1986), Yuji Harasaki, *Saishin Binder Giiutsu Binran,* Ch. 2, Sogo Gijutsu Center (1985), Taira Okuda (ed.), *Kobunshi Kako,* Vol. 20, Supplement "Nenchaku", Kobunshi Kankokai (1976), Keizi Fukuzawa, *Nenchaku Gijutsu*, Kobunshi Kankokai (1987), Mamoru Nishiguchi, *Secchaku Binran,* 14th Ed., Kobunshi Kankokai (1985), and Nippon Secchaku Kokai (ed.), *Secchaku Handbook,* 2nd Ed., Nikkan Kogyo Shinbunsha (1980).

The resin (A) used in the transfer layer according to the present invention may contain a polymer component containing a moiety having at least one of a fluorine atom and a silicon atom (hereinafter referred to as polymer component (F) sometimes) which is effective to increase the releasability of the resin (A) itself. Using such a resin, releasability of the transfer layer from an electrophotographic light-sensitive element is increased and as a result, the transferability is further improved.

The moiety having a fluorine atom and/or a silicon atom contained in the resin (A) includes that incorporated into the main chain of the polymer and that contained as a substituent in the side chain of the polymer.

The content of polymer component (F) is preferably from 3 to 30 parts by weight, more preferably from 5 to 15 parts by weight per 100 parts by weight of the total polymer component of the resin (A).

The polymer component (F) may be incorporated into any of the resin (AH) and the resin (AL) described above. The polymer components (F) are preferably present as a block in the resin (A).

Now, the polymer component (F) which is incorporated into the resin (A) in order to increase the releasability of the resin (A) itself will be described below.

The fluorine atom-containing moieties include monovalent or divalent organic residues, for example, $—C_hF_{2h+1}$ (wherein h represents an integer of from 1 to 18), $-(CF_2)_jCF_2H$ (wherein j represents an integer of from 1 to 17), $—CFH_2$,

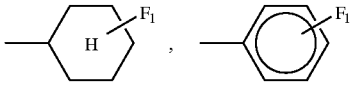

(wherein l represents an integer of from 1 to 5), $—CF_2—$, —CFH—,

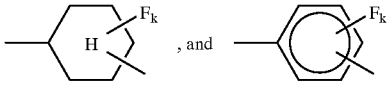

(wherein k represents an integer of from 1 to 4).

The silicon atom-containing moieties include monovalent or divalent organic residues, for example,

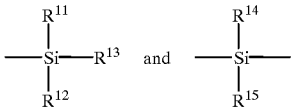

wherein $R^{11}$, $R^{12}$, $R^{13}$, $R^{14}$, and $R^{15}$, which may be the same or different, each represents a hydrocarbon group which may be substituted or $—OR^{16}$ wherein $R^{16}$ represents a hydrocarbon group which may be substituted.

The hydrocarbon group represented by $R^{11}$, $R^{12}$, $R^{13}$, $R^{14}$, $R^{15}$ or $R^{16}$ include specifically an alkyl group having from 1 to 18 carbon atoms which may be substituted (e.g., methyl, ethyl, propyl, butyl, hexyl, octyl, decyl, dodecyl, hexadecyl, 2-chloroethyl, 2-bromoethyl, 2,2,2-trifluoroethyl, 2-cyanoethyl, 3,3,3-trifluoropropyl, 2-methoxyethyl, 3-bromopropyl, 2-methoxycarbonylethyl, or 2,2,2,2',2'2'-hexafluoroisopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, or 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, or dimethoxybenzyl), an alicyclic group having from 5 to 8 carbon atoms which may be substituted (e.g., cyclohexyl, 2-cyclohexylethyl, or 2-cyclopentylethyl), or an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, or dodecyloylamidophenyl).

The fluorine atom and/or silicon atom-containing organic residue may be composed of a combination thereof. In such a case, they may be combined either directly or via a linking group. The linking groups include divalent organic residues, for example, divalent aliphatic groups, divalent aromatic groups, and combinations thereof, which may or may not contain a bonding group, e.g., —O—, —S—,

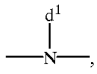

—CO—, —SO—, $—SO_2—$, —COO—, —OCO—, —CONHCO—, —NHCONH—,

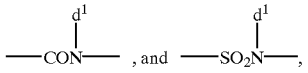

wherein $d^1$ has the same meaning as $R^{11}$ above.

Examples of the divalent aliphatic groups are shown below.

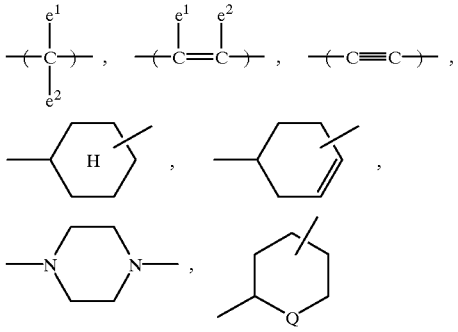

wherein $e^1$ and $e^2$, which may be the same or different, each represents a hydrogen atom, a halogen atom (e.g., chlorine or bromine) or an alkyl group having from 1 to 12 carbon atoms (e.g., methyl, ethyl, propyl, chloromethyl, bromomethyl, butyl, hexyl, octyl, nonyl or decyl); and Q represents —O—, —S—, or

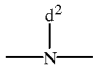

wherein $d^2$ represents an alkyl group having from 1 to 4 carbon atoms, $—CH_2Cl$, or $—CH_2Br$.

Examples of the divalent aromatic groups include a benzene ring, a naphthalene ring, and a 5- or 6-membered heterocyclic ring having at least one hetero atom selected from an oxygen atom, a sulfur atom and a nitrogen atom. The aromatic groups may have a substituent, for example, a halogen atom (e.g., fluorine, chlorine or bromine), an alkyl group having from 1 to 8 carbon atoms (e.g., methyl, ethyl, propyl, butyl, hexyl or octyl) or an alkoxy group having from 1 to 6 carbon atoms (e.g., methoxy, ethoxy, propoxy or butoxy). Examples of the heterocyclic ring include a furan ring, a thiophene ring, a pyridine ring, a piperazine ring, a tetrahydrofuran ring, a pyrrole ring, a tetrahydropyran ring, and a 1,3-oxazoline ring.

Specific examples of the repeating units having the fluorine atom and/or silicon atom-containing moiety as described above are set forth below, but the present invention should not be construed as being limited thereto. In formulae (F-1) to (F-32) below, $R_f$ represents any one of the following groups of from (1) to (11); and b represents a hydrogen atom or a methyl group.

$-C_nF_{2n+1}$ (1)
$-CH_2C_nF_{2n+1}$ (2)
$-CH_2CH_2C_nF_{2n+1}$ (3)
$-CH_2(CF_2)_mCFHCF_3$ (4)
$-CH_2CH_2(CF_2)_mCFHCF_3$ (5)
$-CH_2CH_2(CF_2)_mCFHCF_2H$ (6)
(7)
$-CH_2(CF_2)_mCFHCF_2H$
(8)
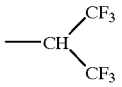
(9)
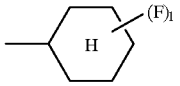
(10)
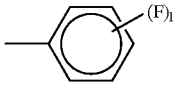
(11)
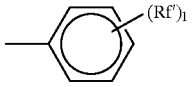
wherein $R_f$ represents any one of the above-described groups of from (1) to (8); n represents an integer of from 1 to 18; m represents an integer of from 1 to 18; and l represents an integer of from 1 to 5.
(F-1)
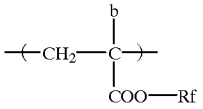
(F-2)
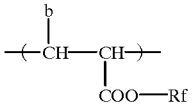
(F-3)
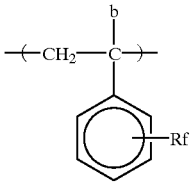
(F-4)
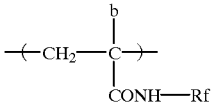
-continued
(F-5)
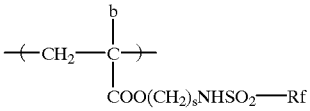
s: an integer of from 1 to 12
(F-6)
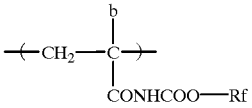
(F-7)
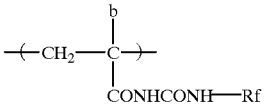
(F-8)
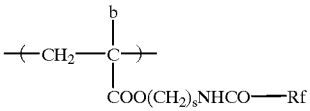
(F-9)
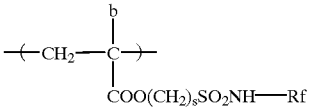
(F-10)
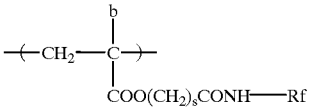
(F-11)
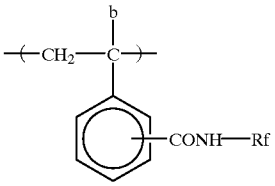
(F-12)
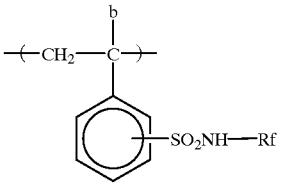
(F-13)
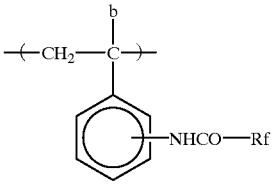

-continued (F-14)

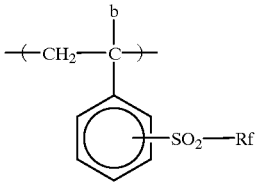

(F-15)

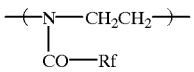

(F-16)

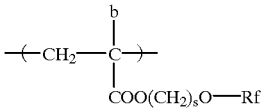

(F-17)

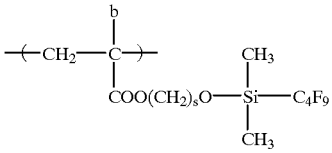

(F-18)

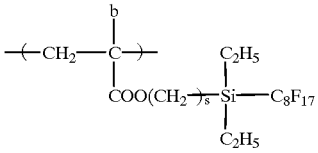

(F-19)

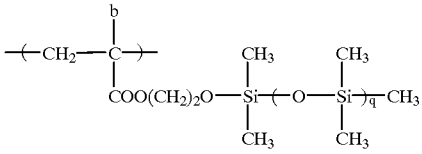

q: an integer of from 1 to 20

(F-20)

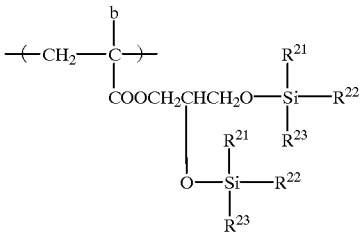

$R^{21}$, $R^{22}$, $R^{23}$: an alkyl group having from 1 to 12 carbon atoms (F-21)

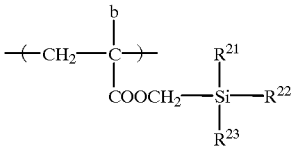

(F-22)

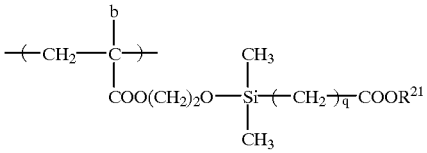

-continued (F-23)

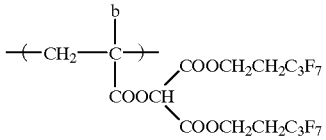

(F-24)

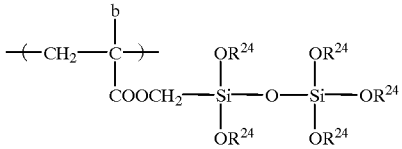

$R^{24}$:

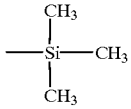

(F-25)

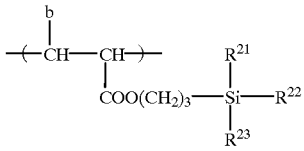

(F-26)

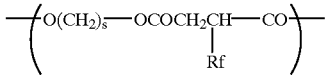

(F-27)

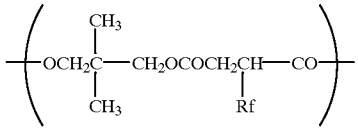

(F-28)

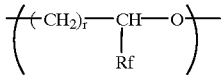

r: an integer of from 3 to 6

(F-29)

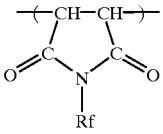

(F-30)

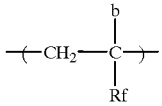

(F-31)

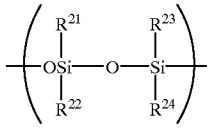

(F-32)

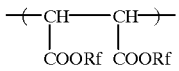

A preferred embodiment of the block copolymer in the resin (A) according to the present invention will be described below. Any type of copolymer can be used as far as the fluorine atom and/or silicon atom-containing polymer component (F) is contained as a block in the resins (A). The term "to be contained as a block" means that the polymer has a polymer segment (α) containing not less than 70% by weight of the fluorine atom and/or silicon atom-containing polymer component based on the polymer segment. The forms of blocks include an A-B type block, an A-B-A type block, a B-A-B type block, a graft type block, and a starlike type block as schematically illustrated below.

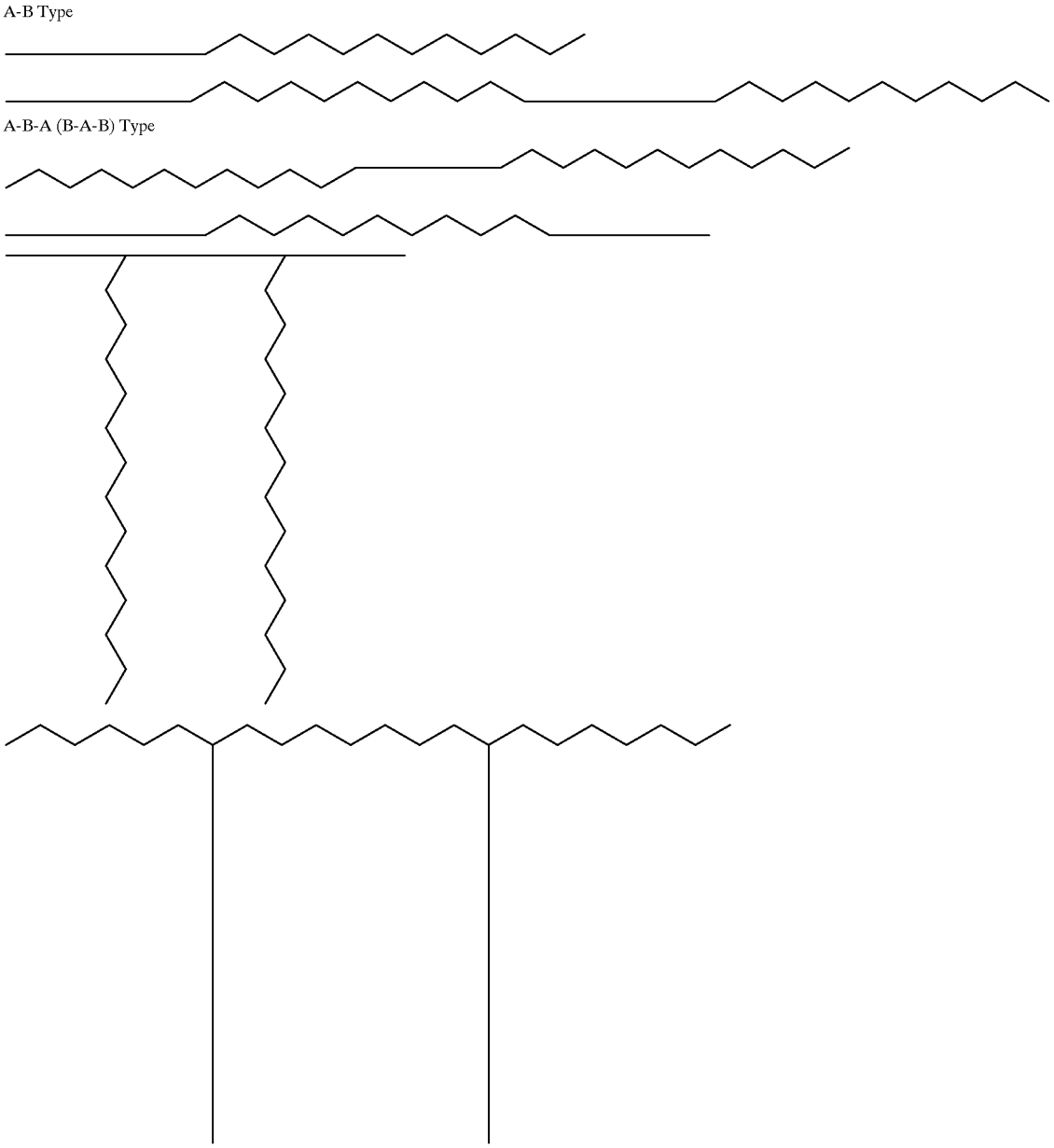

Graft Type (The number of the grafts is arbitrary)

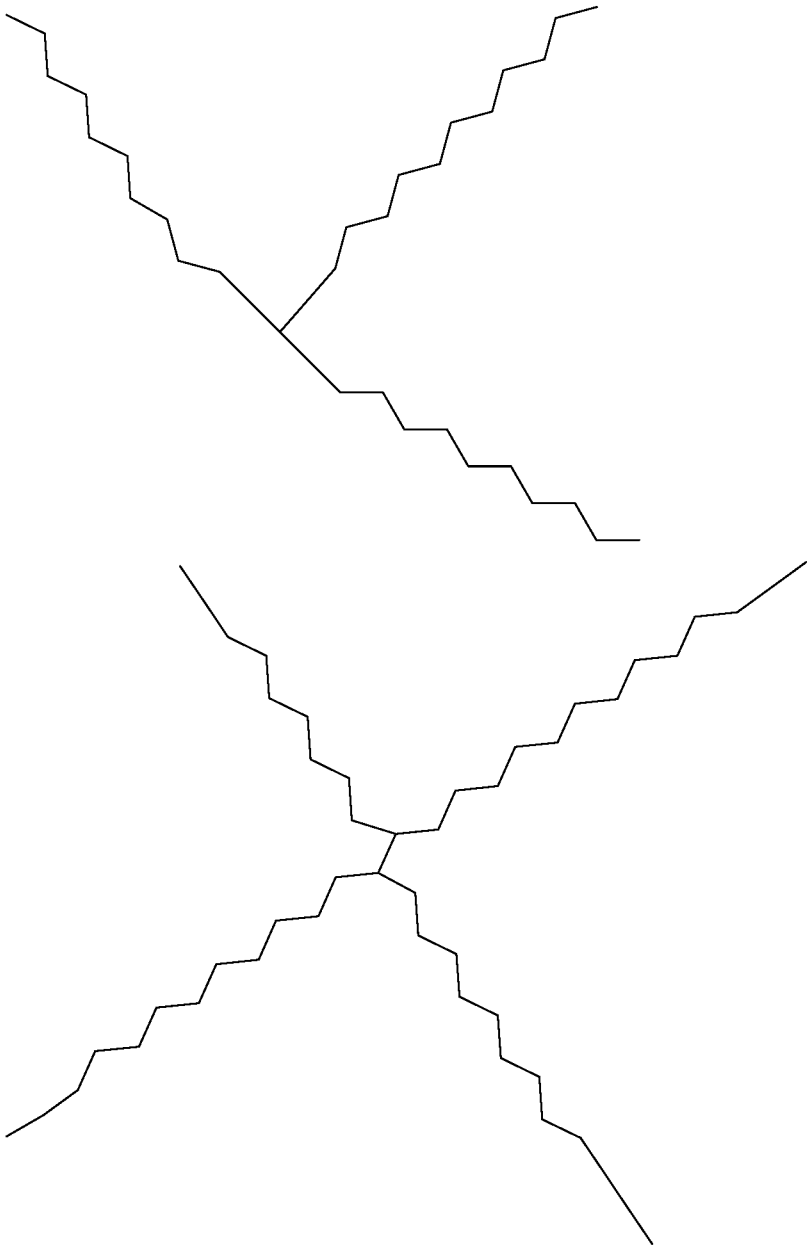

Starlike Type (The number of the branches is arbitrary)

————: Segment (α) (containing fluorine atom and/or silicon atom)

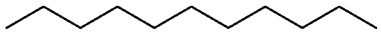

: Segment (β) (containing no or little fluorine atom and/or silicon atom)

These various types of block copolymers can be synthesized in accordance with conventionally known polymerizing methods. Useful methods are described, e.g., in W. J. Burlant and A. S. Hoffman, *Block and Graft Polymers,* Reuhold (1986), R. J. Cevesa, *Block and Graft Copolymers,* Butterworths (1962), D. C. Allport and W. H. James, *Block Copolymers,* Applied Sci. (1972), A. Noshay and J. E. McGrath, *Block Copolymers,* Academic Press (1977), G. Huvtreg, D. J. Wilson, and G. Riess, *NATO ASIser. SerE.,* Vol. 1985, p. 149, and V. Perces, *Applied Polymer Sci.,* Vol. 285, p. 95 (1985).

For example, ion polymerization reactions using an organometallic compound (e.g., an alkyl lithium, lithium diisopropylamide, an alkali metal alcoholate, an alkylmagnesium halide, or an alkylaluminum halide) as a polymerization initiator are described, for example, in T. E. Hogeu-Esch and J. Smid, *Recent Advances in Anion Polymerization,* Elsevier (New York) (1987), Yoshio Okamoto, *Kobunshi,* Vol. 38, P. 912 (1989), Mitsuo Sawamoto, *Kobunshi,* Vol. 38, p. 1018 (1989), Tadashi Narita, *Kobunshi,* Vol. 37, p. 252 (1988), B. C. Anderson, et al., *Macromolecules,* Vol. 14, p. 1601 (1981), and S. Aoshima and T. Higasimura, *Macromolecules,* Vol. 22, p. 1009 (1989).

Ion polymerization reactions using a hydrogen iodide/iodine system are described, for example, in T. Higashimura, et al., *Macromol. Chem., Macromol. Symp.*, Vol. 13/14, p. 457 (1988), and Toshinobu Higashimura and Mitsuo Sawamoto, *Kobunshi Ronbunshu,* Vol. 46, p. 189 (1989).

Group transfer polymerization reactions are described, for example, in D. Y. Sogah, et al., *Macromolecules,* Vol. 20, p. 1473 (1987), O. W. Webster and D. Y. Sogah, *Kobunshi,* Vol. 36, p. 808 (1987), M. T. Reetg, et al., *Angew. Chem. Int. Ed. Engl.,* Vol. 25, p. 9108 (1986), and JP-A-63-97609.

Living polymerization reactions using a metalloporphyrin complex are described, for example, in T. Yasuda, T. Aida, and S. Inoue, *Macromolecules,* Vol. 17, p. 2217 (1984), M. Kuroki, T. Aida, and S. Inoue, *J. Am. Chem. Soc.,* Vol. 109, p. 4737 (1987), M. Kuroki, et al., *Macromolecules,* Vol. 21, p. 3115 (1988), and M. Kuroki and I. Inoue, *Yuki Gosei Kagaku,* Vol. 47, p. 1017 (1989).

Ring-opening polymerization reactions of cyclic compounds are described, for example, in S. Kobayashi and T. Saegusa, *Ring Opening Polymerization,* Applied Science Publishers Ltd. (1984), W. Seeliger, et al., *Angew. Chem. Int. Ed. Engl.,* Vol. 5, p. 875 (1966), S. Kobayashi, et al., *Poly. Bull.,* Vol. 13, p. 447 (1985), and Y. Chujo, et al., *Macromolecules,* Vol. 22, p. 1074 (1989).

Photo living polymerization reactions using a dithiocarbamate compound or a xanthate compound, as an initiator are described, for example, in Takayuki Otsu, *Kobunshi,* Vol. 37, p. 248 (1988), Shun-ichi Himori and Koichi Otsu, *Polymer Rep. Jap.,* Vol. 37, p. 3508 (1988), JP-A-64-111, JP-A-64-26619, and M. Niwa, *Macromolecules*, Vol. 189, p. 2187 (1988).

Radical polymerization reactions using a polymer containing an azo group or a peroxide group as an initiator to synthesize block copolymers are described, for example, in Akira Ueda, et al., *Kobunshi Ronbunshu*, Vol. 33, p. 931 (1976), Akira Ueda, *Osaka Shiritsu Kogyo Kenkyusho Hokoku,* Vol. 84 (1989), O. Nuyken, et al., *Macromol. Chem., Rapid Commun.,*Vol. 9, p. 671 (1988), Yasuo Moriya, et al., *Kyoka Plastic,* Vol. 29, p. 907, and Ryohei Oda, *Kagaku to Kogyo,* Vol. 61, p. 43 (1987).

Syntheses of graft type block copolymers are described in the above-cited literature references and, in addition, Fumio Ide, *Graft Jugo to Sono Oyo,* Kobunshi Kankokai (1977), and Kobunshi Gakkai (ed.), *Polymer Alloy,* Tokyo Kagaku Dojin (1981). For example, known grafting techniques including a method of grafting of a polymer chain by a polymerization initiator, an actinic ray (e.g., radiant ray, electron beam), or a mechano-chemical reaction; a method of grafting with chemical bonding between functional groups of polymer chains (reaction between polymers); and a method of grafting comprising a polymerization reaction of a macromonomer may be employed.

The methods of grafting using a polymer are described, for example, in T. Shiota, et al., *J. Appl. Polym. Sci.,* Vol. 13, p. 2447 (1969), W. H. Buck, *Rubber Chemistry and Technology,* Vol. 50, p. 109 (1976), Tsuyoshi Endo and Tsutomu Uezawa, *Nippon Secchaku Kyokaishi,* Vol. 24, p. 323 (1988), and Tsuyoshi Endo, ibid., Vol. 25, p. 409 (1989).

The methods of grafting using a macromonomer are described, for example, in P. Dreyfuss and R. P. Quirk, *Encycl. Polym. Sci. Eng.,* Vol. 7, p. 551 (1987), P. F. Rempp and E. Franta, *Adv. Polym. Sci.,* Vol. 58, p. 1 (1984), V. Percec, *Appl. Poly. Sci.,* Vol. 285, p. 95 (1984), R. Asami and M. Takari, *Macromol. Chem. Suppl.,* Vol. 12, p. 163 (1985), P. Rempp, et al., *Macromol. Chem. Suppl.,* Vol. 8, p. 3 (1985), Katsusuke Kawakami, *Kagaku Kogyor* Vol. 38, p. 56 (1987), Yuya Yamashita, *Kobunshi,* Vol. 31, p. 988 (1982), Shiro Kobayashi, *Kobunshi,* Vol. 30, p. 625 (1981), Toshinobu Higashimura, *Nippon Secchaku Kyokaishi,* Vol. 18, p. 536 (1982), Koichi Itoh, *Kobunshi Kako,* Vol. 35, p. 262 (1986), Takashiro Azuma and Takashi Tsuda, *Kino Zairyo,* Vol. 1987, No. 10, p. 5, Yuya Yamashita (ed.), *Macromonomer no Kagaku to Kogyo*, I.P.C. (1989), Tsuyoshi Endo (ed.), *Atarashii Kinosei Kobunshi no Bunshi Sekkei,* Ch. 4, C.M.C. (1991), and Y. Yamashita, et al., *Polym. Bull.,* Vol. 5, p. 361 (1981).

Syntheses of starlike block copolymers are described, for example, in M. T. Reetz, *Angew. Chem. Int. Ed. Engl.,* Vol. 27, p. 1373 (1988), M. Sgwarc, *Carbanions, Living Polymers and Electron Transfer Processes,* Wiley (New York) (1968), B. Gordon, et al., *Polym. Bull.,* Vol. 11, p. 349 (1984), R. B. Bates, et al., *J. Org. Chem.,* Vol. 44, p. 3800 (1979), Y. Sogah, *A.C.S. Polym. Rapr.,* Vol. 1988, No. 2, p. 3, J. W. Mays, *Polym. Bull.,* Vol. 23, p. 247 (1990), I. M. Khan et al., *Macromolecules,* Vol. 21, p. 2684 (1988), A. Morikawa, *Macromolecules,* Vol. 24, p. 3469 (1991), Akira Ueda and Toru Nagai, *Kobunshi,* Vol. 39, p. 202 (1990),. and T. Otsu, *Polymer Bull.,* Vol. 11, p. 135 (1984).

While reference can be made to known techniques described in the literatures cited above, the method for synthesizing the block copolymers according to the present invention is not limited to these methods.

The resin (A) is preferably used at least 70% by weight, more preferably at least 90% by weight based on the total amount of the composition for the transfer layer.

If desired, the transfer layer may contain various additives for improving physical characteristics, such as adhesion, film-forming property, and film strength. For example, rosin, petroleum resin, or silicone oil may be added for controlling adhesion; polybutene, DOP, DBP, low-molecular weight styrene resins, low molecular weight polyethylene wax, microcrystalline wax, or paraffin wax, as a plasticizer or a softening agent for improving wetting property to the light-sensitive element or decreasing melting viscosity; and a polymeric hindered polyvalent phenol, or a triazine derivative, as an antioxidant. For the details, reference can be made to Hiroshi Fukada, *Hot-melt Secchaku no Jissai,* pp. 29 to 107, Kobunshi Kankokai (1983).

The transfer layer preferably has a thickness of from 0.1 to 20 $\mu$m, and preferably from 0.5 to 10 $\mu$m in total. If the transfer layer is too thin, it is liable to result in insufficient transfer, and if the layer is too thick, troubles on the electrophotographic process tend to occur, failing to obtain a sufficient image density or resulting in degradation of image quality.

According to the present invention, the thermoplastic resin grains (ARW) each containing the resin (AH) and resin (AL) each having the specific glass transition point described above are applied to the surface of light-sensitive element bearing toner image thereon by an electrodeposition coating method and then transformed into a uniform thin film, for example, by heating, thereby the transfer layer being formed. The electrodeposition coating method used herein means a method wherein the resin grains (ARW) are electrostatically adhered or electrodeposited on the toner image and the surface of light-sensitive element.

The thermoplastic resin grains (ARW) must have either a positive charge or a negative charge. The electroscopicity of the resin grains is appropriately determined depending on a charging property of the electrophotographic light-sensitive element to be used in combination.

An average grain diameter of the resin grains (ARW) having the physical property described above is generally in a range of from 0.01 to 15 $\mu$m, preferably from 0.05 to 5 $\mu$m and more preferably from 0.1 to 1 $\mu$m. The resin grains may be employed as powder grains (in case of dry type electrodeposition), grains dispersed in a non-aqueous system (in case of wet type electrodeposition), or grains dispersed in an electrically insulating organic substance which is solid at normal temperature but becomes liquid by heating (in case of pseudo-wet type electrodeposition). The resin grains dispersed in a non-aqueous system are preferred since they can easily prepare the peelable transfer layer of uniform and small thickness.

The resin grains used in the present invention can be produced by a conventionally known mechanical powdering method or polymerization granulation method. These methods can be applied to the production of resin grains for both of dry type electrodeposition and wet type electrodeposition.

The mechanical powdering method for producing powder grains used in the dry type electrodeposition method includes a method wherein the thermoplastic resin is directly powdered by a conventionally known pulverizer to form fine grains (for example, a method using a ball mill, a paint shaker or a jet mill). If desired, mixing, melting and kneading of the materials for resin grains before the powdering and classification for a purpose of controlling a grain diameter and after-treatment for treating the surface of grain after the powdering may be performed in an appropriate combination. A spray dry method is also employed.

Specifically, the powder grains can be easily produced by appropriately using a method as described in detail, for example, in Shadanhojin Nippon Funtai Kogyo Gijutsu Kyokai (ed.), *Zoryu Handbook,* II ed., Ohm Sha (1991), Kanagawa Keiei Kaihatsu Center, *Saishin Zoryu Gijutsu no Jissai,* Kanagawa Keiei Kaihatsu Center Shuppan-bu (1984), and Masafumi Arakawa et al (ed.), *Saishin Funtai no Sekkei Gijutsu,* Techno System (1988).

The polymerization granulation methods include conventionally known methods using an emulsion polymerization reaction, a seed polymerization reaction or a suspension polymerization reaction each conducted in an aqueous system, or using a dispersion polymerization reaction conducted in a non-aqueous solvent system.

More specifically, grains are formed according to the methods as described, for example, in Soichi Muroi, *Kobunshi Latex no Kagaku,* Kobunshi Kankokai (1970), Taira Okuda and Hiroshi Inagaki, *Gosei Jushi Emulsion,* Kobunshi Kankokai (1978), soichi Muroi, *Kobunshi Latex Nyumon,* Kobunsha (1983), I. Pürma and P. C. Wang, *Emulsion Polymerization,* I. Pürma and J. L. Gaudon, *ACS Symp. Sev.,* 24, p. 34 (1974), Fumio Kitahara et al, *Bunsan Nyukakei no Kagaku,* Kogaku Tosho (1979), and Soichi Muroi (supervised), *Chobiryushi Polymer no Saisentan Gijutsu,* C.M.C. (1991), and then collected and pulverized in such a manner as described in the reference literatures cited with respect to the mechanical method above, thereby the resin grains being obtained.

In order to conduct dry type electrodeposition of the fine powder grains thus-obtained, a conventionally known method, for example, a coating method of electrostatic powder and a developing method with a dry type electrostatic developing agent can be employed. More specifically, a method for electrodeposition of fine grains electrically charged by a method utilizing, for example, corona charge, triboelectrification, induction charge, ion flow charge, and inverse ionization phenomenon, as described, for example, in J. F. Hughes, *Seiden Funtai Toso,* translated by Hideo Nagasaka and Machiko Midorikawa, or a developing method, for example, a cascade method, a magnetic brush method, a fur brush method, an electrostatic method, an induction method, a touchdown method and a powder cloud method, as described, for example, in Koich Nakamura (ed.), *Saikin no Denshishashin Genzo System to Toner Zairyo no Kaihatsu•Jitsuyoka,* Ch. 1, Nippon Kogaku Joho (1985) is appropriately employed.

The production of resin grains dispersed in a non-aqueous system which are used in the wet type electrodeposition method can also be performed by any of the mechanical powdering method and polymerization granulation method as described above.

The mechanical powdering method includes a method wherein the thermoplastic resin is dispersed together with a dispersion polymer in a wet type dispersion machine (for example, a ball mill, a paint shaker, a Keddy mill, and a Dyno-mill), and a method wherein the materials for resin grains and a dispersion assistant polymer (or a covering polymer) have been previously kneaded, the resulting mixture is pulverized and then is dispersed together with a dispersion polymer. Specifically, a method of producing paints or electrostatic developing agents can be utilized as described, for example, in Kenji Ueki (translated), *Toryo no Ryudo to Ganryo Bunsan,* Kyoritsu Shuppan (1971), D. E. Solomon, *The Chemistry of Organic Film Formers,* John Wiley & Sons (1967), *Paint and Surface Coating Theory and Practice*, Yuji Harasaki, *Coating Kogaku,* Asakura Shoten (1971), and Yuji Harasaki, *Coating no Kiso Kagaku,* Maki Shoten (1977).

The polymerization granulation method includes a seed polymerization method. Specifically, fine grains are first prepared by a dispersion polymerization method in a non-aqueous system conventionally known as described, for example, in *Chobiryushi Polymer no Saisentan Gijutsu,* Ch. 2, mentioned above, *Saikin no Denshishashin Genzo System to Toner Zairyo no Kaihatsu•Jitsuyoka*, Ch. 3, mentioned above, and K. E. J. Barrett, *Dispersion Polymerization in Organic Media*, John Wiley & Sons (1975), and then using these fine grains as seeds, the desired resin grains are prepared by supplying monomer(s) corresponding to the resin (A) in the same manner as above.

The resin grains composed of a random copolymer containing the polymer component (F) can be easily obtained by performing a polymerization reaction using monomers corresponding to the resin (A) together with a monomer corresponding to the polymer component (F) according to the polymerization granulation method described above.

The resin grains containing the polymer component (F) as a block can be prepared by conducting a polymerization reaction using, as a dispersion stabilizing resins, a block copolymer containing the polymer component (F) as a block, or conducting polymerization reaction using a monofunctional macromonomer having a weight average molecular weight of from $1\times10^3$ to $2\times10^4$, preferably from $3\times10^3$ to $5\times10^4$ and containing the polymer component (F) as main repeating unit together with monomers corresponding to the resin (A). Alternatively, the resin grains composed of block copolymer can be obtained by conducting a polymerization reaction using a polymer initiator (for example, azobis polymer initiator or peroxide polymer initiator) containing the polymer component (F) as main repeating unit.

As the non-aqueous solvent used for the preparation of resin grains dispersed in a non-aqueous system, there can be used any of organic solvents having a boiling point of at most 200° C., individually or in a combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

When the dispersed resin grains are synthesized by the dispersion polymerization method in a non-aqueous solvent system, the average grain diameter of the dispersed resin grains can readily be adjusted to at most 1 $\mu$m while simultaneously obtaining grains of monodisperse system with a very narrow distribution of grain diameters.

A dispersive medium used for the resin grains dispersed in a non-aqueous system is preferably a non-aqueous solvent having an electric resistance of not less than $10^8$ Ω•cm and a dielectric constant of not more than 3.5, since the dispersion is employed in a method wherein the resin grains are electrodeposited utilizing a wet type electrostatic photographic developing process or electrophoresis in electric fields.

The insulating solvents which can be used include straight chain or branched chain aliphatic hydrocarbons, alicyclic hydrocarbons, aromatic hydrocarbons, and halogen-substituted derivatives thereof. Specific examples of the solvent include octane, isooctane, decane, isodecane, decalin, nonane, dodecane, isododecane, cyclohexane, cyclooctane, cyclodecane, benzener toluene, xylene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 Solvent (Amsco: trade name of Americal Mineral Spirits Co.). They may be used singly or as a combination thereof.

The insulating organic solvent described above is preferably employed as a non-aqueous solvent from the beginning of polymerization granulation of resin grains dispersed in the non-aqueous system. However, it is also possible that the granulation is performed in a solvent other than the above-described insulating solvent and then the dispersive medium is substituted with the insulating solvent to prepare the desired dispersion.

Another method for the preparation of a dispersion of resin grains in non-aqueous system is that a block copolymer comprising a polymer portion which is soluble in the above-described non-aqueous solvent having an electric resistance of not less than $10^8$ Ω•cm and a dielectric constant of not more than 3.5 and a polymer portion which is insoluble in the non-aqueous solvent, is dispersed in the non-aqueous solvent by a wet type dispersion method. Specifically, the block copolymer is first synthesized in an organic solvent which dissolves the resulting block copolymer according to the synthesis method of block copolymer as described above and then dispersed in the non-aqueous solvent described above.

In order to electrodeposit dispersed grains in a dispersive medium upon electrophoresis, the grains must be electroscopic grains of positive charge or negative charge. The impartation of electroscopicity to the grains can be performed by appropriately utilizing techniques on developing agents for wet type electrostatic photography. More specifically, it can be carried out using electroscopic materials and other additives as described, for example, in *Saikin no Denshishashin Genzo System to Toner Zairyo no Kaihatsu•Jitsuyoka,* pp. 139 to 148, mentioned above, Denshishashin Gakkai (ed.), *Denshishashin Gijutsu no Kiso to Oyo,* pp. 497 to 505, Corona Sha (1988), and Yuji Harasaki, *Denshishashin,* Vol. 16, No. 2, p. 44 (1977). Further, compounds as described, for example, in British Patents 893,429 and 934,038, U.S. Pat. Nos. 1,122,397, 3,900,412 and 4,606,989, JP-A-60-179751, JP-A-60-185963 and JP-A-2-13965 are employed.

The dispersion of resin grains in a non-aqueous system (latex) which can be employed for electrodeposition usually comprises from 0.1 to 20 g of grains containing the thermoplastic resin, from 0.01 to 50 g of a dispersion stabilizing resin and if desired, from 0.0001 to 10 g of a charge control agent per one liter of an electrically insulating dispersive medium.

Furthermore, if desired, other additives may be added to the dispersion of resin grains in order to maintain dispersion stability and charging stability of grains. Suitable examples of such additives include rosin, petroleum resins, higher alcohols, polyethers, silicone oil, paraffin wax and triazine derivatives. The total amount of these additives is restricted by the electric resistance of the dispersion. Specifically, if the electric resistance of the dispersion in a state of excluding the grains therefrom becomes lower than $10^8$ Ω•cm, a sufficient amount of the thermoplastic resin grains deposited is reluctant to obtain and, hence, it is necessary to control the amounts of these additives in the range of not lowering the electric resistance than $10^8$ Ω•cm.

The thermoplastic resin grains (ARW) which are prepared, provided with an electrostatic charge and dispersed in an electrically insulting liquid behave in the same manner as an electrophotographic wet type developing agent. For instance, the resin grains can be subjected to electrophoresis on the surface of light-sensitive element using a developing device, for example, a slit development electrode device as described in *Denshishashin Gijutsu no Kiso to Oyo,* pp. 275 to 285, mentioned above. Specifically, the grains comprising the thermoplastic resin are supplied between the electrophotographic light-sensitive element and an electrode placed in face of the light-sensitive element, and migrated by electrophoresis according to a potential gradient applied from an external power source to cause the grains to adhere to or electrodeposit on the electrophotographic light-sensitive element, thereby a film being formed.

In general, if the charge of grains is positive, an electric voltage was applied between an electroconductive support of the light-sensitive element and a development electrode of a developing device from an external power source so that the light-sensitive material is negatively charged, thereby the grains being electrostatically electrodeposited on the surface of light-sensitive element.

Electrodeposition of grains can also be performed by wet type toner development in a conventional electrophotographic process. Specifically, the light-sensitive element is uniformly charged and then subjected to a conventional wet type toner development without exposure to light or after conducting a so-called print-off in which only unnecessary regions are exposed to light, as described in *Denshishashin Gilutsu no Kiso to Oyo*, pp. 46 to 79, mentioned above.

The medium for the resin grains dispersed therein which becomes liquid by heating is an electrically insulating organic compound which is solid at normal temperature and becomes liquid by heating at temperature of from 30° C. to 80° C., preferably from 40° C. to 70° C. Suitable compounds include paraffines having a solidifying point of from 30° C. to 80° C., waxes, low molecular weight polypropylene having a solidifying point of from 20° C. to 80° C., beef tallow having a solidifying point of from 20° C. to 50° C. and hardened oils having a solidifying point of from 30° C.

to 80° C. They may be employed individually or as a combination of two or more thereof.

Other characteristics required are same as those for the dispersion of resin grains used in the wet type developing method.

The resin grains used in the pseudo-wet type electrodeposition according to the present invention can stably maintain their state of dispersion without the occurrence of heat adhesion of dispersed resin grains by forming a core/shell structure wherein the core portion is composed of a resin having a lower glass transition point or softening point and the shell portion is composed of a resin having a higher glass transition point or softening point which is not softened at the temperature at which the medium used becomes liquid.

The amount of thermoplastic resin grain adhered to the light-sensitive element can be appropriately controlled, for example, by an external bias voltage applied, a potential of the light-sensitive element charged and a processing time.

After the electrodeposition of grains, the dispersive medium is wiped off upon squeeze using a rubber roller, a gap roller or a reverse roller. Other known methods, for example, corona squeeze and air squeeze can also be employed. Then, the deposit is dried with cool air or warm air or by an infrared lamp preferably to be rendered the thermoplastic resin grains in the form of a film, thereby the transfer layer being formed.

Now, the electrophotographic light-sensitive element which can be used in the present invention will be described in detail below.

Any conventionally known electrophotographic light-sensitive element can be employed. What is important is that the surface of light-sensitive element has the specified releasability at the time for the formation of toner image so as to easily release the toner image together with the transfer layer provided thereon.

More specifically, an electrophotographic light-sensitive element wherein an adhesive strength of the surface thereof measured according to JIS Z 0237-1980 "Testing methods of pressure sensitive adhesive tapes and sheets" is not more than 100 gram•force (g•f) is preferably employed.

The measurement of adhesive strength is conducted according to JIS Z 0237-1980 8.3.1. 180 *Degrees Peeling Method* with the following modifications:

(i) As a test plate, an electrophotographic light-sensitive element comprising a substrate and a photoconductive layer, on the surface of which a toner image is to be formed is used.

(ii) As a test piece, a pressure resistive adhesive tape of 6 mm with a tolerance ±1.0 in width prepared according to JIS C 2338-1984 is used.

The thickness of the adhesive tape shall be 0.05 mm with a tolerance ±0.020, and the length shall be 10 m with a tolerance ±1.0. The adhesive tape is made in such a way that pressure-sensitive adhesive is spread uniformly on one side of a polyester film specified in JTS C 2338, the coated film is wound tightly on a core of 25 mm or more inner diameter with the pressure-sensitive adhesive side being inside. The adhesive tape shall be uniform in thickness and width, rich in tackiness and durability, uniform in electric insulation property, not corrosive for metals in contact, and free from substances harmful to electrical insulation.

Specifically, a peeling test with an angle of 180 degrees is conducted according to the following procedure:

(a) Lay the adhesive face downward and true up each one edge of the test piece upon the cleared test plate, allow the test piece to be placed at the midway of the test plate, and keep free the remainder of the test piece 125 mm in length and powder with talc or stick a paper thereon.

Let the roller reciprocate one stroke at a rate of approximately 300 mm/min upon the test piece for pressure sticking.

Within 20 to 40 minutes after sticking with pressure, fold the free part of the test piece through 180 degrees, peel a part of the stuck portion approximately 25 mm in length, insert the test piece into the upper chuck and the test plate into the lower chuck, and peel at a rate of 120 mm/min using a constant rate of traverse type tensile testing machine.

(b) Detach the click, peel continuously, read the strength at an interval of approximately 20 mm in length of peeling, and eventually read 4 times. The test shall be made on three test pieces.

(c) Determine the mean value from 12 measured values for three test pieces, and convert this mean value in terms ov 10 mm width.

The measurement of adhesive strength of the surface of primary receptor or receiving material is also conducted in the same manner as described above using the primary receptor or receiving material to be measured as the test plate.

The adhesive strength of the surface of electrophotographic light-sensitive element is more preferably not more than 50 g•f, and particularly preferably not more than 30 g•f.

In order to obtain an electrophotographic light-sensitive element having a surface of the desired releasability, there are a method of using an electrophotographic light-sensitive element which has already the surface exhibiting the desired releasability (first method), and a method of applying a compound (S) exhibiting the desired releasability to a surface of electrophotographic light-sensitive element before the formation of toner image (second method). These methods may be employed in combination.

One example of the electrophotographic light-sensitive element, the surface of which has the releasability, used in the first method is an electrophotographic light-sensitive element using amorphous silicon as a photoconductive substance. Another example thereof is an electrophotographic light-sensitive element containing a polymer having a polymer component containing a fluorine atom and/or a silicon atom in a region near to the surface thereof.

The term "region near to the surface of electrophotographic light-sensitive element" used herein means the uppermost layer of the light-sensitive element and includes an overcoat layer provided on a photoconductive layer and the uppermost photoconductive layer. Specifically, an overcoat layer is provided on the light-sensitive element having a photosensitive layer as the uppermost layer which contains the above-described polymer to impart the releasability, or the above-described polymer is incorporated into the uppermost layer of a photoconductive layer (including a single photoconductive layer and a laminated photoconductive layer) to modify the surface thereof so as to exhibit the releasability. By using such a light-sensitive element, the toner image can be easily and completely transferred together with the transfer layer onto a primary receptor since the surface of the light-sensitive element has the good releasability.

In order to impart the releasability to the overcoat layer or the uppermost photoconductive layer, a polymer containing a silicon atom and/or a fluorine atom is used as a binder resin of the layer. It is preferred to use a small amount of a block copolymer containing a polymer segment comprising a silicon atom and/or fluorine atom-containing polymer component described in detail below (hereinafter referred to as a surface-localized type block copolymer) in combination with other binder resins. Further, such polymers containing a silicon atom and/or a fluorine atom are employed in the form of grains.

In the case of providing an overcoat layer, it is preferred to use the above-described surface-localized type block copolymer together with other binder resins of the layer for maintaining sufficient adhesion between the overcoat layer and the photoconductive layer.

The surface-localized type copolymer is ordinarily used in a proportion of from 0.1 to 20 parts by weight per 100 parts by weight of the total composition of the overcoat layer or in a proportion of from 0.5 to 30 parts by weight per 100 parts by weight of the total composition of the uppermost photoconductive layer.

Specific examples of the overcoat layer include a protective layer which is a surface layer provided on the light-sensitive element for protection known as one means for ensuring durability of the surface of a light-sensitive element for a plain paper copier (PPC) using a dry toner against repeated use. For instance, techniques relating to a protective layer using a silicon type block copolymer are described, for example, in JP-A-61-95358, JP-A-55-83049, JP-A-62-87971, JP-A-61-189559, JP-A-62-75461, JP-A-61-139556, JP-A-62-139557, and JP-A-62-208055. Techniques relating to a protective layer using a fluorine type block copolymer are described, for example, in JP-A-61-116362, JP-A-61-117563, JP-A-61-270768, and JP-A-62-14657. Techniques relating to a protecting layer using grains of a resin containing a fluorine-containing polymer component in combination with a binder resin are described in JP-A-63-249152 and JP-A-63-221355.

On the other hand, the method of modifying the surface of the uppermost photoconductive layer so as to exhibit the releasability is effectively applied to a so-called disperse type light-sensitive element which contains at least a photoconductive substance and a binder resin.

Specifically, a layer constituting the uppermost layer of a photoconductive layer is made to contain either one or both of a block copolymer resin comprising a polymer segment containing a fluorine atom and/or silicon atom-containing polymer component as a block and resin grains containing a fluorine atom and/or silicon atom-containing polymer component, whereby the resin material migrates to the surface of the layer and is concentrated and localized there to have the surface imparted with the releasability. The copolymers and resin grains which can be used include those described in European Patent Application No. 534,479A1.

In order to further ensure surface localization, a block copolymer comprising at least one fluorine atom and/or fluorine atom-containing polymer segment and at least one polymer segment containing a photo- and/or heat-curable group-containing component as blocks can be used as a binder resin for the overcoat layer or the uppermost photoconductive layer. Examples of such polymer segments containing a photo- and/or heat-curable group-containing component are described in European Patent Application No. 534,279A1. Alternatively, a photo- and/or heat-curable resin may be used in combination with the fluorine atom and/or silicon atom-containing resin in the present invention.

The polymer comprising a polymer component containing a fluorine atom and/or a silicon atom effectively used for modifying the surface of the electrophotographic light-sensitive element according to the present invention include a resin (hereinafter referred to as resin (P) sometimes) and resin grain (hereinafter referred to as resin grain (PL) sometimes).

Where the polymer containing a fluorine atom and/or silicon atom-containing polymer component used in the present invention is a random copolymer, the content of the fluorine atom and/or silicon atom-containing polymer component is preferably at least 60% by weight, and more preferably at least 80% by weight based on the total polymer component.

In a preferred embodiment, the above-described polymer is a block copolymer comprising at least one polymer segment ($\alpha$) containing at least 50% by weight of a fluorine atom and/or silicon atom-containing polymer component and at least one polymer segment ($\beta$) containing 0 to 20% by weight of a fluorine atom and/or silicon atom-containing polymer component, the polymer segments ($\alpha$) and ($\beta$) being bonded in the form of blocks. More preferably, the polymer segment ($\beta$) of the block copolymer contains at least one polymer component containing at least one photo- and/or heat-curable functional group.

It is preferred that the polymer segment ($\beta$) does not contain any fluorine atom and/or silicon atom-containing polymer component.

As compared with the random copolymer, the block copolymer comprising the polymer segments ($\alpha$) and ($\beta$) (surface-localized type copolymer) is more effective not only for improving the surface releasability but also for maintaining such a releasability.

More specifically, where a film is formed in the presence of a small amount of the resin (P) or resin grains (PL) of copolymer containing a fluorine atom and/or a silicon atom, the resins (P) or resin grains (PL) easily migrate to the surface portion of the film and are concentrated there by the end of a drying step of the film to thereby modify the film surface so as to exhibit the releasability.

Where the resin (P) is the block copolymer in which the fluorine atom and/or silicon atom-containing polymer segment ($\alpha$) exists as a block, the other polymer segment ($\beta$) containing no, or if any a small proportion of, fluorine atom and/or silicon atom-containing polymer component undertakes sufficient interaction with the film-forming binder resin since it has good compatibility therewith. Thus, during the formation of the toner image or transfer layer on the electrophotographic light-sensitive element, further migration of the resin into the toner image or transfer layer is inhibited or prevented by an anchor effect to form and maintain the definite interface between the toner image or transfer layer and the electrophotographic light-sensitive element.

Further, where the segment ($\beta$) of the block copolymer contains a photo- and/or heat-curable group, crosslinking between the polymer molecules takes place during the film formation to thereby ensure retention of the releasability at the interface between the light-sensitive element and the toner image or transfer layer. Such a crosslinked structure is particularly advantageous when the light-sensitive element is repeatedly employed and when a liquid developer is used for the formation of toner image.

The above-described polymer may be used in the form of resin grains as described above. Preferred resin grains (PL) are resin grains dispersible in a non-aqueous solvent. Such resin grains include a block copolymer comprising a non-aqueous solvent-insoluble polymer segment ($\alpha$) which contains a fluorine atom and/or silicon atom-containing polymer component and a non-aqueous solvent-soluble polymer segment ($\beta$) which contains no, or if any not more than 20% of, fluorine atom and/or silicon atom-containing polymer component.

Where the resin grains (PL) according to the present invention are used in combination with a binder resin, the insolubilized polymer segment undertakes migration of the grains to the surface portion and concentration there while the soluble polymer segment exerts an interaction with the binder resin (an anchor effect) similarly to the above-described resin (P). When the resin grains contain a photo- and/or heat-curable group, further-migration of the grains to the toner image or transfer layer can be avoided.

The polymer component containing a moiety having a fluorine atom and/or a silicon atom which is incorporated into the resin (P) or resin grains (PL) is same as the polymer component (F) described with respect to the resin (A) used for the transfer layer above.

Of the resins (P) and resin grains (PL) each containing silicon atom and/or fluorine atom used in the uppermost layer of the electrophotographic light-sensitive element according to the present invention, the so-called surface-localized type copolymers will be described in detail below.

The content of the silicon atom and/or fluorine atom-containing polymer component in the segment (α) is at least 50% by weight, preferably at least 70% by weight, and more preferably at least 80% by weight. The content of the fluorine atom and/or silicon atom-containing polymer component in the segment (β) bonded to the segment (α) is not more than 20% by weight, and preferably 0% by weight.

A weight ratio of segment (α)/segment (β) ranges usually from 1/99 to 95/5, and preferably from 5/95 to 90/10. If the weight ratio is out of this range, the migration effect and anchor effect of the resin (P) or resin grain (PL) at the surface region of light-sensitive element are decreased.

The resin (P) preferably has a weight average molecular weight of from $5\times10^3$ to $1\times10^6$, and more preferably from $1\times10^4$ to $5\times10^5$. The segment (α) in the resin (P) preferably has a weight average molecular weight of at least $1\times10^3$.

The resin grain (PL) preferably has an average grain diameter of from 0.001 to 1 μm, and more preferably from 0.05 to 0.5 μm.

As a preferred embodiment of the surface-localized type copolymer in the resin (P) according to the present invention, any type of the block copolymer can be used as far as the fluorine atom and/or silicon atom-containing polymer components are contained therein as a block. The term "to be contained as a block" means that the polymer has the polymer segment containing at least 50% by weight of the fluorine atom and/or silicon atom-containing polymer component based on the weight of the polymer segment. The forms of blocks include an A-B type block, an A-B-A type block, a B-A-B type block, a grafted type block, and a starlike type block as described with respect to the resin (A) above. Also, these various types of block copolymers can be synthesized by conventionally known polymerizing methods. Specifically, those described with respect to the resin (A) above can be employed.

A preferred embodiment of the resin grain (PL) according to the present invention will be described below. As described above, the resin grain (PL) preferably comprises the fluorine atom and/or silicon atom-containing polymer segment (α) insoluble in a non-aqueous solvent and the polymer segment (β) which is soluble in the non-aqueous solvent and contains substantially no fluorine atom and/or silicon atom. The polymer segment (α) constituting the insoluble portion of the resin grain may have a crosslinked structure.

A preferred method for synthesizing the resin grain (PL) includes the dispersion polymerization method in a non-aqueous solvent system described above.

The non-aqueous solvents which can be used in the preparation of non-aqueous solvent-dispersed resin grains include any organic solvents having a boiling point of not more than 200° C., either individually or in combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

Dispersion polymerization in such a non-aqueous solvent system easily results in the production of mono-dispersed resin grains having an average grain diameter of not greater than 1 μm with a very narrow size distribution.

More specifically, a monomer corresponding to the polymer component constituting the segment (α) (hereinafter referred to as a monomer (a)) and a monomer corresponding to the polymer component constituting the segment (β) (hereinafter referred to as a monomer (b)) are polymerized by heating in a non-aqueous solvent capable of dissolving a monomer (a) but incapable of dissolving the resulting polymer in the presence of a polymerization initiator, for example, a peroxide (e.g., benzoyl peroxide or lauroyl peroxide), an azobis compound (e.g., azobisisobutyronitrile or azobisisovaleronitrile), or an organometallic compound (e.g., butyl lithium). Alternatively, a monomer (a) and a polymer comprising the segment (β) (hereinafter referred to as a polymer (Pβ)) are polymerized in the same manner as described above.

The inside of the resin grain (PL) according to the present invention may have a crosslinked structure. The formation of crosslinked structure can be conducted by any of conventionally known techniques. For example, (i) a method wherein a polymer containing the polymer segment (α) is crosslinked in the presence of a crosslinking agent or a curing agent; (ii) a method wherein at least the monomer (a) corresponding to the polymer segment (α) is polymerized in the presence of a polyfunctional monomer or oligomer containing at least two polymerizable functional groups to form a network structure over molecules; or (iii) a method wherein the polymer segment (α) and a polymer containing a reactive group-containing polymer component are subjected to a polymerization reaction or a polymer reaction to cause crosslinking may be employed.

The crosslinking agents to be used in the method (i) include those commonly employed as described, e.g., in Shinzo Yamashita and Tosuke Kaneko (ed.), *Kakyozai Handbook,* Taiseisha (1981) and Kobunshi Gakkai (ed.), *Kobunshi Data Handbook* (*Kiso-hen*), Baifukan (1986).

Specific examples of suitable crosslinking agents include organosilane compounds (such as those known as silane coupling agents, e.g., vinyltrimethoxysilane, vinyltributoxysilane, γ-glycidoxypropyltrimethoxysilane, γ-mercaptopropyltriethoxysilane, and γ-aminopropyltriethoxysilane), polyisocyanate compounds (e.g., toluylene diisocyanate, diphenylmethane diisocyanate, triphenylmethane triisocyanate, polymethylenepolyphenyl isocyanate, hexamethylene diisocyanate, isophorone diisocyanate, and polymeric polyisocyanates), polyol compounds (e.g., 1,4-butanediol, polyoxypropylene glycol, polyoxyethylene glycols, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), titanate coupling compounds (e.g., titanium tetrabutoxide, titanium tetrapropoxide, and isopropyltristearoyl titanate), aluminum coupling compounds (e.g., aluminum butylate, aluminum acetylacetate, aluminum oxide octate, and aluminum trisacetylacetate), polyepoxy-containing compounds and epoxy resins (e.g., the compounds as described in Hiroshi Kakiuchi (ed.), *Shin-Epoxy Jushi,* Shokodo (1985) and Kuniyuki Hashimoto (ed.), *Epoxy Jushi,* Nikkan Kogyo Shinbunsha (1969)), melamine resins (e.g., the compounds as described in Ichiro Miwa and Hideo Matsunaga (ed.)., *Urea•Melamine Jushi,* Nikkan Kogyo Shinbunsha (1969)), and poly(meth)acrylate compounds (e.g., the compounds as described in Shin Okawara, Takeo Saegusa, and Toshinobu Higashimura (ed.), *Oligomer,* Kodansha (1976), and Eizo Omori, *Kinosei Acrylkei Jushi,* Techno System (1985)).

Specific examples of the polymerizable functional groups which are contained in the polyfunctional monomer or oligomer (the monomer will sometimes be referred to as a polyfunctional monomer (d)) having two or more polymerizable functional groups used in the method (ii) above include $CH_2{=}CH{-}CH_2{-}$, $CH_2{=}CH{-}CO{-}O{-}$, $CH_2{=}CH{-}$, $C_2{=}C(CH_3){-}CO{-}O{-}$, $CH(CH_3){=}CH{-}CO{-}O{-}$, $CH_2{=}CH{-}CONH{-}$, $CH_2{=}C(CH_3){-}CONH{-}$, $CH(CH_3){=}CH{-}CONH{-}$, $CH_2{=}CH{-}O{-}CO{-}$, $CH_2{=}C(CH_3){-}O{-}CO{-}$, $CH_2{=}CH{-}CH_2{-}O{-}CO{-}$, $CH_2{=}CH{-}NHCO{-}$, $CH_2{=}CH{-}CH_2{-}NHCO{-}$, $CH_2{=}CH{-}SO_2{-}$, $CH_2{=}CH{-}CO{-}$, $CH_2{=}CH{-}O{-}$, and $CH_2{=}CH{-}S{-}$. The two or more polymerizable functional groups present in the polyfunctional monomer or oligomer may be the same or different.

Specific examples of the monomer or oligomer having the same two or more polymerizable functional groups include styrene derivatives (e.g., divinylbenzene and trivinylbenzene); methacrylic, acrylic or crotonic acid esters, vinyl ethers or allyl ethers of polyhydric alcohols (e.g., ethylene glycol, diethylene glycol, triethylene glycol, polyethylene glycol 200, 400 or 600, 1,3-butylene glycol, neopentyl glycol, dipropylene glycol, polypropylene glycol, trimethylolpropane, trimethylolethane, and pentaerythritol) or polyhydric phenols (e.g., hydroquinone, resorcin, catechol, and derivatives thereof); vinyl esters, allyl esters, vinyl amides, or allyl amides of dibasic acids (e.g., malonic acid, succinic acid, glutaric acid, adipic acid, pimelic acid, maleic acid, phthalic acid, and itaconic acid); and condensation products of polyamines (e.g., ethylenediamine, 1,3-propylenediamine, and 1,4-butylenediamine) and vinyl-containing carboxylic acids (e.g., methacrylic acid, acrylic acid, crotonic acid, and allylacetic acid).

Specific examples of the monomer or oligomer having two or more different polymerizable functional groups include reaction products between vinyl-containing carboxylic acids (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a carboxylic acid anhydride) and alcohols or amines, vinyl-containing ester derivatives or amide derivatives (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethylene acrylate, N-allylacrylamide, N-allylmethacrylamide, N-allylitaconamide, and methacryloylpropionic acid allylamide) and condensation products between amino alcohols (e.g., aminoethanol, 1-aminopropanol, 1-aminobutanol, 1-aminohexanol, and 2-aminobutanol) and vinyl-containing carboxylic acids.

The monomer or oligomer containing two or more polymerizable functional groups is used in an amount of not more than 10 mol %, and preferably not more than 5 mol %, based on the total amount of monomer (a) and other monomers copolymerizable with monomer (a) to form the resin.

Where crosslinking between polymer molecules is conducted by the formation of chemical bonds upon the reaction of reactive groups in the polymers according to the method (iii), the reaction may be effected in the same manner as usual reactions of organic low-molecular weight compounds.

From the standpoint of obtaining mono-dispersed resin grains having a narrow size distribution and easily obtaining fine resin grains having a diameter of 0.5 μm or smaller, the method (ii) using a polyfunctional monomer is preferred for the formation of network structure. Specifically, a monomer (a), a monomer (b) and/or a polymer (Pβ) and, in addition, a polyfunctional monomer (d) are subjected to polymerization granulation reaction to obtain resin grains. Where the above-described polymer (Pβ) comprising the segment (β) is used, it is preferable to use a polymer (Pβ') which has a polymerizable double bond group copolymerizable with the monomer (a) in the side chain or at one terminal of the main chain of the polymer (Pβ).

The polymerizable double bond group is not particularly limited as far as it is copolymerizable with the monomer (a). Specific examples thereof include

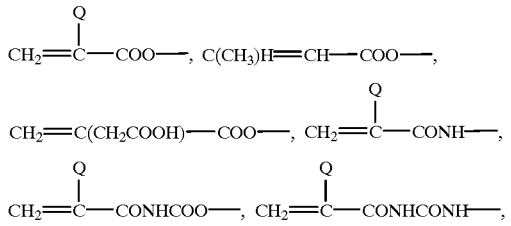

$C(CH_3)H{=}CH{-}CONH{-}$, $CH_2{=}CHCO{-}$, $CH_2{=}CH(CH_2)_g{-}OCO{-}$, $CH_2{=}CHO{-}$, and $CH_2{=}CH{-}C_6H_4{-}$, wherein Q represents —H or $-CH_3$, and g represents 0 or an integer of from 1 to 3.

The polymerizable double bond group may be bonded to the polymer chain either directly or via a divalent organic residue. Specific examples of these polymers include those described, for example, in JP-A-61-43757, JP-A-1-257969, JP-A-2-74956, JP-A-1-282566, JP-A-2-173667, JP-A-3-15862, and JP-A-4-70669.

In the preparation of resin grains, the total amount of the polymerizable compounds used is from about 5 to about 80 parts by weight, preferably from 10 to 50 parts by weight, per 100 parts by weight of the non-aqueous solvent. The polymerization initiator is usually used in an amount of from 0.1 to 5% by weight based on the total amount of the polymerizable compounds. The polymerization is carried out at a temperature of from about 30° to about 180° C., and preferably from 40° to 120° C. The reaction time is preferably from 1 to 15 hours.

Now, an embodiment in which the resin (P) contains a photo- and/or heat-curable group or the resin (P) is used in combination with a photo- and/or heat-curable resin will be described below.

The polymer components containing at least one photo- and/or heat-curable group, which may be incorporated into the resin (P), include those described in the above-cited literature references. More specifically, the polymer components containing the above-described polymerizable functional group(s) can be used.

The content of the polymer component containing at least one photo- and/or heat-curable group ranges preferably from 1 to 95 parts by weight, more preferably from 10 to 70 parts by weight, based on 100 parts by weight of the polymer segment (β) in the block copolymer (P). Also, the polymer component is preferably contained in the range of from 5 to 40 parts by weight per 100 parts by weight of the total polymer components in the resin (P).

If the content is too small, curing of the photoconductive layer after film formation does not proceed sufficiently, sometimes resulting in insufficient maintenance of the interface between the photoconductive layer and the transfer layer formed thereon. If the content is too large, the electrophotographic characteristics of the photoconductive layer may be deteriorated sometimes, resulting in reduction in reproducibility of original in duplicated image and occurrence of background fog in non-image areas.

The photo- and/or heat-curable group-containing resin (P) is preferably used in an amount of not more than 40% by weight based on the total binder resin. If the proportion of the resin (P) is too high, the electrophotographic characteristics of the light-sensitive element tend to be deteriorated.

The fluorine atom and/or silicon atom-containing resin may also be used in combination with a photo- and/or heat-curable resin (D) in the present invention.

Any of conventionally known curable resins may be used as the photo- and/or heat-curable resin (D). For example, resins containing the curable group as described with respect to the block copolymer (P) may be used.

Further, conventionally known binder resins for an electrophotographic light-sensitive layer are employed. These resins will be described in detail as binder resins used in the photoconductive layer hereinafter.

As described above, while the uppermost layer of light-sensitive element, for example, the overcoat layer or the photoconductive layer contains the silicon atom and/or fluorine atom-containing resin and, if desired, other binder resins, it is preferred that the layer further contains a small amount of photo- and/or heat-curable resin (D) and/or a crosslinking agent for further improving film curability.

The amount of photo- and/or heat-curable resin (D) and/or crosslinking agent to be added is from 0.01 to 20% by weight, and preferably from 0.1 to 15% by weight, based on the total amount of the whole resin. If the amount is less than 0.01% by weight, the effect of improving film curability decreases. If it exceeds 20% by weight, the electrophotographic characteristics may be adversely affected.

A combined use of a crosslinking agent is preferable. Any of ordinarily employed crosslinking agents may be utilized. Suitable crosslinking agents are described, e.g., in Shinzo Yamashita and Tosuke Kaneko (ed.), *Kakyozai Handbook,* Taiseisha (1981) and Kobunshi Gakkai (ed.), *Kobunshi Data Handbook* (*Kiso-hen*), Baifukan (1986).

Specific examples of suitable crosslinking agents include those described hereinbefore. In addition, monomers containing a polyfunctional polymerizable group (e.g., vinyl methacrylate, acryl methacrylate, ethylene glycol diacrylate, polyethylene glycol diacrylate, divinyl succinate, divinyl adipate, diacryl succinate, 2-methylvinyl methacrylate, trimethylolpropane trimethacrylate, divinylbenzene, and pentaerythritol polyacrylate) may also be used as the crosslinking agent.

As described above, the uppermost layer of the photoconductive layer (a layer which will be in contact with the transfer layer) is preferably cured after film formation. It is preferred that the binder resin, the surface-localized type copolymer (P), the curable resin (D), and the crosslinking agent to be used in the photoconductive layer are so selected and combined that their functional groups easily undergo chemical bonding to each other.

Combinations of functional groups which easily undergo a polymer reaction are well known. Specific examples of such combinations are shown in Table A below, wherein a functional group selected from Group A can be combined with a functional group selected from Group B. However, the present invention should not be construed as being limited thereto.

TABLE A

| Group A | Group B |
|---|---|
| —COOH, —$PO_3H_2$, —OH, | 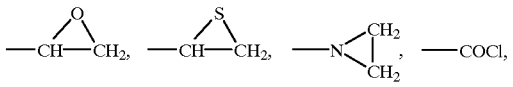 |
| —SH, —$NH_2$, —NHR, —$SO_2H$ | —$SO_2Cl$, a cyclic acid anhydride group, —N=C=O, —N=C=S, 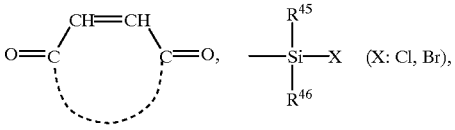 (X: Cl, Br), 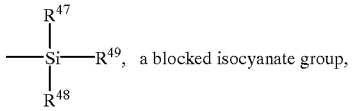 a blocked isocyanate group, |

TABLE A-continued

| Group A | Group B |
|---|---|
| | —NHCOOR′ (R′: —CH(CF$_3$)$_2$, 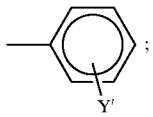 ; (Y′: —CH$_3$, —Cl, —OCH$_3$), |
| | —NHCOCH(B$^1$)(B$^2$) |
| | —NHCO—N(=C)  (e.g., an imidazole ring) |

In Table A, $R^{45}$ and $R^{46}$ each represents an alkyl group; $R^{47}$, $R^{48}$, and $R^{49}$ each represents an alkyl group or an alkoxy group, provided that at least one of them is an alkoxy group; R represents a hydrocarbon group; $B^1$ and $B^2$ each represents an electron attracting group, e.g., —CN, —$CF_3$, —$COR^{50}$, —$COOR^{50}$, —$SO_2OR^{50}$ ($R^{50}$ represents a hydrocarbon group, e.g., —$C_nH_{2n+1}$ (n: an integer of from 1 to 4), —$CH_2C_6H_5$, or —$C_6H_5$).

If desired, a reaction accelerator may be added to the binder resin for accelerating the crosslinking reaction in the light-sensitive layer.

The reaction accelerators which may be used for the crosslinking reaction forming a chemical bond between functional groups include organic acids (e.g., acetic acid, propionic acid, butyric acid, benzenesulfonic acid, and p-toluenesulfonic acid), phenols (e.g., phenol, chlorophenol, nitrophenol, cyanophenol, bromophenol, naphthol, and dichlorophenol), organometallic compounds (e.g., zirconium acetylacetonate, zirconium acetylacetone, cobalt acetylacetonate, and dibutoxytin dilaurate), dithiocarbamic acid compounds (e.g., diethyldithiocarbamic acid salts), thiuram disulfide compounds (e.g., tetramethylthiuram disulfide), and carboxylic acid anhydrides (e.g., phthalic anhydride, maleic anhydride, succinic anhydride, butylsuccinic anhydride, benzophenone-3,3',4,4'-tetracarboxylic acid dianhydride, and trimellitic anhydride).

The reaction accelerators which may be used for the crosslinking reaction involving polymerization include polymerization initiators, such as peroxides and azobis compounds.

After a coating composition for the light-sensitive layer is coated, the binder resin is preferably cured by light and/or heat. Heat curing can be carried out by drying under severer conditions than those for the production of a conventional light-sensitive element. For example, elevating the drying temperature and/or increasing the drying time may be utilized. After drying the solvent of the coating composition, the film is preferably subjected to a further heat treatment, for example, at 60° to 150° C. for 5 to 120 minutes. The conditions of the heat treatment may be made milder by using the above-described reaction accelerator in combination.

Curing of the resin containing a photocurable functional group can be carried out by incorporating a step of irradiation of actinic ray into the production line. The actinic rays to be used include visible light, ultraviolet light, far ultraviolet light, electron beam, X-ray, γ-ray, and α-ray, with ultraviolet light being preferred. Actinic rays having a wavelength range of from 310 to 500 nm are more preferred. In general, a low-, high- or ultrahigh-pressure mercury lamp or a halogen lamp is employed as a light source. Usually, the irradiation treatment can be sufficiently performed at a distance of from 5 to 50 cm for 10 seconds to 10 minutes.

Now, the second method for obtaining an electrophotographic light-sensitive element having a surface of the desired releasability will be described in detail below. According to the method, a compound (S) exhibiting the desired releasability is applied to a surface of a conventional electrophotographic light-sensitive element to cause the compound (S) to adhere to or adsorb on the surface before the formation of toner image, whereby the surface of light-sensitive element is provided with the desired releasability.

The compound (S) is a compound containing a fluorine atom and/or a silicon atom. The compound (S) containing a moiety having a fluorine and/or silicon atom is not particularly limited in its structure as far as it can improve releasability of the surface of electrophotographic light-sensitive element, and includes a low molecular weight compound, an oligomer, and a polymer.

When the compound (S) is an oligomer or a polymer, the moiety having a fluorine and/or silicon atom includes that incorporated into the main chain of the oligomer or polymer and that contained as a substituent in the side chain thereof. Of the oligomers and polymers, those containing repeating units containing the moiety having a fluorine and/or silicon atom as a block are preferred since they adsorb on the surface of electrophotographic light-sensitive element to impart good releasability.

The fluorine and/or silicon atom-containing moieties include those described with respect to the resin (A) suitable for use in the transfer layer above.

Specific examples of the compound (S) containing a fluorine and/or silicon atom which can be used in the present invention include fluorine and/or silicon-containing organic compounds described, for example, in Tokiyuki Yoshida, et al. (ed.), *Shin-ban Kaimenkasseizai Handbook,* Kogaku Tosho (1987), Takao Karikome, *Saishin Kaimenkasseizai Oyo Gijutsu*, C.M.C. (1990), Kunio Ito (ed.), *Silicone Handbook,* Nikkan Kogyo Shinbunsha (1990), Takao Karikome, *Tokushukino Kaimenkasseizai*, C.M.C. (1986), and A. M. Schwartz, et al., *Surface Active Agents and Detergents,* Vol. II.

Further, the compound (S) according to the present invention can be synthesized by utilizing synthesis methods as described, for example, in Nobuo Ishikawa, *Fussokagobutsu no Gosei to Kino,* C.M.C. (1987), Jiro Hirano et al. (ed.), *Ganfussoyukikagobutsu-Sono Gosei to Oyo,* Gijutsu Joho Kyokai (1991), and Mitsuo Ishikawa, *Yukikeiso Senryaku Shiryo,* Chapter 3, Science Forum (1991).

Specific examples of polymer components having the fluorine atom and/or silicon atom-containing moiety used in the oligomers or polymers of compound (S) include the polymer components (F) described with respect to the resin (A) above.

Of the oligomers or polymers of compounds (S), so-called block copolymers are preferred as described above. Specifically, the compound (S) may be any type of copolymer as far as it contains the fluorine atom and/or silicon atom-containing polymer components as a block. The term "to be contained as a block" means that the compound (S) has a polymer segment comprising at least 70% by weight of the fluorine atom and/or silicon atom-containing polymer component based on the weight of the polymer segment. The content of the polymer components present in the polymer segment constituting a block is preferably 90% by weight, more preferably 100% by weight. The forms of blocks include an A-B type block, an A-B-A type block, a B-A-B type block, a graft type block, and a starlike type block as schematically illustrated with respect to the resin (A) above. These block copolymers can be synthesized according to the methods described with respect to the resin (A) above.

By the application of compound (S) onto the surface of electrophotographic light-sensitive element, the surface is modified to have the desired releasability. The term "application of compound (S) onto the surface of electrophotographic light-sensitive element" means that the compound is supplied on the surface of electrophotographic light-sensitive element to form a state wherein the compound (S) is adsorbed or adhered thereon.

In order to apply the compound (S) to the surface of electrophotographic light-sensitive element, conventionally known various methods can be employed. For example, methods using an air doctor coater, a blade coater, a knife coater, a squeeze coater, a dip coater, a reverse roll coater, a transfer roll coater, a gravure coater, a kiss roll coater, a spray coater, a curtain coater, or a calender coater as described, for example, in Yuji Harasaki, *Coating Kogaku,* Asakura Shoten (1971), Yuji Harasaki, *Coating Hoshiki,* Maki Shoten (1979), and Hiroshi Fukada, *Hot-melt Secchaku no Jissai* Kobunshi Kankokai (1979) can be used.

A method wherein cloth, paper or felt impregnated with the compound (S) is brought into close contact with the surface of light-sensitive element, a method of pressing a curable resin impregnated with the compound (S), a method wherein the light-sensitive element is wetted with a non-aqueous solvent containing the compound (S) dissolved therein, and then dried to remove the solvent, and a method of migrating the compound (S) dispersed in a non-aqueous solvent to cause the compound (S) to adhere to the surface of light-sensitive element by electrophoresis according to the wet-type electrodeposition method as described above can also be employed.

Further, the compound (S) can be applied on the surface of light-sensitive element by utilizing a non-aqueous solvent containing the compound (S) according to an ink jet method, followed by drying. The ink jet method can be performed with reference to the descriptions in Shin Ohno (ed.), *Non-impact Printing*, C.M.C. (1986). More specifically, a Sweet process or Hartz process of a continuous jet type, a Winston process of an intermittent jet type, a pulse jet process of an ink on-demand type, a bubble jet process, and a mist process of an ink mist type are illustrated. In any system, the compound (S) itself or diluted with a solvent is filled in an ink tank or ink head cartridge in place of an ink to use. The solution of compound (S) used ordinarily has a viscosity of from 1 to 10 cp and a surface tension of from 30 to 60 dyne/cm, and may contain a surface active agent, or may be heated, if desired. Although a diameter of ink droplet is in a range of from 30 to 100 $\mu$m due to a diameter of an orifice of head in a conventional ink jet printer in order to reproduce fine letters, droplets of a larger diameter can also be used in the present invention. In such a case, an amount of jet of the compound (S) becomes large and thus a time necessary for the application can be shortened. Further, to use multiple nozzles is very effective to shorten the time for application.

When silicone rubber is used as the compound (S), it is preferred that silicone rubber is provided on a metal axis to cover and the resulting silicone rubber roller is directly pressed on the surface of electrophotographic light-sensitive element. In such a case, a nip pressure is ordinarily in a range of from 0.5 to 10 Kgf/cm$^2$ and a time for contact is ordinarily in a range of from 1 second to 30 minutes. Also, the light-sensitive element and/or silicone rubber roller may be heated up to a temperature of 150° C. According to this method, it is believed that a part of low molecular weight components contained in silicone rubber is moved from the silicone rubber roller onto the surface of light-sensitive element during the press. The silicone rubber may be swollen with silicone oil. Moreover, the silicone rubber may be a form of sponge and the sponge roller may be impregnated with silicone oil or a solution of silicone surface active agent.

The application method of the compound (S) is not particularly limited, and an appropriate method can be selected depending on a state (i.e., liquid, wax or solid) of the compound (S) used. A flowability of the compound (S) can be controlled using a heat medium, if desired.

The application of compound (S) is preferably performed by a means which is easily incorporated into an electrophotographic apparatus used in the present invention.

An amount of the compound (S) applied to the surface of electrophotographic light-sensitive element is adjusted in a range wherein the electrophotographic characteristics of light-sensitive element do not adversely affected in substance. Ordinarily, a thickness of the coating is sufficiently 1 $\mu$m or less. By the formation of weak boundary layer as defined in Bikerman, *The Science of Adhesive Joints,* Academic Press (1961), the releasability-imparting effect of the present invention can be obtained. Specifically, when an adhesive strength of the surface of electrophotographic light-sensitive element to which the compound (S) has been applied is measured according to JIS Z 0237-1980 "Testing methods of pressure sensitive adhesive tapes and sheets" described above, the resulting adhesive strength is preferably not more than 100 g•f.

In accordance with the method described above, the surface of electrophotographic light-sensitive element is provided with the desired releasability by the application of compound (S), and the light-sensitive element can be repeatedly employed as far as the releasability is maintained. Specifically, the application of compound (S) is not always necessarily whenever a series of steps comprising the formation of toner image, formation of transfer layer, and transfer of the toner image together with the transfer layer onto a primary receptor and then onto a receiving material is repeated.

The second method described above can simply provide an electrophotographic light-sensitive element having a surface of the desired releasability. Using such a method a conventional electrophotographic light-sensitive element can be converted to one having a surface of the desired releasability.

The construction and material used for the electrophotographic light-sensitive element according to the present invention are not particularly limited and any of those conventionally known can be employed.

Suitable examples of electrophotographic light-sensitive element used are described, for example, in R. M. Schaffert, *Electrophotography,* Forcal Press, London (1980), S. W. Ing, M. D. Tabak and W. E. Haas, *Electrophotography Fourth International Conference,* SPSE (1983), Isao Shinohara, Hidetoshi Tsuchida and Hideaki Kusakawa (ed.), *Kirokuzairyo to Kankoseijushi*, Gakkai Shuppan Center (1979), Hiroshi Kokado, *Kagaku to Kogyo*, Vol. 39, No. 3, p. 161 (1986), *Saikin no Kododen Zairyo to Kankotai no Kaihatsu-Jitsuyoka,* Nippon Kagaku Joho Shuppanbu (1986), Denshishashin Gakkai (ed.), *Denshishashin no Kiso to Oyo,* Corona (1986), and Denshishashin Gakkai (ed.), *Denshishashinyo Yukikankotai no Genjo Symposium* (preprint), (1985).

A photoconductive layer for the electrophotographic light-sensitive element which can be used includes a single layer made of a photoconductive compound itself and a photoconductive layer comprising a binder resin having dispersed therein a photoconductive compound. The dispersed type photoconductive layer may have a single layer structure or a laminated structure. The photoconductive compounds used in the present invention may be inorganic compounds or organic compounds.

Inorganic photoconductive compounds used in the present invention include those conventionally known for example, amorphous silicon, zinc oxide, titanium oxide, zinc sulfide, cadmium sulfide, selenium, selenium-tellurium, and lead sulfide. These compounds are used together with a binder resin to form a photoconductive layer, or they are used alone to form a photoconductive layer by vacuum deposition or spattering.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound.

Organic photoconductive compounds used may be selected from conventionally known compounds. Suitable photoconductive layers containing an organic photoconductive compound include (i) a layer mainly comprising an organic photoconductive compound, a sensitizing dye, and a binder resin as described, e.g., in JP-B-37-17162, JP-B-62-51462, JP-A-52-2437, JP-A-54-19803, JP-A-56-107246, and JP-A-57-161863; (ii) a layer mainly comprising a charge generating agent, a charge transporting agent, and a binder resin as described, e.g., in JP-A-56-146145, JP-A-60-17751, JP-A-60-17752, JP-A-60-17760, JP-A-60-254142, and JP-A-62-54266; and (iii) a double-layered structure containing a charge generating agent and a charge transporting agent in separate layers as described, e.g., in JP-A-60-230147, JP-A-60-230148, and JP-A-60-238853.

The photoconductive layer of the electrophotographic light-sensitive element according to the present invention may have any of the above-described structure.

The organic photoconductive compounds which may be used in the present invention include (a) triazole derivatives described, e.g., in U.S. Pat. No. 3,112,197, (b) oxadiazole derivatives described, e.g., in U.S. Pat. No. 3,189,447, (c) imidazole derivatives described in JP-B-37-16096, (d) polyarylalkane derivatives described, e.g., in U.S. Pat. Nos. 3,615,402, 3,820,989, and 3,542,544, JP-B-45-555, JP-B-51-10983, JP-A-51-93224, JP-A-55-108667, JP-A-55-156953, and JP-A-56-36656, (e) pyrazoline derivatives and pyrazolone derivatives described, e.g., in U.S. Pat. Nos. 3,180,729 and 4,278,746, JP-A-55-88064, JP-A-55-88065, JP-A-49-105537, JP-A-55-51086, JP-A-56-80051, JP-A-56-88141r JP-A-57-45545, JP-A-54-112637, and JP-A-55-74546, (f) phenylenediamine derivatives described, e.g., in U.S. Pat. No. 3,615,404, JP-B-51-10105, JP-B-46-3712, JP-B-47-28336, JP-A-54-83435, JP-A-54-110836, and JP-A-54-119925, (g) arylamine derivatives described, e.g., in U.S. Pat. Nos. 3,567,450, 3,180,703, 3,240,597, 3,658,520, 4,232,103, 4,175,961, and 4,012,376, JP-B-49-35702, West German Patent (DAS) 1,110,518, JP-B-39-27577, JP-A-55-144250, JP-A-56-119132, and JP-A-56-22437, (h) amino-substituted chalcone derivatives described, e.g., in U.S. Pat. No. 3,526,501, (i) N,N-bicarbazyl derivatives described, e.g., in U.S. Pat. No. 3,542,546, (j) oxazole derivatives described, e.g., in U.S. Pat. No. 3,257,203, (k) styrylanthracene derivatives described, e.g., in JP-A-56-46234, (l) fluorenone derivatives described, e.g., in JP-A-54-110837, (m) hydrazone derivatives described, e.g., in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749, and JP-A-57-104144, (n) benzidine derivatives described, e.g., in U.S. Pat. Nos. 4,047,948, 4,047,949, 4,265,990, 4,273,846, 4,299,897, and 4,306,008, (o) stilbene derivatives described, e.g., in JP-A-58-190953, JP-A-59-95540, JP-A-59-97148, JP-A-59-195658, and JP-A-62-36674, (p) polyvinylcarbazole and derivatives thereof described in JP-B-34-10966, (q) vinyl polymers, such as polyvinylpyrene, polyvinylanthracene, poly-2-vinyl-4-(4'-dimethylaminophenyl)-5-phenyloxazole, and poly-3-vinyl-N-ethylcarbazole, described in JP-B-43-18674 and JP-B-43-19192, (r) polymers, such as polyacenaphthylene, polyindene, and an acenaphthylene-styrene copolymer, described in JP-B-43-19193, (s) condensed resins, such as pyrene-formaldehyde resin, bromopyrene-formaldehyde resin, and ethyl-carbazole-formaldehyde resin, described, e.g., in JP-B-56-13940, and (t) triphenylmethane polymers described in JP-A-56-90833 and JP-A-56-161550.

The organic photoconductive compounds which can be used in the present invention are not limited to the above-described compounds (a) to (t), and any of known organic photoconductive compounds may be employed in the present invention. The organic photoconductive compounds may be used either individually or in combination of two or more thereof.

The sensitizing dyes which can be used in the photoconductive layer include those conventionally known as described, e.g., in *Denshishashin,* Vol. 12, p. 9 (1973) and *Yuki Gosei Kagaku,* Vol. 24, No. 11, p. 1010 (1966). Specific examples of suitable sensitizing dyes include pyrylium dyes described, e.g., in U.S. Pat. Nos. 3,141,770 and 4,283,475, JP-A-48-25658, and JP-A-62-71965; triarylmethane dyes described, e.g., in *Applied Optics Supplement,* Vol. 3, p. 50 (1969) and JP-A-50-39548; cyanine dyes described, e.g., in U.S. Pat. No. 3,597,196; and styryl dyes described, e.g., in JP-A-60-163047, JP-A-59-164588, and JP-A-60-252517.

The charge generating agents which can be used in the photoconductive layer include various conventionally known charge generating agents, either organic or inorganic, such as selenium, selenium-tellurium, cadmium sulfide, zinc oxide, and organic pigments, for example, (1) azo pigments (including monoazo, bisazo, and trisazo pigments) described, e.g., in U.S. Pat. Nos. 4,436,800 and 4,439,506, JP-A-47-37543, JP-A-58-123541, JP-A-58-192042, JP-A-58-219263, JP-A-59-78356, JP-A-60-179746, JP-A-61-148453, JP-A-61-238063, JP-B-60-5941, and JP-B-60-45664, (2) metal-free or metallized phthalocyanine pigments described, e.g., in U.S. Pat. Nos. 3,397,086 and 4,666,802, JP-A-51-90827, and JP-A-52-55643, (3) perylene pigments described, e.g., in U.S. Pat. No. 3,371,884 and JP-A-47-30330, (4) indigo or thioindigo derivatives described, e.g., in British Patent 2,237,680 and JP-A-47-30331, (5) quinacridone pigments described, e.g., in British Patent 2,237,679 and JP-A-47-30332, (6) polycyclic quinone dyes described, e.g., in British Patent 2,237,678, JP-A-59-184348, JP-A-62-28738, and JP-A-47-18544, (7) bisbenzimidazole pigments described, e.g., in JP-A-47-30331 and JP-A-47-18543, (8) squarylium salt pigments described, e.g., in U.S. Pat. Nos. 4,396,610 and 4,644,082, and (9) azulenium salt pigments described, e.g., in JP-A-59-53850 and JP-A-61-212542.

These charge generating agents may be used either individually or in combination of two or more thereof.

The charge transporting agents used in the photoconductive layer include those described for the organic photoconductive compounds above.

With respect to a mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur. In general, 5 to 120 parts by weight, and preferably from 10 to 100 parts by weight, of the organic photoconductive compound is used per 100 parts by weight of the total binder resin.

Binder resins other than the specific resins described hereinbefore (hereinafter referred to as binder resin (B) sometimes) which can be used in the light-sensitive element according to the present invention include those for conventionally known electrophotographic light-sensitive elements. A weight average molecular weight of the binder resin is preferably from $5\times10^3$ to $1\times10^6$, and more preferably from $2\times10^4$ to $5\times10^5$. A glass transition point of the binder resin is preferably from −40° to 200° C., and more preferably from −10° to 140° C.

Conventional binder resins for electrophotographic light-sensitive elements which may be used in the present invention are described, e.g., in Takaharu Shibata and Jiro Ishiwatari, *Kobunshi,* Vol. 17, p. 278 (1968), Harumi Miyamoto and Hidehiko Takei, *Imaging*, Vol. 1973, No. 8, Koichi Nakamura (ed.), *Kioku Zairyoyo Binder no Jissai Gilutsu,* Ch. 10, C.M.C. (1985), Denshi- shashin Gakkai (ed.), *Denshishashinyo Yukikankotai no Genjo Symposium* (preprint) (1985), Hiroshi Kokado (ed.), *Saikin no Kododen Zairyo to Kankotai no Kaihatsu•Jitsuyoka,* Nippon Kagaku Joho (1986), Denshishashin Gakkai (ed.), *Denshishashin Gijutsu no Kiso to Oyo*, Ch. 5, Corona (1988), D. Tatt and S. C. Heidecker, *Tappi*, Vol. 49, No. 10, p. 439 (1966), E. S. Baltazzi and R. G. Blanchlotte, et al., *Photo. Sci. Eng.,* Vol. 16, No. 5, p. 354 (1972), and Nguyen Chank Keh, Isamu Shimizu and Eiichi Inoue, *Denshi Shashin Gakkaishi,* Vol. 18, No. 2, p. 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styreneacrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins , cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

More specifically, reference can be made to Tsuyoshi Endo, *Netsukokasei Kobunshi no Seimitsuka*, C.M.C. (1986), Yuji Harasaki, *Saishin Binder Gijutsu Binran,* Ch. II-1, Sogo Gijutsu Center (1985), Takayuki Otsu, *Acryl Jushi no Gosei•Sekkei to Shinyoto Kaihatsu*, Chubu Kei-ei Kaihatsu Center Shuppanbu (1985), and Eizo Omori, *Kinosei Acryl-Kei Jushi,* Techno System (1985).

Further, the electrostatic characteristics of the photoconductive layer are improved by using, as a binder resin (B) for photoconductive substance, a resin having a relatively low molecular weight (e.g., a weight average molecular weight of from $10^3$ to $10^4$) and containing an acidic group such as a carboxy group, a sulfo group or a phosphono group. For instance, JP-A-63-217354 discloses a resin having polymer components containing an acidic group at random in the polymer main chain, JP-A-64-70761 discloses a resin having an acidic group bonded at one terminal of the polymer main chain, J?-A-2-67563, JP-A-2-236561, JP-A-2-238458, JP-A-2-236562 and JP-A-2-247656 disclose a resin of graft type copolymer having an acidic group bonded at one terminal of the polymer main chain or a resin of graft type copolymer containing acidic groups in the graft portion, and JP-A-3-181948 discloses an AB block copolymer containing acidic groups as a block.

Moreover, in order to obtain a satisfactorily high mechanical strength of the photoconductive layer which may be insufficient by only using the low molecular weight resin, a medium to high molecular weight resin is preferably used together with the low molecular weight resin. For instance, JP-A-2-68561 discloses a thermosetting resin capable of forming crosslinked structures between polymers, JP-A-2-68562 discloses a resin partially having crosslinked structures, and JP-A-2-69759 discloses a resin of graft type copolymer having an acidic group bonded at one terminal of the polymer main chain. Also, in order to maintain the relatively stable performance even when ambient conditions are widely fluctuated, a specific medium to high molecular weight resin is employed in combination. For instance, JP-A-3-29954, JP-A-3-77954, JP-A-3-92861 and JP-A-3-53257 disclose a resin of graft type copolymer having an acidic group bonded at the terminal of the graft portion or a resin of graft type copolymer containing acidic groups in the graft portion. Moreover, JP-A-3-206464 and JP-A-3-223762 discloses a medium to high molecular weight resin of graft type copolymer having a graft portion formed from an AB block copolymer comprising an A block containing acidic groups and a B block containing no acidic group.

In a case of using these resins, the photoconductive substance is uniformly dispersed to form a photoconductive layer having good smoothness. Also, excellent electrostatic characteristics can be maintained even when ambient conditions are fluctuated or when a scanning exposure system using a semiconductor laser beam is utilized for the image exposure.

The photoconductive layer usually has a thickness of from 1 to 100 $\mu$m, and preferably from 10 to 50 $\mu$m.

Where a photoconductive layer functions as a charge generating layer of a laminated type light-sensitive element composed of a charge generating layer and a charge transporting layer, the charge generating layer has a thickness of from 0.01 to 5 $\mu$m, and preferably from 0.05 to 2 $\mu$m.

Depending on the kind of a light source for exposure, for example, visible light or semiconductor laser beam, various dyes may be used as spectral sensitizers. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described e.g., in Harumi Miyamoto and Hidehiko Takei, *Imaging,* Vol. 1973, No. 8, p. 12, C. J. Young et al., *RCA Review,* Vol. 15, p. 469 (1954), Kohei Kiyota et al., *Denkitsushin Gakkai Ronbunshi,* Vol. J 63-C, No. 2, p. 97 (1980), Yuji Harasaki et al., *Kogyo Kagaku Zasshi,* Vol. 66, p. 78 and 188 (1963), and Tadaaki Tani, *Nihon Shashin Gakkaishi*, Vol. 35, p. 208 (1972).

Specific examples of carbonium dyes, triphenylmethane dyes, xanthene dyes, and phthalein dyes are described, e.g., in JP-B-51-452, JP-A-50-90334, JP-A-50-114227, JP-A-53-39130, JP-A-53-82353, U.S. Pat. Nos. 3,052,540 and 4,054,450, and JP-A-57-16456.

Usable polymethine dyes, such as oxonol dyes, merocyanine dyes, cyanine dyes, and rhodacyanine dyes, are described in F. M. Hamer, *The Cyanine Dyes and Related Compounds.* Specific examples of these dyes are described, e.g., in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-B-48-7814, and JP-B-55-18892.

Further, polymethine dyes capable of performing spectral sensitization in the near infrared to infrared region of 700 nm or more include those described, e.g., in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and Research Disclosure, No. 216, pp. 117–118 (1982).

The light-sensitive element of the present invention is excellent in that the characteristics thereof hardly vary with the combined use of various sensitizing dyes.

If desired, the light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, phthalic anhydride, maleic anhydride, N-hydroxymaleimide, N-hydroxyphthalimide, 2,3-dichloro-5,6-dicyanobenzoquinone, dinitrofluorenone, trinitrofluorenone, tetracyanoethylene, nitrobenzoic acid, and dinitrobenzoic acid; and polyarylalkane compounds, hindered phenol compounds and p-phenylenediamine compounds as described in the literature references cited in Hiroshi Kokado, et al., *Saikin no Kododen Zairyo to Kankotai no Kaihatsu•Jitsuyoka*, Chs. 4 to 6, Nippon Kagaku Joho (1986). In addition, the compounds as described in JP-A-58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer.

The amount of the additive to be added is not particularly limited, but ordinarily ranges from 0.001 to 2.0 parts by weight per 100 parts by weight of the photoconductive substance.

The photoconductive layer of the present invention can be provided on a conventionally known support. In general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin,* Vol. 14, No. 1, pp. 2–11 (1975), Hiroyuki Moriga, *Nyumon Tokushushi no Kagaku*, Kobunshi Kankokai (1975), and M. F. Hoover, *J. Macromol. Sci. Chem.,* Vol. A-4, No. 6, pp. 1327–1417 (1970).

According to the present invention, on an electrophotographic light-sensitive element having a surface of the releasability is formed a toner image through a conventional electrophotographic process.

Specifically, each step of the electrophotographic process, i.e., charging, light exposure, development and fixing is performed in a conventionally known manner. The electrophotographic process and the formation of transfer layer may be conducted in the same apparatus or in different apparatus.

In order to form the toner image by an electrophotographic process according to the present invention, any methods and apparatus conventionally known can be employed.

The developers which can be used in the present invention include conventionally known developers for electrostatic photography, either dry type or liquid type. For example, specific examples of the developer are described in *Denshishashin Gilutsu no Kiso to Oyo*, supra, pp. 497–505, Koichi Nakamura (ed.), *Toner Zairyo no Kaihatsu•Jitsuyoka*, Ch. 3, Nippon Kagaku Joho (1985), Gen Machida, *Kirokuyo Zairyo to Kankosei Jushi*, pp. 107–127 (1983), and Denshishashin Gakkai (ed.), *Imaging,* Nos. 2–5, "Denshishashin no Genzo•Teichaku•Taiden•Tensha", Gakkai Shuppan Center.

Dry developers practically used include one-component magnetic toners, two-component toners, one-component non-magnetic toners, and capsule toners. Any of these dry developers may be employed in the present invention.

The typical liquid developer is basically composed of an electrically insulating organic solvent, for example, an isoparaffinic aliphatic hydrocarbon (e.g., Isopar H or Isopar G (manufactured by Esso Chemical Co.) , Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein a colorant (e.g., an organic or inorganic pigment or dye) and a resin for imparting dispersion stability, fixability, and chargeability to the developer (e.g., an alkyd resin, an acrylic resin, a polyester resin, a styrene-butadiene resin, and rosin). If desired, the liquid developer can contain various additives for enhancing charging characteristics or improving image characteristics.

The colorant is appropriately selected from known dyes and pigments, for example, benzidine type, azo type, azomethine type, xanthene type, anthraquinone type, phthalocyanine type (including metallized type), titanium white, nigrosine, aniline black, and carbon black.

Other additives include, for example, those described in Yuji Harasaki, *Denshishashin,* Vol. 16, No. 2, p. 44, such as di-2-ethylhexylsufosuccinic acid metal salts, naphthenic acid metal salts, higher fatty acid metal salts, alkylbenzenesulfonic acid metal saltsy alkylphosphoric acid metal salts, lecithin, polyvinylpyrrolidone, copolymers containing a maleic acid monoamido component, coumarone-indene resins, higher alcohols, polyethers, polysiloxanes, and waxes.

With respect to the content of each of the main components of the liquid developer, toner particles mainly comprising a resin (and, if desired, a colorant) are preferably present in an amount of from 0.5 to 50 parts by weight per 1000 parts by weight of a carrier liquid. If the toner content is less than 0.5 part by weight, the image density may be insufficient, and if it exceeds 50 parts by weight, the occurrence of fog in the non-image areas may be tended to.

If desired, the above-described resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the amount of each additive is preferably controlled so that the liquid developer exclusive of toner particles has an electrical resistivity of not less than $10^8$ Ωcm. If the resistivity is less than $10^9$ Ωcm, a continuous gradation image of good quality may hardly be obtained.

The liquid developer can be prepared, for example, by mechanically dispersing a colorant and a resin in a dispersing machine, e.g., a sand mill, a ball mill, a jet mill, or an attritor, to produce colored particles, as described, for example, in JP-B-35-5511, JP-B-35-13424, JP-B-50-40017, JP-B-49-98634, JP-B-58-129438, and JP-A-61-180248.

The colored particles may also be obtained by a method comprising preparing dispersed resin grains having a fine grain size and good monodispersity in accordance with a non-aqueous dispersion polymerization method and coloring the resulting resin grains. In such a case, the dispersed grains prepared can be colored by dyeing with an appropriate dye as described, e.g., in JP-A-57-48738, or by chemical bonding of the dispersed grains with a dye as described, e.g., in JP-A-53-54029. It is also effective to polymerize a monomer already containing a dye at the polymerization granulation to obtain a dye-containing copolymer as described, e.g., in JP-B-44-22955.

Particularly, a combination of a scanning exposure system using a laser beam based on digital information and a development system using a liquid developer is an advantageous process in order to form highly accurate images.

One specific example of the methods for preparing toner image is illustrated below. An electrophotographic light-sensitive element is positioned on a flat bed by a register pin system and fixed on the flat bed by air suction from the backside. Then it is charged by means of a charging device, for example, the device as described in Denshishashin Gakkai (ed.), *Denshishashin Gijutsu no Kiso to Oyo,* p. 212 et seq., Corona Sha (1988). A corotron or scotron system is usually used for the charging process. In a preferred charging process, the charging conditions may be controlled by a feedback system of the information on charged potential from a detector connected to the light-sensitive element thereby to control the surface potential within a predetermined range.

Thereafter, the charged light-sensitive element is exposed to light by scanning with a laser beam in accordance with the system described, for example, in ibidem, p. 254 et seq. Of four color separation images, first the image corresponding to a yellow part is converted to a dot pattern and exposed.

Toner development is then conducted using a liquid developer. The light-sensitive element charged and exposed is removed from the flat bed and developed according to a wet type developing method as described, for example, in ibidem, p. 275 et seq. The exposure mode is determined in accord with the toner image development mode. Specifically, in case of reversal development, a negative image is irradiated with a laser beam, and a toner having the same charge polarity as that of the charged light-sensitive element is electrodeposited on the exposed area with a bias voltage applied. For the details, reference can be made to ibidem, p. 157 et seq.

After the toner development, the light-sensitive element is squeezed to remove the excess developer as described in ibidem, p. 283 and dried. Preferably, the light-sensitive element is rinsed with the carrier liquid alone used in the liquid developer before squeezing.

The above electrophotographic process for forming toner image is repeated with respect to a magenta, cyan and black part in case forming a full-color duplicate.

In the method of the present invention, the transfer layer is then formed on the light-sensitive element bearing one or more color toner images by the electrodeposition coating method as described above. The formation of transfer layer is preferably performed together with the electrophotographic process and transfer process in the same apparatus, although it may be conducted independently of these processes.

Now, the primary receptor which can be used in the present invention will be described in detail below.

According to the present invention. The toner image formed on the surface of light-sensitive element is transferred together with the transfer layer from the light-sensitive element onto a primary receptor upon bringing the light-sensitive material having the transfer layer provided on the light-sensitive element into intimate contact with the primary receptor under applying heat and/or pressure and then the transfer layer is released from the primary receptor and transferred together with the toner image onto a receiving material under applying heat and/or pressure thereby forming a color duplicate.

It is important therefore that releasability of the surface of primary receptor is less than releasability of the surface of light-sensitive element but is sufficient for peeling and transferring onto a receiving material. Specifically, the surface of primary receptor has the adhesive strength lager, preferably 10 g·f lager, more preferably 20 g·f lager, than the adhesive strength of the surface of light-sensitive element. On the other hand, the adhesive strength of the surface of primary receptor is preferably at most 200 g·f, more preferably at most 180 g·f.

Any type of primary receptor can be employed. For example, primary receptors of a drum type and an endless belt type which are repeatedly usable are preferred in the present invention. Also, any material can be employed for the primary receptor as far as the conditions described above are fulfilled. In the primary receptor of drum type or endless belt type, an elastic material layer or a stratified structure of an elastic material layer and a reinforcing layer is preferably provided on the surface thereof stationarily or removably so as to be replaced.

Any of conventionally known natural resins and synthetic reins can be used as the elastic material. These resins may be used either individually or as a combination of two or more thereof in a single or plural layer. Specifically, various resins described, for example, in A. D. Roberts, *Natural Rubber Science and Technology,* Oxford Science Publications (1988), W. Hofmann, *Rubber Technology Handbook,* Hanser Publisher (1989) and *Plastic Zairyo Koza,* Vols. 1 to 18, Nikkan Kogyo Shinbunsha can be employed.

Specific examples of the elastic material include styrene-butadiene rubber, butadiene rubber, acrylo-nitrile-butadiene rubber, cyclized rubber, chloroprene rubber, ethylene-propylene rubber, butyl rubber, chloro-sulfonated polyethylene rubber, silicone rubber fluoro-rubber, polysulfide rubber, natural rubber, isoprene rubber and urethane rubber. The desired elastic material can be appropriately selected by taking releasability from the transfer layer, durability, etc. into consideration. The thickness of elastic material layer is preferably from 0.01 to 10 mm.

Examples of materials used in the reinforcing layer for the elastic material layer include cloth, glass fiber, resin-impregnated specialty paper, aluminum and stainless steel. A spongy rubber layer may be provided between the surface elastic material layer and the reinforcing layer.

Conventionally known materials can be used as materials for the primary receptor of endless belt type. For example, those described in U.S. Pat. Nos. 3,893,761, 4,684,238 and 4,690,539 are employed. Further, a layer serving as a heating medium may be provided in the belt as described in JP-W-4-503265 (the term "JP-W" as used herein means an "unexamined published international patent application").

The adhesive strength of the surface of primary receptor can be easily adjusted by applying the method as described with respect to the releasability of the surface of light-sensitive element hereinbefore, including the application of compound (S). The surface of primary receptor has preferably an average roughness of 0.01 mm or below.

The heat transfer of toner image together with the transfer layer onto a primary receptor can be performed using known method and apparatus. In order to heat the light-sensitive material, a non-contact type heater such as an infrared line heater, a flash heater or the like is preferably used. The surface temperature of light-sensitive material at the time of heat transfer is preferably in a range of from 40 to 150° C., and more preferably from 50 to 120° C.

The nip pressure of rollers is preferably in a range of from 0.2 to 20 kgf/cm$^2$ and more preferably from 0.5 to 15 kgf/cm$^2$. The rollers may be pressed by springs provided on opposite ends of the roller shaft or by an air cylinder using compressed air. A speed of the transportation is preferably in a range of from 0.1 to 300 mm/sec and more preferably in a range of from 0.5 to 200 mm/sec. The speed of transportation may differ between the electrophotographic process and the heat transfer step.

The transfer layer bearing the toner image on the primary receptor is then heat-transferred onto a receiving material. The heat-transfer of the toner image together with the transfer layer onto a receiving material can be performed using known methods and apparatus.

The receiving material used in the present invention is not particularly limited and any material conventionally known can be employed. Suitable examples of the receiving materials include those of reflective type, for example, natural paper such as high quality paper, coated paper or art paper, synthetic paper, a metal plate such as an aluminum, iron or SUS plater and those of transmittive type, for example, a plastic film such as a polyester, polyolefin, polyvinyl chloride or polyacetate film.

Preferred ranges of temperature, nip pressure and transportation speed for the heat-transfer of transfer layer from the primary receptor onto the receiving material are same as those described for the heat transfer step of toner image and transfer layer from the light-sensitive element onto the primary receptor respectively. Further, the conditions of transfer onto the receiving material may be the same as or different from those of transfer onto the primary receptor.

The heat-transfer behavior of transfer layer onto the receiving material is considered as follows. Specifically, when the transfer layer softened to a certain extent, for example, by a pre-heating means is further heated, for example, a heating roller, the tackiness of the transfer layer increases and the transfer layer is closely adhered to the receiving material.

After the transfer layer is passed under a roller for release, for example, a cooling roller, the temperature of the transfer layer is decreased to reduce the flowability and the tackiness and thus the transfer layer is peeled as a film from the surface of the primary receptor together with the toner thereon. Accordingly, the transfer conditions should be set so as to realize such a situation.

The cooling roller comprises a metal roller which has a good thermal conductivity such as aluminum, copper or the like and is covered with silicone rubber. It is preferred that the cooling roller is provided with a cooling means therein or on a portion of the outer surface which is not brought into contact with the receiving material in order to radiate heat. The cooling means includes a cooling fan, a coolant circulation or a thermoelectric cooling element, and it is preferred that the cooling means is coupled with a temperature controller so that the temperature of the cooling roller is maintained within a predetermined range.

In the method of the present invention, the transfer of toner image together with the transfer layer from the light-sensitive element to the primary receptor and the transfer of toner image together with the transfer layer from the primary receptor to the receiving material may be simultaneously performed with respect to one sheet having the toner image.

Alternatively, after the transfer of all of one sheet from the light-sensitive element to the primary receptor is completed, the image is transferred to the receiving material.

According to the present invention, the toner image transferred on the receiving material is covered with the transfer layer, and hence the toner image is protected from being scratched or stained.

Further, by stopping the apparatus in the stage where the transfer layer has been formed on the light-sensitive element, the next operation can start with the electrophotographic process.

It is needless to say that the above-described conditions for the transfer of toner image and transfer layer should be optimized depending on the physical properties of the light-sensitive element (i.e., the light-sensitive layer and the support), the primary receptor, the transfer layer, and the receiving material. Especially it is important to determine the conditions of temperature, in the heat transfer step taking into account the factors such as glass transition point, softening temperature, flowability, tackiness, film properties and film thickness of the transfer layer.

Now, the method of forming a color image using an electrophotographic process according to the present invention will be described with reference to the accompanying drawings hereinbelow.

Figure 2:
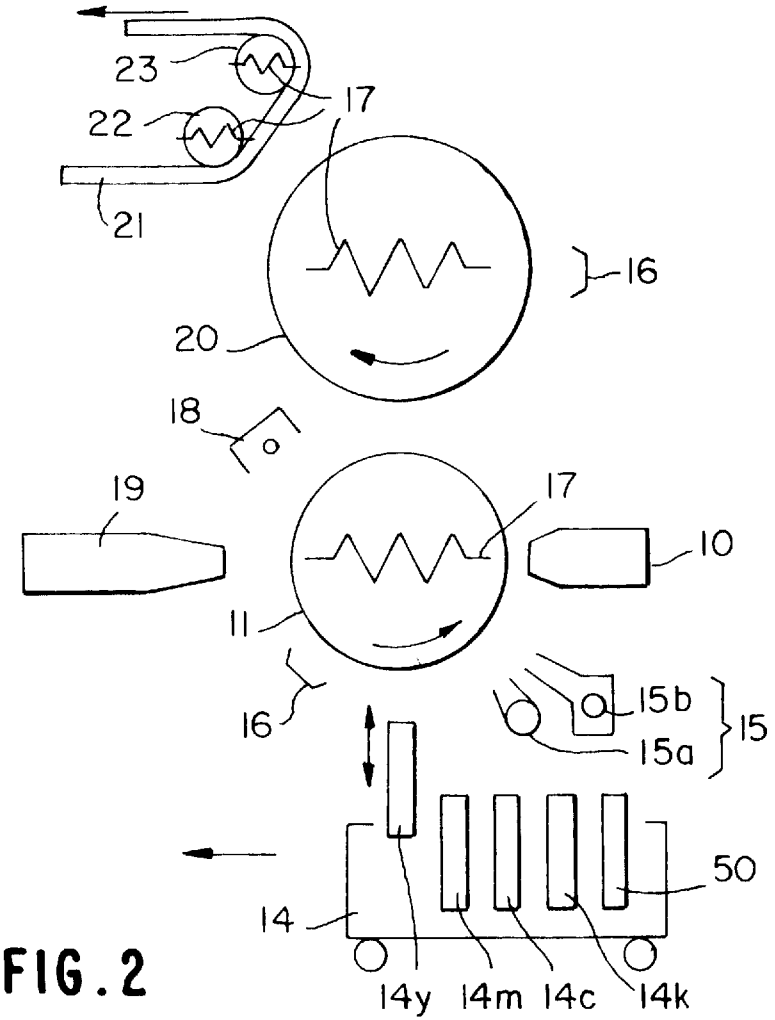
FIG. 2 is a schematic view of an apparatus suitable for performing the method according to the present invention.

FIG. 2 is a schematic view of an apparatus for forming a color image suitable for conducting the method according to the present invention wherein a developing device of wet type and a primary receptor of drum type is employed. In the apparatus, a drum of electrophotographic light-sensitive element 11, a drum of primary receptor 20 and a receiving material 21 are arranged above a liquid developing unit set 14. A temperature controller 17 is provided in each of the drums, a backup roller for transfer 22 and a backup roller for release 23. The liquid developing unit set 14 is movable and provided with a yellow liquid developing unit 14*y* containing a yellow liquid developer, a magenta liquid developing unit 14*m* containing a magenta liquid developer, a cyan liquid developing unit 14*c* containing a cyan liquid developer, a black liquid developing unit 14*k* containing a black liquid developer and an electrodeposition unit of thermoplastic resin grain (50) for forming the transfer layer by the electrodeposition coating method. Each unit is equipped with a prebathing means, a rinsing means and a squeezing means. As the prebathing and rinsing solutions a carrier liquid of a liquid developer is ordinarily used. An applying device of compound (S) 10 can be omitted when an electrophotographic light-sensitive element having the sufficient releasability on the surface thereof is employed. The drum of primary receptor 20 is neither brought into contact with the drum of electrophotographic light-sensitive element 11 nor with the receiving material 21 during the formation of toner image by an electrophotographic process as shown in FIG. 2.

As described above, when an electrophotographic light-sensitive element 11 whose surface has been previously modified to have releasability, a toner image 3 is formed on the light-sensitive element 11 by a conventional electrophotographic process. On the other hand, when releasability of the surface of light-sensitive element 11 is insufficient, a compound (S) is applied to the surface of light-sensitive element before the start of electrophotographic process thereby the desired releasability being imparted to the surface of light-sensitive element 11. Specifically, the compound (S) is supplied from the applying device of compound (S) 10 which utilizes any one of the embodiments as described above onto the surface of light-sensitive element 11. The applying device of compound (S) 10 may be stationary or movable.

Figure 3:
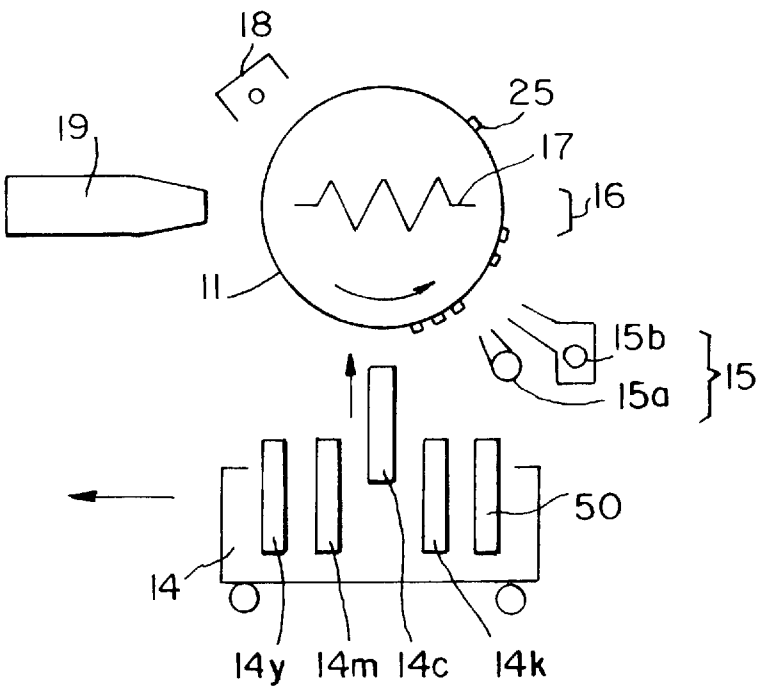
FIG. 3 is a partially schematic view of a step for forming a toner image on an electrophotographic light-sensitive element by an electrophotographic process.

The light-sensitive element whose surface has the releasability is then subjected to an electrophotographic process. The electrophotographic process is described with reference to FIG. 3 which is a partial view schematically illustrating a step for the formation of toner image 25 on the electrophotographic light-sensitive element 11 by an electrophotographic process among the whole view of FIG. 2.

The light-sensitive element 11 is uniformly charged to, for instance, a positive polarity by a corona charger 18 and then is exposed imagewise by an exposure device (e.g., a semiconductor laser) 19 on the basis of yellow image information, whereby the potential is lowered in the exposed regions and thus, a contrast in potential is formed between the exposed regions and the unexposed regions. A yellow liquid developing unit 14*y* containing a liquid developer comprising yellow pigment particles having a positive electrostatic charge dispersed in an electrically insulating dispersion medium is brought near the surface of a light-sensitive element 11 from a liquid developing unit set 14 and is kept stationary with a gap of 1 mm therebetween.

The light-sensitive element 11 is first pre-bathed by a pre-bathing means provided in the developing unit, and then the yellow liquid developer is supplied on the surface of the light-sensitive element while applying a developing bias voltage between the light-sensitive element and a development electrode by a bias voltage source and wiring (not shown). The bias voltage is applied so that it is slightly lower than the surface potential of the unexposed regions, while the development electrode is charged to positive and the light-sensitive element is charged to negative. When the bias voltage applied is too low, a sufficient density of the toner image cannot be obtained.

The liquid developer is subsequently washed off by a rinsing means provided in the developing unit and the rinse solution adhering to the surface of the light-sensitive element is removed by a squeeze means. Then, the light-sensitive element is dried by passing under the suction/exhaust unit 15. The above described electrophotographic process is repeated with respect to each image information of magenta, cyan and black to form color toner images 25 on the light-sensitive element 11.

Figure 4:
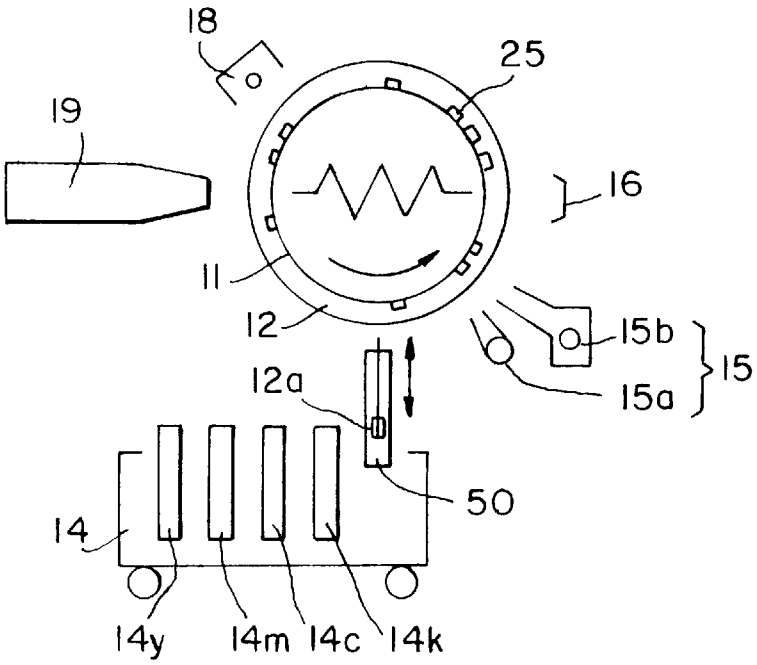
FIG. 4 is a partially schematic view of a step for forming a transfer layer on an electrophotographic light-sensitive element bearing a toner image by an electrodeposition coating method.

Then, a peelable transfer layer is formed on the electrophotographic light-sensitive element bearing the color toner image. The formation of transfer layer is described with reference to FIG. 4 which is a partial view schematically illustrating a step for the formation of transfer layer.

A dispersion of thermoplastic resin grain 12*a* comprising electrically charged thermoplastic resin grains (ARW) is supplied to an electrodeposition unit of thermoplastic resin grain 50 provided in the movable liquid developing unit set 14. The electrodeposition unit 50 is first brought near the surface of the light-sensitive element 11 bearing the toner image and is kept stationary with a gap of 1 mm between a development electrode of the electrodeposition unit 50 and the light-sensitive element. The light-sensitive element 11 is rotated while supplying the dispersion of thermoplastic resin grain 12*a* into the gap and applying an electric voltage across the gap from an external power source (not shown), whereby the resin grains (ARW) are deposited over the entire areas of the surface of light-sensitive element 11.

A medium of the dispersion of thermoplastic resin grain 12*a* adhered to the surface of the light-sensitive element 11 is removed by a squeezing device built in the electrodeposition unit 50, if desired, then the thermoplastic resin grains are fused by a heating means and thus a transfer layer 12 in the form of thermoplastic resin film is obtained.

Thereafter the transfer layer is cooled to a predetermined temperature, if desired, from an outside of the light-sensitive element by a cooling device which is similar to the suction/exhaust unit 15 or from an inside of the drum of the light-sensitive element, although not shown. The liquid developing unit set 14 is moved to its stand-by position, thereby completing the step of forming the transfer layer 12.

A step of transferring the toner image and transfer layer onto a primary receptor is described with reference to FIGS. 5A and 5*b* which are partial views schematically illustrating the step.

The drum of light-sensitive element 11 bearing the toner image 25 and the transfer layer 12 formed thereon and the drum of primary receptor 20 are brought into contact with each other under applying heat and pressure as shown in FIG. 5*a,* whereby the toner image 25 is transferred together with the transfer layer 12 from the light-sensitive element 11 onto the primary receptor 20 as shown in FIG. 5*b*. Specifically, after the transfer layer 12 is formed on the light-sensitive element 11, the transfer layer is pre-heated in the desired range of temperature by a heating means 16, the primary receptor 20 is also pre-heated in the desired range of temperature by a heating means 16 if desired, and then the transfer layer is brought into close contact with the primary receptor, whereby the toner image 25 is heat-transferred together with the transfer layer 12 onto the primary receptor 20.

A step of transferring the toner image and transfer layer from the primary receptor onto a final receiving material is described with reference to FIG. 6 which is a partial view schematically illustrating the step.

The toner image transferred on the primary receptor is then heat-transferred onto a receiving material 21, for example, coated paper together with the transfer layer 12. Specifically, the transfer layer on the primary receptor 20 is pre-heated in the desired range of temperature by a heating means 16, the receiving material 21 is also pre-heated in the desired range of temperature by a back-up roller for transfer 22, the receiving material 21 is brought into close contact with the transfer layer on the primary receptor 20 by the back-up roller for transfer 22 and then the receiving material is cooled by a back-up roller for release 23, thereby heat-transferring the toner image 25 to the receiving material 21 together with the transfer layer 12. Thus a cycle of steps is terminated.

In case of using a primary receptor of endless belt type, the step of heat transferring the toner image together with the transfer layer onto a receiving material can be conducted in the same manner as in the primary receptor of drum type.

In accordance with the method of the present invention, color images of high accuracy and high quality without color shear can be obtained in a simple and stable manner irrespect of the kind of receiving material. The transferability of transfer layer together with toner image is greatly improved and a latitude of the transfer condition is also increased.

A color duplicate obtained is excellent in storage stability and exhibits good retouching property and sealing property similar to those of plain paper.

Further, by appropriately selecting the releasability of light-sensitive element and primary receptor and the composition of transfer layer, the transferability is further improved to provide a color duplicate of better qualities.

Moreover, a conventional electrophotographic light-sensitive element can be employed in the method of the present invention by imparting the desired releasability on the surface thereof using the compound (S) before the formation of toner image. Thus, a running cost can be reduced.

The present invention is illustrated in greater detail with reference to the following examples, but the present invention is not to be construed as being limited thereto.

SYNTHESIS EXAMPLES OF RESIN (P)

Synthesis Example 1 of Resin (P): (P-1)

A mixed solution of 80 g of methyl methacrylate, 20 g of a dimethylsiloxane macromonomer (FM-0725 manufactured by Chisso Corp.; Mw: $1\times10^4$), and 200 g of toluene was heated to a temperature of 75° C. under nitrogen gas stream. To the solution was added 1.0 g of 2,2'-azobis (isobutyronitrile) (abbreviated as AIBN), followed by reacting for 4 hours. To the mixture was further added 0.7 g of AIBN, and the reaction was continued for 4 hours. An Mw of the copolymer thus-obtained was $5.8\times10^4$.

Resin (P-1)

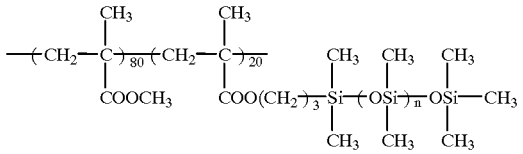

Synthesis Examples 2 to 9 of Resin (P): (P-2) to (P-9)

Each of copolymers was synthesized in the same manner as in Synthesis Example 1 of Resin (P), except for replacing methyl methacrylate and the macromonomer (FM-0725) with each monomer corresponding to the polymer component shown in Table B below. An Mw of each of the resulting polymers was in a range of from $4.5\times10^4$ to $6\times10^4$.

TABLE B
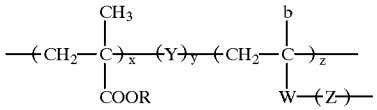
| Synthesis Example of Resin (P) | Resin (P) | —R | —Y— | -b | —W— | —Z— | x/y/z (weight ratio) |
|---|---|---|---|---|---|---|---|
| 2 | P-2 | $—C_2H_5$ | 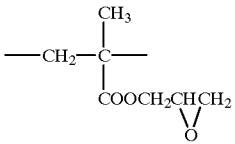 | $—CH_3$ | $—COO(CH_2)_2S—$ | 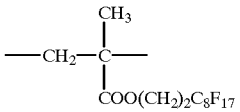 | 65/15/20 |
| 3 | P-3 | $—CH_3$ | 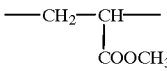 | —H | 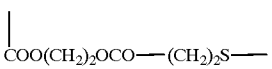 | 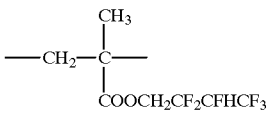 | 60/10/30 |
| 4 | P-4 | $—CH_3$ | 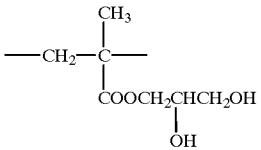 | $—CH_3$ | 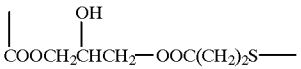 | 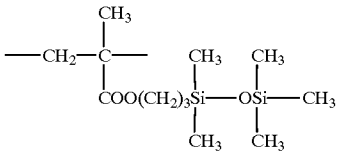 | 65/10/25 |
| 5 | P-5 | $—C_3H_7$ | 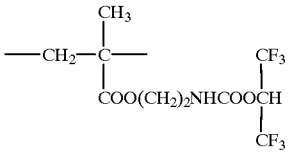 | $—CH_3$ | 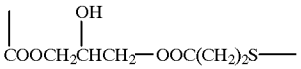 | 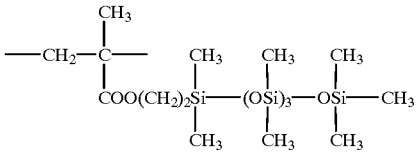 | 65/15/20 |
| 6 | P-6 | $—CH_3$ | 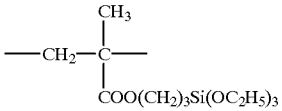 | $—CH_3$ | 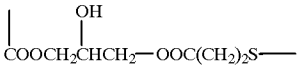 | 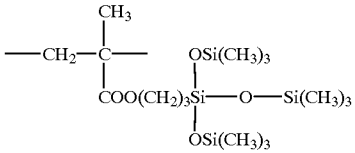 | 50/20/30 |

TABLE B-continued
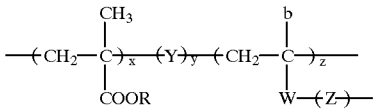
| Synthesis Example of Resin (P) | Resin (P) | —R | —Y— | -b | —W— | —Z— | x/y/z (weight ratio) |
|---|---|---|---|---|---|---|---|
| 7 | P-7 | $—C_2H_5$ | 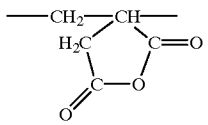 | —H | $—CONH(CH_2)_2S—$ | 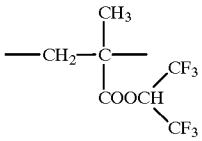 | 57/8/35 |
| 8 | P-8 | $—CH_3$ | 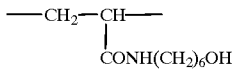 | —H | 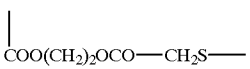 | 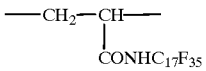 | 70/15/15 |
| 9 | P-9 | $—C_2H_5$ | 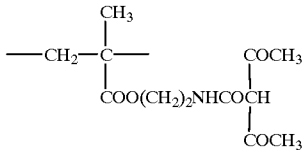 | $—CH_3$ | 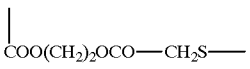 | 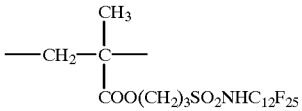 | 70/10/20 |

Synthesis Example 10 of Resin (P): (P-10)

A mixed solution of 60 g of 2,2,3,4,4,4-hexafluorobutyl methacrylate, 40 g of a methyl methacrylate macromonomer (AA-6 manufactured by Toagosei Chemical Industry Co., Ltd.; Mw: $1\times10^4$), and 200 g of benzotrifluoride was heated to a temperature of 75° C. under nitrogen gas stream. To the solution was added 1.0 g of AIBN, followed by reacting for 4 hours. To the mixture was further added 0.5 g of AIBN, and the reaction was continued for 4 hours. An Mw of the copolymer thus-obtained was $6.5\times10^4$.

Resin (P-10)

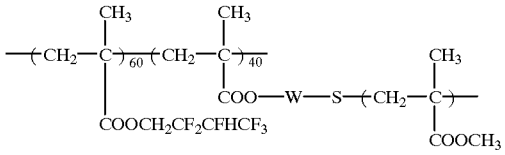

—W—: an organic residue (unknown)

Synthesis Examples 11 to 15 of Resin (P): (P-11) to (P-15)

Each of copolymers was synthesized in the same manner as in Synthesis Example 10 of Resin (P), except for replacing the monomer and the macromonomer used in Synthesis Example 10 of Resin (P) with each monomer and each macromonomer both corresponding to the polymer components shown in Table C below. An Mw of each of the resulting copolymers was in a range of from $4.5\times10^4$ to $6.5\times10^4$.

TABLE C

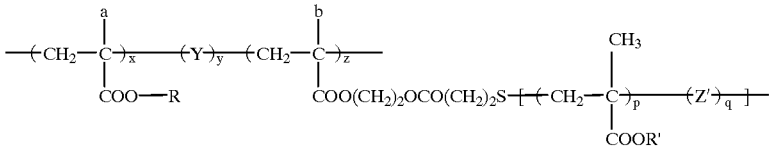

| Synthesis Example of Resin (P) | Resin (P) | -a | —R | —Y— | -b |
|---|---|---|---|---|---|
| 11 | P-11 | $—CH_3$ | $-(CH_2)_2C_nF_{2n+1}$ n = 8~10 | — | $—CH_3$ |
| 12 | P-12 | $—CH_3$ | $-(CH_2)_2CF_2CFHCF_3$ | — | —H |

| Synthesis Example of Resin (P) | —R' | —Z'— | x/y/z (weight ratio) | p/q (weight ratio) |
|---|---|---|---|---|
| 11 | $—CH_3$ | 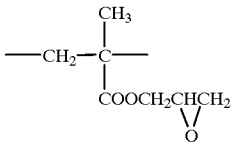 | 70/0/30 | 70/30 |
| 12 | $—CH_3$ | 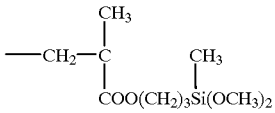 | 60/0/40 | 70/30 |

| Synthesis Example of Resin (P) | Resin (P) | -a | —R | —Y— | -b |
|---|---|---|---|---|---|
| 13 | P-13 | $—CH_3$ | $—CH_2CF_2CF_2H$ | 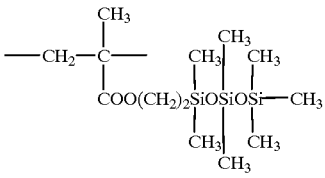 | $—CH_3$ |

TABLE C-continued

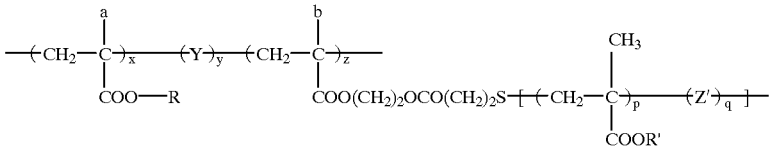

| | | | | | |
|---|---|---|---|---|---|
| 14 | P-14 | —H | —$CH_2CF_2CFHCF_3$ | 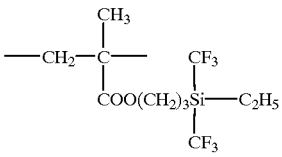 | —$CH_3$ |

| Synthesis Example of Resin (P) | —R' | —Z'— | x/y/z (weight ratio) | p/q (weight ratio) |
|---|---|---|---|---|
| 13 | —$CH_3$ | 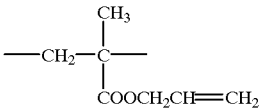 | 40/30/30 | 90/10 |
| 14 | —$C_2H_5$ | 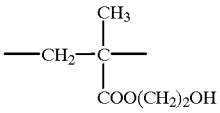 | 30/45/25 | 60/40 |

| Synthesis Example of Resin (P) | Resin (P) | -a | —R | —Y— | -b |
|---|---|---|---|---|---|
| 15 | P-15 | —$CH_3$ | 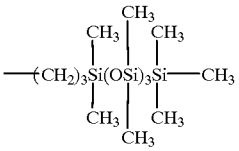 | — | —$CH_3$ |

| Synthesis Example of Resin (P) | —R' | —Z'— | x/y/z (weight ratio) | p/q (weight ratio) |
|---|---|---|---|---|
| 15 | —$C_2H_5$ |  | 80/0/20 | 90/10 |

Synthesis Example 16 of Resin (P): (P-16)

A mixed solution of 67 g of methyl methacrylate, 22 g of methyl acrylate, 1 g of methacrylic acid, and 200 g of toluene was heated to a temperature of 80° C. under nitrogen gas stream. To the solution was added 10 g of Polymer Azobis Initiator (PI-1) having the structure shown below, followed by reacting for 8 hours. After completion of the reaction, the reaction mixture was poured into 1.5 l of methanol, and the precipitate thus-deposited was collected and dried to obtain 75 g of a copolymer having an Mw of $3\times10^4$.

Polymer Initiator (PI-1)

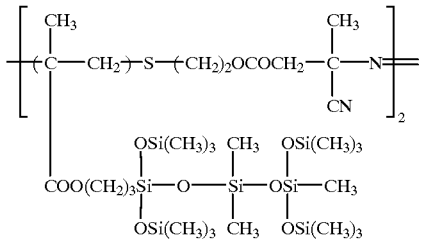

-continued

Polymer (P-16)

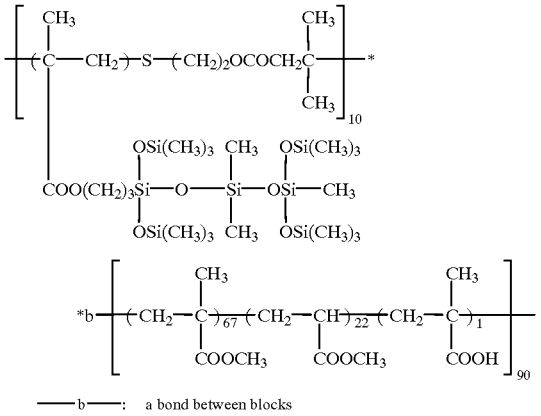

—b—: a bond between blocks

Synthesis Example 17 of Resin (P): (P-17)

A mixed solution of 70 g of methyl methacrylate and 200 g of tetrahydrofuran was thoroughly degassed under nitrogen gas stream and cooled to −20° C. To the solution was added 0.8 g of 1,1-diphenylbutyl lithium, followed by reacting for 12 hours. To the reaction mixture was then added a mixed solution of 30 g of Monomer (M-1) shown below and 60 g of tetrahydrofuran which had been thoroughly degassed under nitrogen gas stream, followed by reacting for 8 hours.

After rendering the mixture to 0° C., 10 ml of methanol was added thereto to conduct a reaction for 30 minutes to stop the polymerization. The resulting polymer solution was heated to a temperature of 30° C. with stirring, and 3 ml of a 30% ethanol solution of hydrogen chloride was added thereto, followed by stirring for 1 hour. The reaction mixture was distilled under reduced pressure to remove the solvent until the volume was reduced to half and the residue was reprecipitated in 1 l of petroleum ether. The precipitate was collected and dried under reduced pressure to obtain 76 g of a polymer having an Mw of $6.8\times10^4$.

Monomer (M-1)

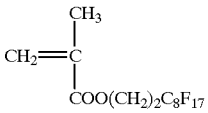

Resin (P-17)

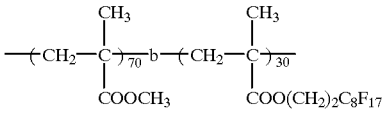

Synthesis Example 18 of Resin (P): (P-18)

A mixed solution of 52.5 g of methyl methacrylate, 22.5 g of methyl acrylate, 0.5 g of methylaluminum tetraphenylporphynate, and 200 g of methylene chloride was heated to a temperature of 30° C. under nitrogen gas stream. The solution was irradiated with light from a xenon lamp of 300 W at a distance of 25 cm through a glass filter for 20 hours. To the mixture was added 25 g of Monomer (M-2) shown below, and the resulting mixture was further irradiated with light under the same conditions as above for 12 hours. To the reaction mixture was added 3 g of methanol, followed by stirring for 30 minutes to stop the reaction. The reaction mixture was reprecipitated in 1.5 l of methanol, and the precipitate was collected and dried to obtain 78 g of a polymer having an Mw of $7\times10^4$.

Monomer (M-2)

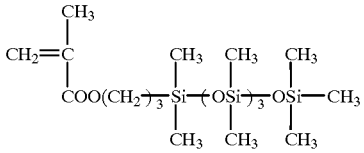

Resin (P-18)

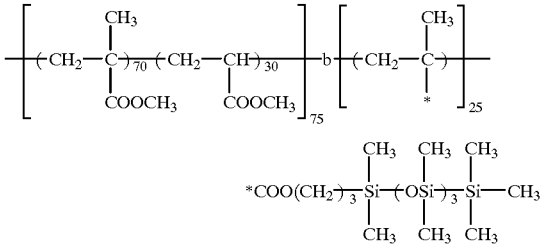

Synthesis Example 19 of Resin (P): (P-19)

A mixture of 50 g of ethyl methacrylate, 10 g of glycidyl methacrylate, and 4.8 g of benzyl N,N-diethyldithiocarbamate was sealed into a container under nitrogen gas stream and heated to a temperature of 50° C. The mixture was irradiated with light from a high-pressure mercury lamp of 400 W at a distance of 10 cm through a glass filter for 6 hours to conduct photopolymerization. The reaction mixture was dissolved in 100 g of tetrahydrofuran, and 40 g of Monomer (M-3) shown below was added thereto. After displacing the atmosphere with nitrogen, the mixture was again irradiated with light for 10 hours. The reaction mixture obtained was reprecipitated in 1 l of methanol, and the precipitate was collected and dried to obtain 73 g of a polymer having an Mw of $4.8\times10^4$.

Monomer (M-3)

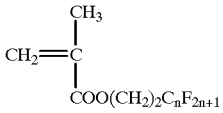

(n: an integer of from 8 to 10)

-continued

Resin (P-19)

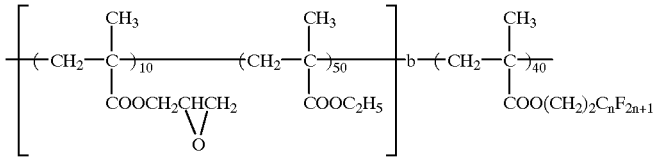

(n: an integer of from 8 to 10)

Synthesis Example 20 of Resin (P): (P-20)

A mixture of 50 g of methyl methacrylate, 25 g of ethyl methacrylate, and 1.0 g of benzyl isopropylxanthate was sealed into a container under nitrogen gas stream and heated to a temperature of 50° C. The mixture was irradiated with light from a high-pressure mercury lamp of 400 W at a distance of 10 cm through a glass filter for 6 hours to conduct photopolymerization. To the mixture was added 25 g of Monomer (M-1) described above. After displacing the atmosphere with nitrogen, the mixture was again irradiated with light for 10 hours. The reaction mixture obtained was reprecipitated in 2 l of methanol, and the precipitate was collected and dried to obtain 63 g of a polymer having an Mw of $6\times10^4$.

Resin (P-20)

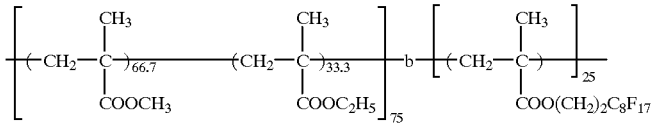

Synthesis Examples 21 to 27 of Resin (P): (P-21) to (P-27)

Each of copolymers shown in Table D below was prepared in the same manner as in Synthesis Example 19 of Resin (P). An Mw of each of the resulting polymers was in a range of from $3.5\times10^4$ to $6\times10^4$.

TABLE D

| Synthesis Example of Resin (P) | Resin (P) | A-B Type Block Copolymer (weight ratio) |
|---|---|---|
| 21 | P-21 | 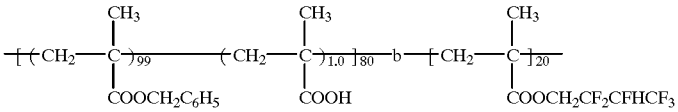 |

TABLE D-continued
| Synthesis Example of Resin (P) | Resin (P) | A-B Type Block Copolymer (weight ratio) |
|---|---|---|
| 22 | P-22 | 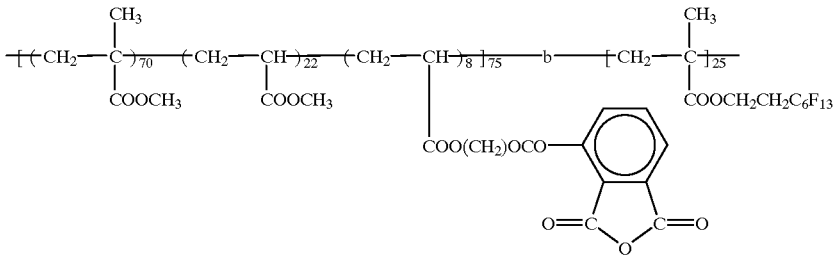 |
| 23 | P-23 | 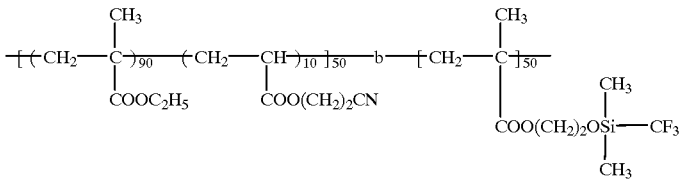 |
| 24 | P-24 | 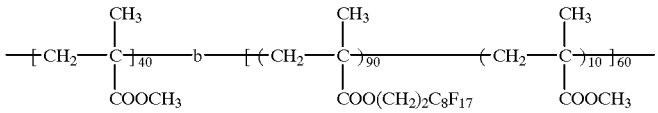 |
| 25 | P-25 | 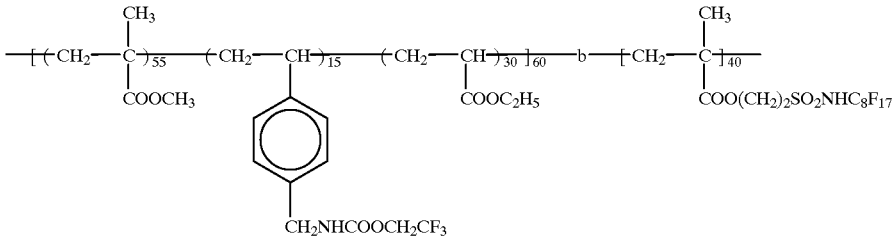 |
| 26 | P-26 | 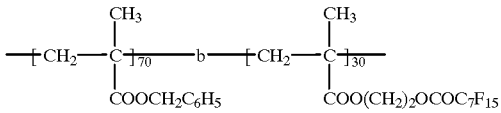 |
| 27 | P-27 | 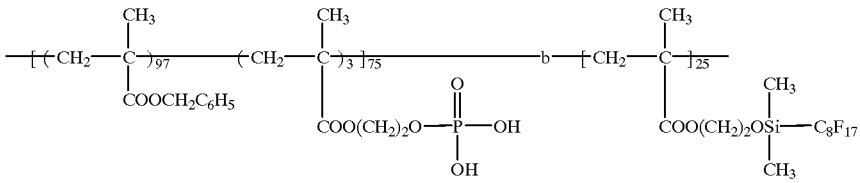 |
Synthesis Example 28 of Resin (P): (P-28)
A copolymer having an Mw of $4.5\times10^4$ was prepared in the same manner as in Synthesis Example 19 of Resin (P), except for replacing benzyl N,N-diethyldithiocarbamate with 18 g of Initiator (I-11) having the structure shown below.

Initiator (I-11)

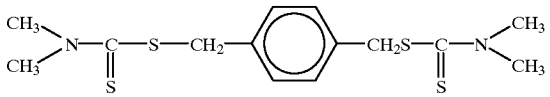

Resin (P-28)

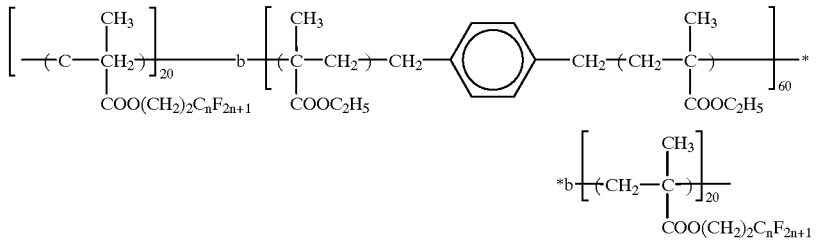

(n: an integer of from 8 to 10)

Synthesis Example 29 of Resin (P): (P-29)

A copolymer having an Mw of $2.5\times10^4$ was prepared in the same manner as in Synthesis Example 20 of Resin (P), except for replacing benzyl isopropylxanthate with 0.8 g of Initiator (I-12) having the structure shown below.

Initiator (I-12)

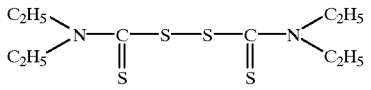

Resin (P-29)

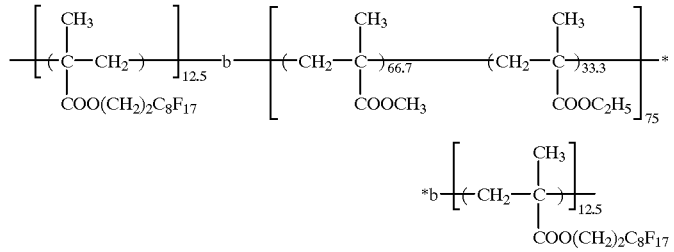

Synthesis Example 30 of Resin (P): (P-30)

A mixed solution of 68 g of methyl methacrylate, 22 g of methyl acrylate, 10 g of glycidyl methacrylate, 17.5 g of Initiator (I-13) having the structure shown below, and 150 g of tetrahydrofuran was heated to a temperature of 50° C. under nitrogen gas stream. The solution was irradiated with light from a high-pressure mercury lamp of 400 W at a distance of 10 cm through a glass filter for 10 hours to conduct photopolymerization. The reaction mixture obtained was reprecipitated in 1 l of methanol, and the precipitate was collected and dried to obtain 72 g of a polymer having an Mw of $4.0\times10^4$.

A mixed solution of 70 g of the resulting polymer, 30 g of Monomer (M-2) described above, and 100 g of tetrahydrofuran was heated to a temperature of 50° C. under nitrogen gas stream and irradiated with light under the same conditions as above for 13 hours. The reaction mixture was reprecipitated in 1.5 l of methanol, and the precipitate was collected and dried to obtain 78 g of a copolymer having an Mw of $6\times10^4$.

Initiator (I-13)

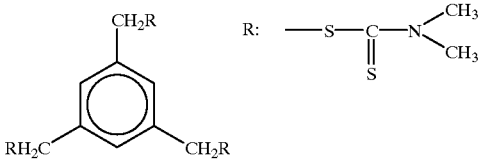

-continued
Resin (P-30)
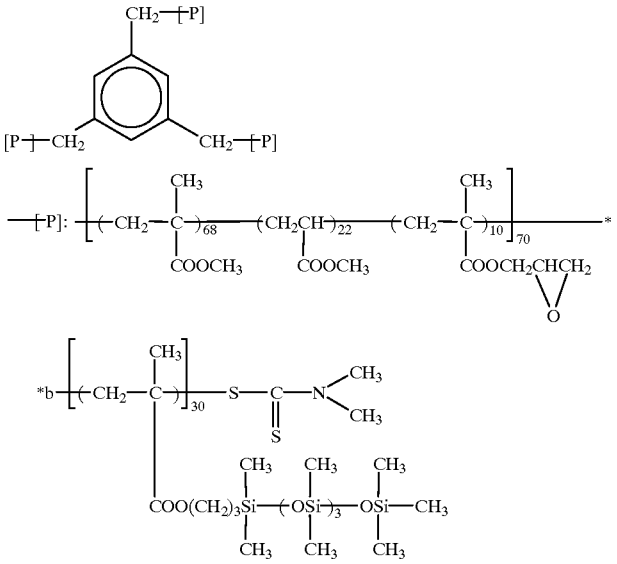
Synthesis Examples 31 to 38 of Resin (P): (P-31) to (P-38)
In the same manner as in Synthesis Example 30 of Resin (P), except for replacing 17.5 g of Initiator (I-13) with 0.031 mol of each of the initiators shown in Table E below, each of the copolymers shown in Table E was obtained. A yield thereof was in a range of from 70 to 80 g and an Mw thereof was in a range of from $4\times10^4$ to $6\times10^4$.

TABLE E
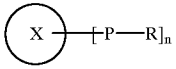
n: an integer
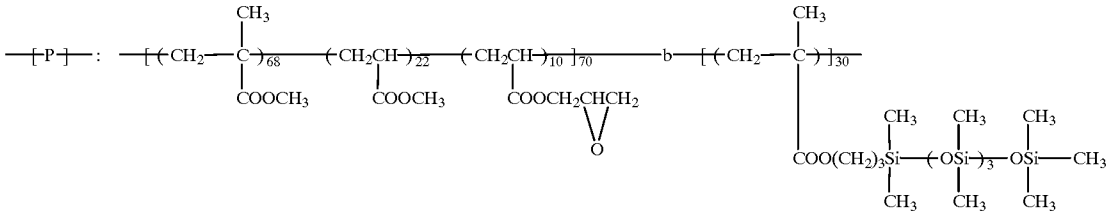
| Synthesis Example of Resin (P) | Resin (P) | Initiator (I) | | —R | X |
|---|---|---|---|---|---|
| 31 | P-31 | 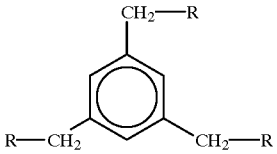 | (I-14) | 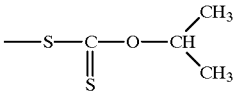 | 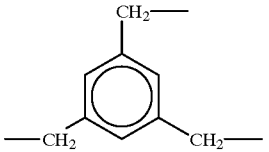 |
| 32 | P-32 | 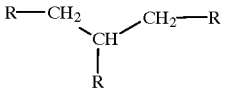 | (I-15) | 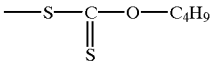 | 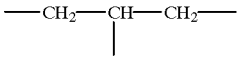 |
| 33 | P-33 | 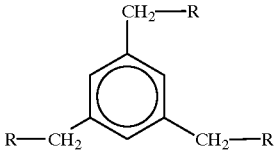 | (I-16) | 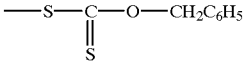 | 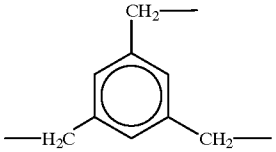 |

TABLE E-continued
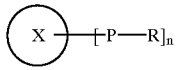
n: an integer
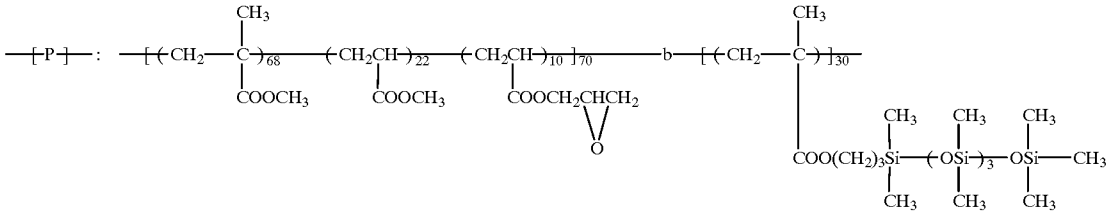
| Synthesis Example of Resin (P) | Resin (P) | Initiator (I) | | —R | 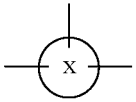 |
|---|---|---|---|---|---|
| 34 | P-34 | 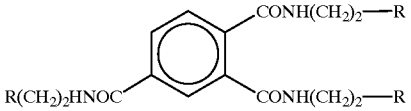 | (I-17) | 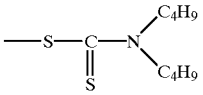 | 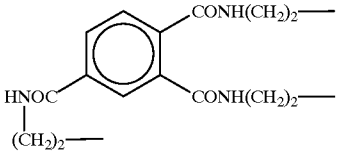 |
| 35 | P-35 | 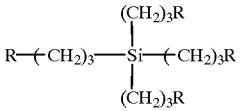 | (I-18) | 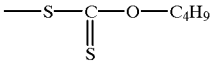 | 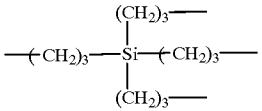 |
| 36 | P-36 | 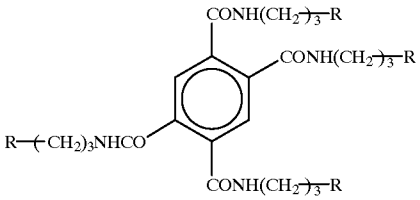 | (I-19) | 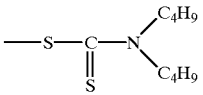 | 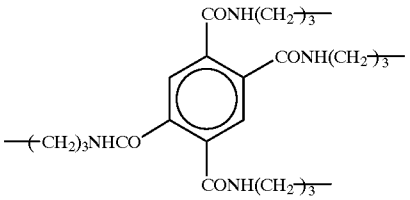 |

TABLE E-continued
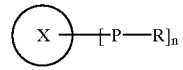
n: an integer
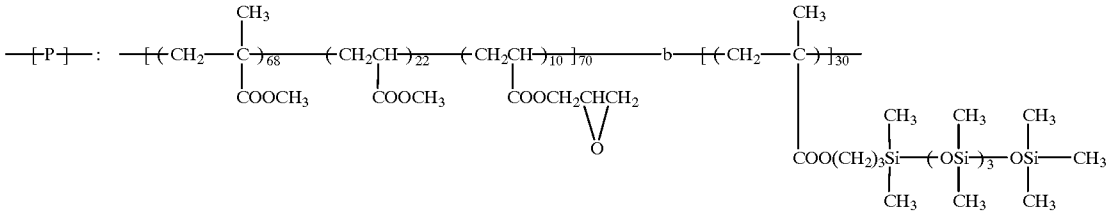
| Synthesis Example of Resin (P) | Resin (P) | Initiator (I) | | —R | |
|---|---|---|---|---|---|
| 37 | P-37 | 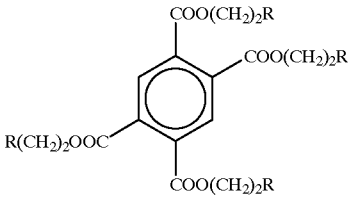 | (I-20) | 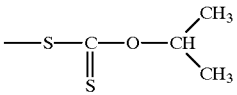 | 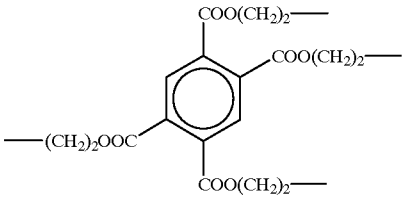 |
| 38 | P-38 | 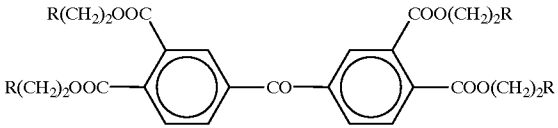 | (I-21) | 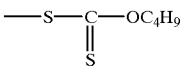 | 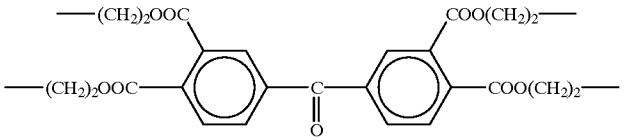 |

SYNTHESIS EXAMPLE 1 OF RESIN GRAIN (PL)

Synthesis Example 1 of Resin Grain (PL): (PL-1)

A mixed solution of 40 g of Monomer (LM-1) having the structure shown below, 2 g of ethylene glycol dimethacrylate, 4.0 g of Dispersion Stabilizing Resin (LP-1) having the structure shown below, and 180 g of methyl ethyl ketone was heated to a temperature of 60° C. with stirring under nitrogen gas stream. To the solution was added 0.3 g of 2,2'-azobis(isovaleronitrile) (abbreviated as AIVN), followed by reacting for 3 hours. To the reaction mixture was further added 0.1 g of AIVN, and the reaction was continued for 4 hours. After cooling, the reaction mixture was passed through a nylon cloth of 200 mesh to obtain a white dispersion. The average grain diameter of the latex was 0.25 μm. The grain diameter was measured by CAPA-500 manufactured by Horiba Ltd. (hereinafter the same).

Monomer (LM-1)

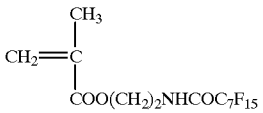

Dispersion Stabilizing Resin (LP-1)

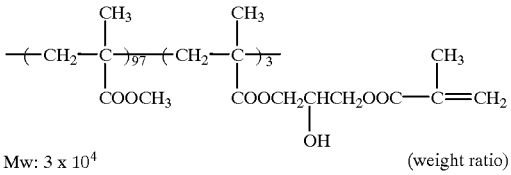

Mw: 3 x $10^4$ (weight ratio)

Synthesis Example 2 of Resin Grain (PL): (PL-2)

A mixed solution of 5 g of AB-6 (a monofunctional macromonomer comprising a butyl acrylate unit, manufactured by Toagosei Chemical Industry Co., Ltd.) as a dispersion stabilizing resin and 140 g of methyl ethyl ketone was heated to a temperature of 60° C. under nitrogen gas stream while stirring. To the solution was added dropwise a mixed solution of 40 g of Monomer (LM-2) having the structure shown below, 1.5 g of ethylene glycol diacrylate, 0.2 g of AIVN, and 40 g of methyl ethyl ketone over a period of one hour. After the addition, the reaction was continued for 2 hours. To the reaction mixture was further added 0.1 g of AIVN, followed by reacting for 3 hours to obtain a white dispersion. After cooling, the dispersion was passed through a nylon cloth of 200 mesh. The average grain diameter of the dispersed resin grains was 0.35 μm.

Monomer (LM-2)

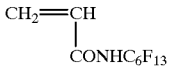

Synthesis Examples 3 to 11 of Resin Grain (PL): (PL-3) to (PL-11)

Each of resin grains was synthesized in the same manner as in Synthesis Example 1 of Resin Grain (PL), except for replacing Monomer (LM-1), ethylene glycol dimethacrylate and methyl ethyl ketone with each of the compounds shown in Table F below, respectively. An average grain diameter of each of the resulting resin grains was in a range of from 0.15 to 0.30 μm.

TABLE F

| Synthesis Example of Resin Grain (PL) | Resin Grain (PL) | Monomer (LM) | Crosslinking Poly-functional Monomer | Amount | Reaction Solvent |
|---|---|---|---|---|---|
| 3 | PL-3 | (LM-3) 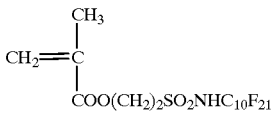 | Ethylene glycol dimethylacrylate | 2.5 g | Methyl ethyl ketone |
| 4 | PL-4 | (LM-4) 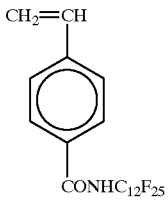 | Divinylbenzene | 3 g | Methyl ethyl ketone |
| 5 | PL-5 | (LM-5) 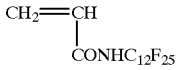 | — | | Methyl ethyl ketone |
| 6 | PL-6 | (LM-6) | Diethylene glycol | 5 g | n-Hexane |

TABLE F-continued

| Synthesis Example of Resin Grain (PL) | Resin Grain (PL) | Monomer (LM) | Crosslinking Poly-functional Monomer | Amount | Reaction Solvent |
|---|---|---|---|---|---|
| | | $CH_2{=}C(CH_3)CONH(CH_2)_3Si(CH_3)_2C_4F_9$ | diacrylate | | |
| 7 | PL-7 | (LM-7) $CH_2{=}C(CH_3)COOCH(CF_3)_2$ | Ethylene glycol dimethylacrylate | 3.5 g | n-Hexane |
| 8 | PL-8 | (LM-8) $CH_2{=}CH\text{-}COO(CH_2)_2CONHC_8F_{17}$ | Trimethylolpropane trimethylacrylate | 2.5 g | Methyl ethyl ketone |
| 9 | PL-9 | (LM-9) $CH_2{=}CH\text{-}CONH(CH_2)_3Si[OSi(CH_3)_3]_3$ | Trivinylbenzene | 3.3 g | Ethyl acetate/ n-Hexane (4/1 by weight) |
| 10 | PL-10 | (LM-10) $CH_2{=}C(CH_3)\text{-}COO(CH_2)_2NHCONH(CH_2)_3Si[OSi(CH_3)_3]_3$ | Divinyl glutaconate | 4 g | Ethyl acetate/ n-Hexane (2/1 by weight) |
| 11 | PL-11 | (LM-11) $CH_2{=}C(CH_3)\text{-}CONHCOOCH_2CF_2CFHCF_3$ | Propylene glycol diacrylate | 3 g | Methyl ethyl ketone |

Synthesis Examples 12 to 17 of Resin Grain (PL): (PL-12) to (PL-17)

Each of resin grains was synthesized in the same manner as in Synthesis Example 2 of Resin Grain (PL), except for replacing 5 g of AB-6 (dispersion stabilizing resin) with each of Resins (LP) shown in Table G below. An average grain diameter of each of the resulting resin grains was in a range of from 0.10 to 0.25 μm.

TABLE G

| Synthesis Example of Resin Grain (PL) | Resin Grain (PL) | Dispersion Stabilizing Resin (LP) | Amount |
|---|---|---|---|
| 12 | PL-12 | $-(CH_2-C(CH_3)(COOCH_3))_{67}-(CH_2-CH(COOCH_3))_{30}-(CH_2-C(CH_3)(COO(CH_2)_2OCO(CH_2)_2COOCH_2CH(OH)CH_2OCO\text{-}CH{=}CH_2))_3-$ (LP-2) Mw $3.3 \times 10^4$ | 4 g |

TABLE G-continued

| Synthesis Example of Resin Grain (PL) | Resin Grain (PL) | Dispersion Stabilizing Resin (LP) | Amount |
|---|---|---|---|
| 13 | PL-13 | 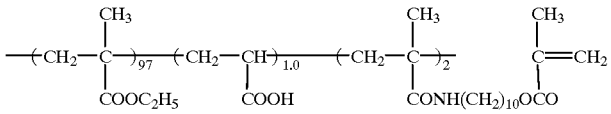 (LP-3) Mw 2.5 × $10^4$ | 2 g |
| 14 | PL-14 | 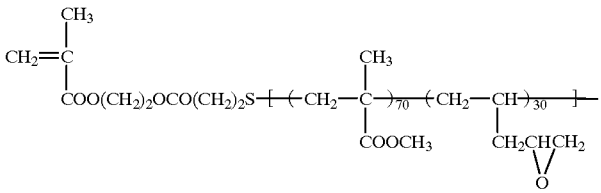 (LP-4) Mw 8 × $10^3$ | 6 g |
| 15 | PL-15 | 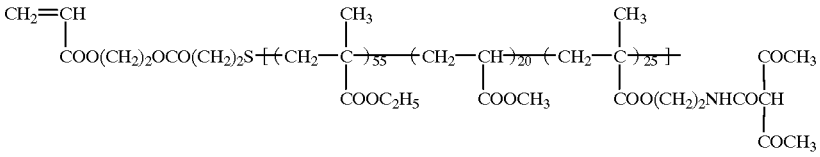 (LP-5) Mw 1 × $10^4$ | 6 g |
| 16 | PL-16 | 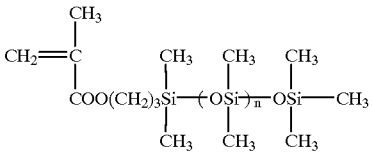 (LP-6) Mw 1 × $10^4$ | 4 g |
| 17 | PL-17 | 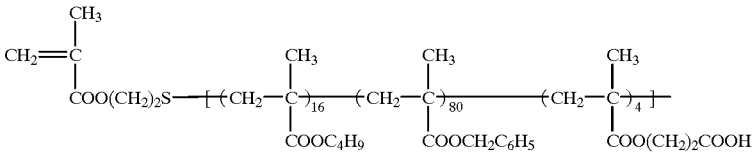 (LP-7) Mw 6 × $10^3$ | 5 g |

Synthesis Examples 18 to 23 of Resin Grain (PL): (PL-18) to (PL-23)

Each of resin grains was synthesized in the same manner as in Synthesis Example 2 of Resin Grain (PL), except for replacing 40 g of Monomer (LM-2) with each of the monomers shown in Table H below and replacing 5 g of AB-6 (dispersion stabilizing resin) with 6 g of Dispersion Stabilizing Resin (LP-8) having the structure shown below. An average grain diameter of each of the resulting resin grains was in a range of from 0.05 to 0.20 $\mu$m.

Dispersion Stabilizing Resin (LP-8)

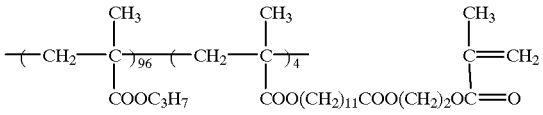

Mw 3 × $10^4$

TABLE H

| Synthesis Example of Resin Grain (PL) | Resin Grain (PL) | Monomer (LM) | Amount | Other Monomer | Amount |
|---|---|---|---|---|---|
| 18 | PL-18 | (LM-12) $CH_2{=}C(CH_3)COO(CH_2)_2C_8F_{17}$ | 30 g | $CH_2{=}CH\text{-}CONHCH_2OCH_3$ | 10 g |
| 19 | PL-19 | (LM-13) $CH_2{=}C(CH_3)COO(CH_2)_3Si(CH_3)_2(OSi(CH_3)_2)_2OSi(CH_3)_3$ | 25 g | Glycidyl methacrylate | 15 g |
| 20 | PL-20 | (LM-14) $CH_2{=}CH\text{-}COOCH_2CF_2CF_2H$ | 20 g | Acrylonitrile | 20 g |
| 21 | PL-21 | (LM-15) 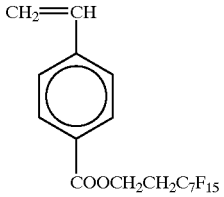 | 25 g | 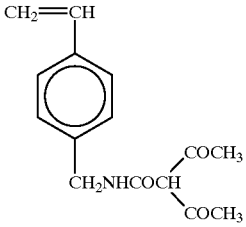 | 15 g |
| 22 | PL-22 | (LM-16) $CH_2{=}C(CH_3)COO(CH_2)_2OSi(CH_3)_2C_6F_{13}$ | 20 g | Methyl methacrylate | 20 g |
| 23 | PL-23 | (LM-17) $CH_3\text{-}CH{=}CH\text{-}COOCH_2CF_2CFHCF_3$ | 20 g | Vinyl acetate | 20 g |

SYNTHESIS EXAMPLES OF RESIN GRAIN (ARW):

Synthesis Example 1 of Resin Grain (ARW): (ARW-1)

A mixture of 12 g of Dispersion Stabilizing Resin (Q-1) described below, 70 g of vinyl acetate, 30 g of vinyl butyrate and 388 g of Isopar H was heated to a temperature of 80° C. under nitrogen gas stream while stirring. To the solution was added 1.5 g of AIBN as a polymerization initiator, followed by reacting for 2 hours. To the reaction mixture was added 0.8 g of AIBN, followed by reacting for 2 hours. Further, 0.8 g of AIBN, followed by reacting for 2 hours. After cooling the reaction mixture was passed through a nylon cloth of 200 mesh to obtain a white dispersion which was a latex of good monodispersity with a polymerization ratio (i.e., the ratio of the amount of polymerized monomer components to the total amount of monomer components to be charged in the reaction system) of 93% and an average grain diameter of 0.18 $\mu$m.

A part of the above-described white dispersion was centrifuged at a rotation of $1\times10^4$ r.p.m. for 60 minutes and the resin grains precipitated were collected and dried. A weight average molecular weight (Mw) and a glass transition point (Tg) of the resin grain were measured. An Mw of the resin grain was $8\times10^4$ and a Tg thereof was 18° C.

The resin grain thus-obtained is designated as Resin Grain (AR-1).

A mixed solution of the whole amount of the above-described resin grain dispersion (as seed) and 10 g of Dispersion Stabilizing Resin (Q-2) described below was heated to a temperature of 60° C. under nitrogen gas stream with stirring. To the mixture was added dropwise a mixture of 60 g of methyl methacrylate, 40 g of methyl acrylate, 2.0 g of methyl 3-mercaptopropionate, 0.8 g of AIVN and 400 g of Isopar G over a period of 2 hours, followed by further reacting for 2 hours. Then 0.8 g of AIVN was added to the reaction mixture, the temperature thereof was raised to 70° C., and the reaction was conducted for 2 hours. Further, 0.6 g of AIVN was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.25 μm.

Dispersion Stabilizing Resin

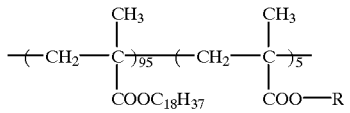

(Q-1):R: $-(CH_2)_2OCO(CH_2)_2COOCH{=}CH_2$ Mw $4\times10^4$ (Q-2):R: $-(CH_2)_5OCO(CH_2)_2COO(CH_2)_2OOC-C(CH_3){=}CH_2$ Mw $5\times10^4$ In order to investigate that the resin grain thus-obtained was composed of the two kinds of resins, the state of resin grain was observed using a scanning electron microscope (SEM).

Specifically, the dispersion of Resin Grain (ARW-1) was applied to a polyethylene terephthalate film so that the resin grains were present in a dispersive state on the film, followed by heating at a temperature of 20° C. or 50° C. for 5 minutes to prepare a sample. Each sample was observed using a scanning electron microscope (JSL-T330 Type manufactured by JEOL Co., Ltd.) of 20,000 magnifications. As a result, the resin grains were observed with the sample heated at 20° C. On the contrary, with the sample heated at 50° C. the resin grains had been melted by heating and were not observed.

The state of resin grain was observed in the same manner as described above with respect to resin grains formed from respective two kinds of resins (copolymers) constituting Resin Grain (ARW-1), i.e., Resin Grain (AR-1) having a Tg of 18° C. and Resin Grain (AR-2) having a Tg of 45° C. described below, and a mixture of these resin grains in a weight ratio of 1:1.

Preparation of Resin Grain (AR-2)

A mixed solution of 18 g of Dispersion Stabilizing Resin (Q-2) described above and 553 g of Isopar H was heated to a temperature of 55° C. under nitrogen gas stream while stirring. To the solution was added dropwise a mixture of 60 g of methyl methacrylate, 40 g of methyl acrylate, 1.3 g of methyl 3-mercaptopropionate and 1.0 g of 2,2'-azobis(2-cycropropionitrile) (abbreviated as ACPP) over a period of 30 minutes, followed by reacting for 1.5 hours. To the reaction mixture was further added 0.8 g of ACPP, followed by reacting for 2 hours. Then, 0.8 g of AIVN was added thereto and the temperature was adjusted to 80° C., and the reaction was continued for 2 hours. To the reaction mixture was further added 0.5 g of AIVN, followed by reacting for 2 hours.

After cooling, the reaction mixture was passed through a nylon cloth of 200 mesh to obtain a white dispersion which was a latex of good monodispersity with a polymerization ratio of 99% and an average grain diameter of 0.15 μm. An Mw of the resin grain was $1.5\times10^4$ and a Tg thereof was 45° C.

As a result, it was found that with Resin Grain (AR-1), the resin grains were not observed in the sample heated at 20° C., although the resin grains were observed in the sample before heating. On the other hand, with Resin Grain (AR-2), the resin grains were not observed in the sample heated at 50° C. Further, with the mixture of two kinds of resin grains, disappearance of the resin grains was observed in the sample heated at 20° C. in comparison with the sample before heating.

From these results it was confirmed that Resin Grain (ARW-1) described above was not a mixture of two kinds of resin grains but contained two kinds of resins therein, and had a core/shell structure wherein the resin having a relatively high Tg formed shell portion and the resin having a relatively low Tg formed core portion.

Synthesis Examples 2 to 14 of Resin Grain (ARW): (ARW-2) to (ARW-14)

Each of Resin Grains (ARW-2) to (ARW-14) was synthesized in the same manner as in Synthesis Example 1 of Resin Grain (ARW) except for using each of the monomers shown in Table I below in place of the monomers employed in Synthesis Example 1 of Resin Grain (ARW). A polymerization ratio of each of the resin grains obtained in latexes was in a range of from 95 to 99% and an average grain diameter thereof was in a range of from 0.20 to 0.30 μm with good monodispersity.

TABLE I

| Synthesis Example of Resin Grain (ARW) | Resin Grain (ARW) | Monomer for Seed Grain | Weight Ratio | Monomer for Feeding | Weight Ratio |
|---|---|---|---|---|---|
| 2 | ARW-2 | Methyl methacrylate | 60 | Methyl methacrylate | 70 |
| | | Butyl acrylate | 40 | 2-Propoxyethyl methacrylate | 30 |
| 3 | ARW-3 | Methyl methacrylate | 30 | Vinyl acetate | 100 |
| | | Methyl acrylate | 70 | | |
| 4 | ARW-4 | Phenethyl methacrylate | 70 | Methyl methacrylate | 60 |
| | | 2-Butoxyethyl methacrylate | 30 | 2-(2-Butoxyethyloxy)ethyl methacrylate | 40 |
| 5 | ARW-5 | Vinyl acetate | 80 | Methyl methacrylate | 65 |
| | | Vinyl valerate | 20 | Methyl acrylate | 35 |
| 6 | ARW-6 | Methyl methacrylate | 60 | 3-Phenylpropyl methacrylate | 70 |
| | | 2,3-Dibutyroyloxypropyl methacrylate | 40 | 3-Propoxypropyl methacrylate | 30 |

TABLE I-continued

| Synthesis Example of Resin Grain (ARW) | Resin Grain (ARW) | Monomer for Seed Grain | Weight Ratio | Monomer for Feeding | Weight Ratio |
|---|---|---|---|---|---|
| 7 | ARW-7 | Methyl methacrylate | 40 | 2-Phenoxyethyl methacrylate | 60 |
| | | 2-Butoxycarbonylethyl methacrylate | 60 | Methyl methacrylate | 40 |
| 8 | ARW-8 | Ethyl methacrylate | 50 | Methyl methacrylate | 70 |
| | | Methyl methacrylate | 50 | 2-Methoxyethyl acrylate | 25 |
| | | | | Macromonomer | 5 |
| | | | | 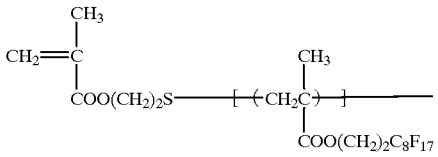 | |
| 9 | ARW-9 | Methyl methacrylate | 75 | Methyl methacrylate | 50 |
| | | Hexyl acrylate | 25 | Methyl acrylate | 50 |
| 10 | ARW-10 | Vinyl acetate | 100 | Vinyl acetate | 60 |
| | | | | Vinyl propionate | 40 |
| 11 | ARW-11 | Methyl methacrylate | 70 | Methyl methacrylate | 30 |
| | | Dodecyl methacrylate | 30 | Ethyl acrylate | 70 |
| 12 | ARW-12 | Methyl methacrylate | 50 | Methyl methacrylate | 100 |
| | | Ethyl acrylate | 50 | | |
| 13 | ARW-13 | Styrene | 80 | Vinyl acetate | 80 |
| | | Vinyl toluene | 20 | Vinyl propionate | 20 |
| 14 | ARW-14 | Vinyl acetate | 75 | Methyl methacrylate | 60 |
| | | Crotonic acid | 5 | Butyl acrylate | 40 |
| | | Vinyl butyrate | 20 | | |

Synthesis Example 15 of Resin Grain (ARW): (ARW-15)

A mixture of resins (A) comprising vinyl acetate/ethylene (46/54 by weight ratio) copolymer (Evaflex 45X manufactured by Du Pont-Mitsui Polychemicals Co., Ltd.) having a Tg of −25° C. and polyvinyl acetate having a Tg of 38° C. in a weight ratio of 1:1 was melted and kneaded by a three-roll mill at a temperature of 120° C. and then pulverized by a trio-blender. A mixture of 5 g of the resulting coarse powder, 4 g of a dispersion stabilizing resin (Sorprene 1205 manufactured by Asahi Kasei Kogyo Kabushiki Kaisha) and 51 g of Isopar H was dispersed in a paint shaker (manufactured by Toyo Seiki Seisakusho Co.) with glass beads having a diameter of about 4 mm for 20 minutes. The resulting pre-dispersion was subjected to a wet type dispersion process using Dyno-mill KDL (manufactured by Sinmaru Enterprises Co., Ltd.) with glass beads having a diameter of from 0.75 to 1 mm at a rotation of 4500 r.p.m. for 6 hours, and then passed through a nylon cloth of 200 mesh to obtain a white dispersion which was a latex having an average grain diameter of 0.4 μm.

Synthesis Examples 16 to 20 of Resin Grain (ARW): (ARW-16) to (ARW-20)

Each dispersion was prepared according to a wet type dispersion process in the same manner as in Synthesis Example 15 of Resin Grain (ARW) except for using each of the compounds shown in Table J below in place of two kinds of the resins (A) employed in Synthesis Example 15 of Resin Grain (ARW). An average grain diameter of each of the white dispersion obtained was in a range of from 0.3 to 0.6 μm.

TABLE J

| Synthesis Example | Resin Grain (ARW) | Resin for Transfer Layer |
|---|---|---|
| 16 | ARW-16 | Mixture of cellulose acetate butyrate (Cellidor Bsp manufactured by Bayer AG) and vinyl acetate/crotonic acid (99/1 by weight ratio) copolymer in a weight ratio of 60:40 |
| 17 | ARW-17 | Mixture of styrene/butadiene copolymer(Sorprene 1204 manufactured by Asahi Kasei Kogyo Kabushiki Kaisha) and styrene/vinyl acetate (20/80 by weight ratio) copolymer in a weight ratio of 50:50 |
| 18 | ARW-18 | Mixture of polyvinyl butyral resin (S-Lec manufactured by |

TABLE J-continued

| Synthesis Example | Resin Grain (ARW) | Resin for Transfer Layer |
|---|---|---|
| | | Sekisui Chemical Co., Ltd.) and cellulose propionate (Cellidoria manufactured by Daicel Co., Ltd. in a weight ratio of 70:30 |
| 19 | ARW-19 | Mixture of polyester resin (Chemit R-185 manufactured by Toray Co., Ltd.) and methyl methacrylate/butyl acrylate (60/40 by weight ratio) AB block copolymer in a weight ratio of 50:50 |
| 20 | ARW-20 | Mixture of polydecamethylene terephthalate and polypentamethylene carbonate in a weight ratio of 30:70 |

EXAMPLE 1

A mixture of 2 g of X-form metal-free phthalocyanine (manufactured by Dainippon Ink and Chemicals, Inc.), 14.4 g of Binder Resin (B-1) having the structure shown below, 3.6 g of Binder Resin (B-2) having the structure shown below, 0.15 g of Compound (A) having the structure shown below, and 80 g of tetrahydrofuran was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

Binder Resin (B-1)

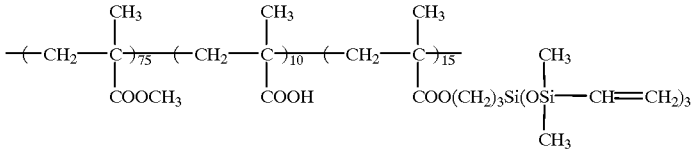

Mw $6 \times 10^4$ (weight ratio)

Binder Resin (B-2)

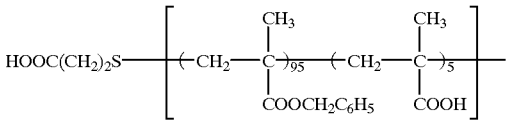

Mw $8 \times 10^3$

Compound (A)

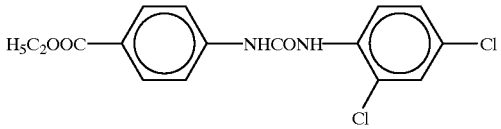

The resulting dispersion was coated on an aluminium plate having a thickness of 0.2 mm, which had been subjected to degrease treatment, by a wire bar, set to touch, and heated at 110° C. for 20 seconds to form a light-sensitive layer having a thickness of 8 μm.

Then, a surface layer for imparting releasability having a thickness of 1.5 μm was provided on the light-sensitive layer.

Formation of Surface Layer for Imparting Releasability

A coating composition comprising 10 g of silicone resin having the structure shown below, 1 g of crosslinking agent having the structure shown below, 0.2 g of crosslinking controller having the structure shown below, 0.1 g of platinum as a catalyst for crosslinking and 100 g of n-hexane was coated by a wire round rod, set to touch, and heated at 120° C. for 10 minutes to form the surface layer having a thickness of 1.5 μm. The adhesive strength of the surface of the resulting light-sensitive element measured according to JIS Z 0237-1980 "Testing methods of pressure sensitive adhesive tapes and sheets" was not more than 1 g·f.

Silicone Resin

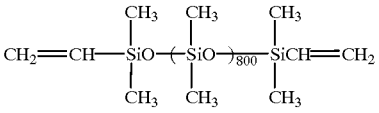

(presumptive structure)

Crosslinking Controller

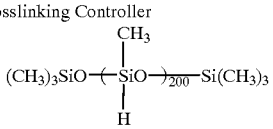

(presumptive structure)

-continued

Crosslinking Controller $CH{\equiv}C{-}Si(OCH_3)_3$

The light-sensitive element having the surface of releasability was installed in an apparatus as shown in FIG. 2 as a light-sensitive element 11. On the other hand, a drum wound with a blanket for offset printing (9600-A manufactured by Meiji Rubber & Co., Ltd.; having the adhesive strength of 80 g·f and a thickness of 1.6 mm) was installed as a primary receptor 20.

An electrophotographic process was then performed. Specifically, the light-sensitive element 11 was charged to +450 V with a corona charger 18 in dark and image-exposed to light using a semiconductor laser having an oscillation wavelength of 788 nm as an exposure device 19 at an irradiation dose on the surface of the light-sensitive element of 30 erg/cm$^2$, based on digital image data on an information for yellow color separation among digital image data on informations for yellow, magenta, cyan and black color separations which had been obtained by reading an original by a color scanner, conducting several corrections relating to color reproduction peculiar to color separation system and memorized in a hard disc.

Thereafter, the exposed light-sensitive element was subjected to reversal development using a liquid developer prepared by diluting a yellow liquid developer for Signature System (manufactured by Eastman Kodak Co.) with 75-fold by weight Isopar H (manufactured by Esso Standard Oil Co.) while a bias voltage of +350 V was applied to a yellow liquid developing unit 14*y* to thereby electrodeposit toner particles on the exposed areas. The light-sensitive element was then rinsed in a bath of Isopar H alone to remove stains in the non-image areas, and dried by passing under a suction/exhaust unit 15 and a heating means 16.

The above procedure was repeated using each information for magenta, cyan and black in place of the information for yellow to form color toner images.

On the light-sensitive element bearing the toner image was formed a transfer layer according to the electrodeposition coating method while supplying Dispersion of Resin (A) (L-1) having the composition shown below to an electrodeposition unit of thermoplastic resin grain 50 as a transfer layer-forming device.

| Dispersion of Resin (A) (L-1) | |
|---|---|
| Resin Grain (ARW-1) | 15 g (solid basis) |
| Charge Control Agent (D-1) (octadecyl vinyl ether/N-tert-octyl maleic monoamide copolymer) | 0.08 g |
| Branched tetradecyl alcohol (FOC-1400 manufactured by Nissan Chemical Industries, Ltd.) | 10 g |
| Isopar H | up to make 1 liter |

Specifically, on the surface of light-sensitive element which had been adjusted at 60° C. by a heating means of infrared line heater and installed on a drum which was rotated at a circumferential speed of 100 mm/sec, Dispersion (L-1) described above was supplied using a slit electrodeposition device, while putting the light-sensitive element to earth and applying an electric voltage of 150 V to an electrode of the slit electrodeposition device, whereby the resin grains were electrodeposited. The dispersion medium was removed by air-squeezing using a suction/exhaust unit, and the resin grains were fused to form a film, whereby a transfer layer composed of a thermoplastic resin was prepared on the light-sensitive element. A thickness of the transfer layer was 2.0 $\mu$m.

The primary receptor 20 was heated at 120° C. and the light-sensitive element was heated using the heating means 16 and a temperature controller 17 so as to maintain the surface temperature of light-sensitive element at 60° C. The drum of light-sensitive element 11 and the drum of primary receptor 20 were brought into contact with each other under the condition of a nip pressure of 3 kgf/cm$^2$ and a drum circumferential speed of 100 mm/sec, whereby the color toner images were wholly transferred together with the transfer layer on the primary receptor 20.

Then, a coated paper was introduced as a receiving material 21 on a back-up roller for transfer 22 adjusted at 130° C. and a back-up roller for release 23 adjusted at 10° C. and the coated paper was brought into contact with the primary receptor 20 of drum type, the surface temperature of which had been adjusted at 60° C. by the temperature controller 17, under a nip pressure of 4 kgf/cm$^2$ and at a drum circumferential speed of 100 mm/sec. The color toner images were wholly transferred onto the coated paper and thus clear color images of good image quality were obtained.

For comparison, the same procedure as above was performed except that the transfer layer was not formed on the light-sensitive element bearing the toner image. In the resulting color images on the coated paper, cuttings of toner image and unevenness in image density were observed. Further, as a result of visual evaluation of the color images using a magnifying glass of 20 magnifications, cuttings of fine image, for example, fine lines and fine letters were recognized. Also, the residue of toner image was found on the surface of light-sensitive element.

These results indicate that cleaning of the surface of light-sensitive element is necessary for removing the residual toner when the light-sensitive element is repeatedly employed. Consequently, a device for the cleaning must be provided and a problem in that the surface of light-sensitive element is damaged due to the cleaning arises. On the contrary, the method according to the present invention has advantages in that the release of toner image from the light-sensitive element is sufficiently performed by utilizing the transfer layer of the present invention, in that the toner image is easily and sufficiently transferred from the primary receptor to the receiving material and in that a color duplicate obtained is excellent in storage stability since the toner image is protected by the transfer layer on the receiving material.

EXAMPLE 2

An amorphous silicon electrophotographic light-sensitive element was treated with tridecylfluorooxyltrimethoxysilane to modify its surface. The adhesive strength of the surface of light-sensitive element was 8 g·f. The resulting electrophotographic light-sensitive element was installed in an apparatus as shown in FIG. 2 wherein an applying device of compound (S) was omitted.

The light-sensitive element was charged to +700 V with a corona discharge in dark and exposed to light using a semiconductor laser having an oscillation wavelength of 780 nm on the basis of digital image data on an information for yellow color separation same as in Example 1. A residual potential in the exposed area was +120 V. The exposed light-sensitive element was then subjected to reversal development by supplying a liquid developer prepared by diluting a yellow toner for an electrostatic color plotter (Versateck 3000 manufactured by Xerox Corp.) with 50-fold Isopar H from the developing unit to the surface of light-sensitive element while applying a bias voltage of +300 V to the developing unit side to thereby electrodeposite yellow toner particles on the unexposed areas. The light-sensitive element was then rinsed in a bath of Isopar H alone to remove stains in the non-image areas and dried.

The above procedure was repeated using each information for magenta, cyan and black in place of the information for yellow.

The light-sensitive element was subjected to fixing by means of a heat roll whereby the toner image was fixed. In order to confirm reproducibility of the image before transfer, the occurrence of fog an image quality were evaluated using an optical microscope of 200 magnifications. As a result, it was found that clear images were obtained in highly accurate image portions such as fine lines, fine letters and dots for continuous gradation, the maximum density of image was more than 1.2 and no fog was observed in the non-image areas.

On the surface of light-sensitive element which had been adjusted at 60° C. and rotated at a circumferential speed of 100 mm/sec, Dispersion of Resin (A) (L-2) shown below was supplied using a slit electrodeposition device, while putting the light-sensitive element to earth and applying an electric voltage of 100 V to an electrode of the slit electrodeposition device, whereby the resin grains were electrodeposited and fixed to form a transfer layer having a thickness of 2 μm.

| Dispersion of Resin (A) (L-2) | |
|---|---|
| Resin Grain (ARW-2) | 20 g (solid basis) |
| Charge Control Agent (D-2) (1-tetradecene/decyl maleic monoamide copolymer) | 0.06 g |
| Branched octadecyl alcohol (FOC-1800 manufactured by Nissan Chemical Industries, Ltd.) | 10 g |
| Isopar G | up to make 1 liter |

A primary receptor was prepared by applying a mixture of 100 g of isoprene rubber, 8 g of Resin (P-2) and 0.001 g of phthalic anhydride to the surface of blancket for offset printing (9600-A) described in Example 1 and heated at 140° C. for 2 hours to form a cured layer having a thickness of 10 μm. The adhesive strength of the surface of the resulting primary receptor was 80 g·f.

Using the light-sensitive element having the transfer layer thereon and the primary receptor, a color image was formed on a coated paper in the same procedure as in Example 1.

The color image obtained was clear and did not fall off when it was rubbed since the toner image was covered with the transfer layer having a good film strength. Also, it was excellent in a retouching property with an HB pencil and a sealing property.

EXAMPLE 3

A mixture of 2 g of X-form metal-free phthalocyanine (manufactured by Dainippon Ink and Chemicals, Inc.), 10 g of Binder Resin (B-3) having the structure shown below, 0.15 g of Compound (B) having the structure shown below, and 80 g of tetrahydrofuran was put into a 500 ml-volume glass container together with glass beads and dispersed in a paint shaker (manufactured by Toyo Seiki Seisakusho Co.) for 60 minutes. To the dispersion were added 2 g of Resin (P-35), 0.1 g of gluconic anhydride and 0.002 g o-chlorophenol, followed by dispersing for 10 minutes. The glass beads were separated by filtration to prepare a dispersion for a light-sensitive layer.

Binder Resin (B-3)

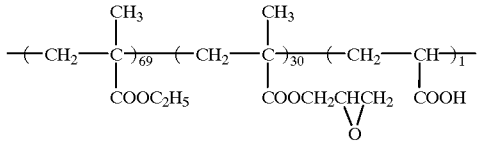

Mw 5.5 × $10^4$

Compound (B)

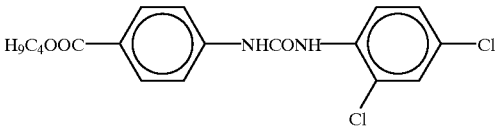

The resulting dispersion was coated on an aluminum plate having a thickness of 0.2 mm, which had been subjected to degrease treatment, by a wire bar, set to touch, and heated in a circulating oven at 110° C. for 20 seconds and then at 140° C. for 2 hours to form a light-sensitive element comprising a light-sensitive layer having a thickness of 8 μm. The adhesion strength of the surface of the resulting electrophotographic light-sensitive element was 2 g·f.

For comparison, an electrophotographic light-sensitive element was prepared in the same manner as described above except for eliminating 2 g of Resin (P-35). The adhesive strength of the surface thereof was more than 450 g·f and did not exhibit releasability at all.

The resulting light-sensitive element of the present invention was installed in an apparatus as shown in FIG. 2 wherein an applying device of Compound (S) was omitted. The formation of toner image, formation of transfer layer, transfer onto a primary receptor and transfer onto coated paper were conducted in the same manner as in Example 1.

The color image obtained on coated paper was clear and did not fall off when it was rubbed because the toner image was covered with the transfer layer composed of the thermoplastic resin on the coated paper.

EXAMPLE 4

5 g of 4,4'-bis(diethylamino)-2,2'-dimethyltriphenylmethane as an organic photoconductive substance, 4 g of Binder Resin (B-4) having the structure shown below, 0.4 g of Resin (P-27), 40 mg of Dye (D-1) having the structure shown below, and 0.2 g of Anilide Compound (C) having the structure shown below as a chemical sensitizer were dissolved in a mixed solvent of 30 ml of methylene chloride and 30 ml of ethylene chloride to prepare a solution for light-sensitive layer.

Binder Resin (B-4)

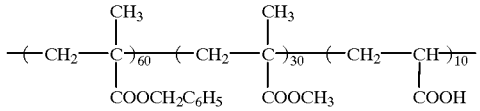

Mw 8 × $10^4$

-continued

Dye (D-1)

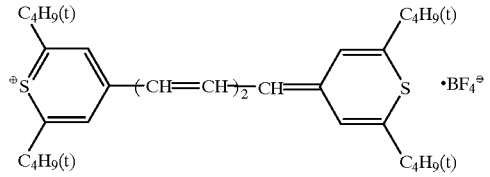

Anilide Compound (C)

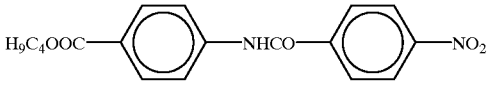

The resulting solution for light-sensitive layer was coated on a conductive transparent substrate composed of a 100 μm-thick polyethylene terephthalate film having a deposited layer of indium oxide thereon (surface resistivity: $10^3$ Ω) by a wire round rod to prepare a light-sensitive element having an organic light-sensitive layer having a thickness of about 4 μm. The adhesive strength of the surface of light-sensitive element was 8 g·f.

The procedure same as in Example 1 was repeated except for using the resulting light-sensitive element in place of the light-sensitive element employed in Example 1 to prepare transferred images. The color images obtained on coated paper were clear and free from background stain and had good image strength.

EXAMPLES 5 TO 16

Color images were formed in the same manner as in Example 1 except for using 15 g of each of Resin Grains (ARW) shown in Table K below in place of 15 g of Resin Grain (ARW-1) in Dispersion of Resin (A) (L-1) respectively.

TABLE K

| Example | Resin Grain (ARW) |
|---|---|
| 5 | ARW-3 |
| 6 | ARW-4 |
| 7 | ARW-5 |
| 8 | ARW-6 |
| 9 | ARW-7 |
| 10 | ARW-8 |
| 11 | ARW-10 |
| 12 | ARW-16 |
| 13 | ARW-17 |
| 14 | ARW-18 |
| 15 | ARW-19 |
| 16 | ARW-20 |

The color duplicates obtained had clear image free from background stain. Specifically, the toner images formed on the light-sensitive element had good reproducibility and no fog in the non-image areas, and were wholly transferred together with the transfer layer to receiving material without the formation of unevenness. Further, on the duplicate, retouching and sealing can be made same as on plain paper.

EXAMPLE 17

The procedure same as in Example 2 was repeated except for using a light-sensitive element prepared by providing a surface layer for imparting releasability having a thickness of 1.5 μm on an amorphous silicon electrophotographic light-sensitive element as shown below to prepare a color duplicate.

Formation of Surface Layer for Imparting Releasability

A solution comprising 1.0 g of Resin (P-12), 15 g of Binder Resin (B-5) having the structure shown below, 0.03 g of phthalic anhydride and 100 g toluene was coated on the amorphous silicon light-sensitive element, set to touch, and heated at 130° C. for one hour to cure to form the surface layer having a thickness of 1.5 μm. The adhesive strength of the surface of the resulting light-sensitive element was 8 g·f.

Binder Resin (B-5)

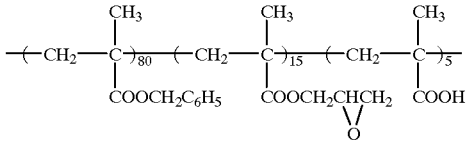

Mw: $3 \times 10^4$

The duplicated image formed on the light-sensitive element was good, and the color duplicate obtained on coated paper was also good and substantially same as the original without the formation of unevenness. Further, the color duplicate had good filing aptitude and sealing property.

EXAMPLE 18

A mixture of 5 g of a bisazo pigment having the structure shown below, 95 g of tetrahydrofuran and 5 g of a polyester resin (Vylon 200 manufactured by Toyobo Co., Ltd.) was thoroughly pulverized in a ball mill. The mixture was added to 520 g of tetrahydrofuran with stirring. The resulting dispersion was coated on a conductive transparent substrate used in Example 4 by a wire round rod to prepare a charge generating layer having a thickness of about 0.7 μm.

Bisazo Pigment

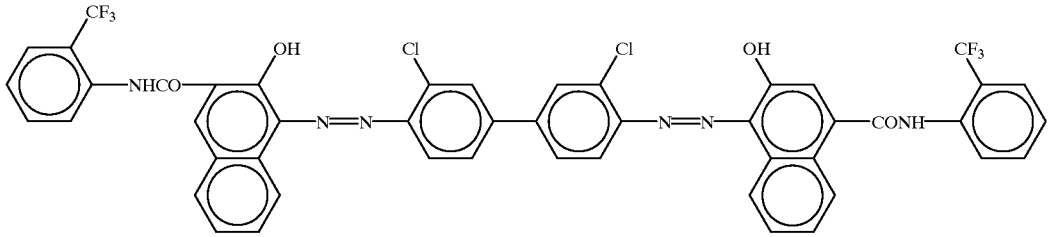

A mixed solution of 20 g of a hydrazone compound having the structure shown below, 20 g of a polycarbonate resin (Lexan 121 manufactured by General Electric Co., Ltd.) and 160 g of tetrahydrofuran was coated on the above-described charge generating layer by a wire round rod, dried at 60° C. for 30 seconds and then heated at 100° C. for 20 seconds to form a charge transporting layer having a thickness of about 18 μm whereby an electrophotographic light-sensitive layer of a double-layered structure was prepared.

Hydrazone Compound

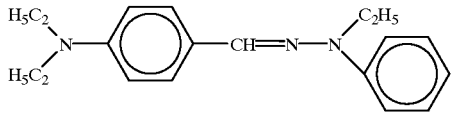

A mixed solution of 13 g of Resin (P-39) having the structure shown below, 0.2 g of phthalic anhydride, 0.002 g of o-chlorophenol and 100 g of toluene was coated on the light-sensitive layer by a wire round rod, set to touch and heated at 120° C. for one hour to prepare a surface layer for imparting releasability having a thickness of 1 μm. The adhesive strength of the surface of the resulting light-sensitive element was 5 g·f.

Resin (P-39)

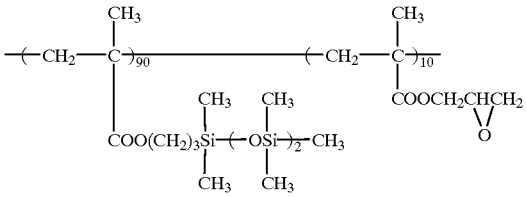

Mw $3 \times 10^4$

The resulting light-sensitive element was charged to a surface potential of +500 V in dark and exposed imagewise using a helium-neon laser of 633 nm at an irradiation dose on the surface of the light-sensitive element of 30 erg/cm$^2$, followed by conducting the same procedure as in Example 1 to form color toner images on the light-sensitive element. A transfer layer having a thickness of 3 μm was formed thereon in the same manner as in Example 1 except for using 20 g (solid basis) of Resin Grain (ARW-9) in place of 15 g of Resin Grain (ARW-1). Then, according to the same procedure as in Example 1, full-color images were formed on a coated paper. The color duplicate obtained exhibited good characteristics similar to those in Example 1.

EXAMPLE 19

A mixture of 100 g of photoconductive zinc oxide, 15 g of Binder Resin (B-6) having the structure shown below, 5 g of Binder Resin (B-7) having the structure shown below, 2 g of Resin (P-28), 0.01 g of Dye (D-2) having the structure shown below, 0.1 g of salicylic acid and 150 g of toluene was dispersed in a ball mill for 2 hours to prepare a dispersion for a light-sensitive layer.

Binder Resin (B-6)

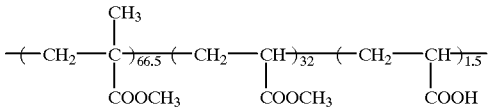

Mw $6.8 \times 10^4$

Binder Resin (B-7)

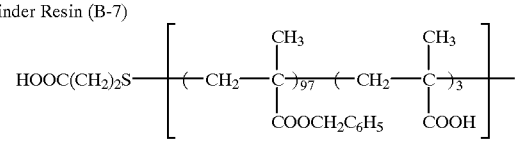

Mw $8 \times 10^3$

Dye (D-2)

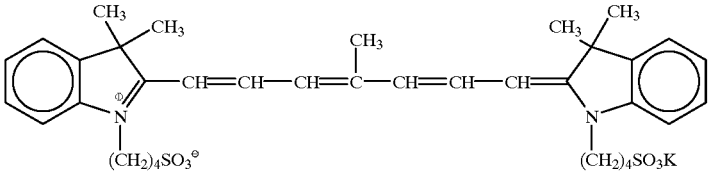

The resulting dispersion was coated on base paper for a paper master having a thickness of 0.2 mm, which had been subjected to electrically conductive treatment and solvent-resistant treatment, by a wire bar at a coverage of 25 g/m$^2$, set to touch, heated in a circulating oven at 110° C. for 20 seconds and allowed to stand in a dark place under conditions of 25° C. and 65% RH for 24 hours. The adhesive strength of the surface of resulting light-sensitive element was 12 g·f.

The light-sensitive element was charged to −600 V with a corona discharge in a dark place and exposed to light using a semiconductor laser having an oscillation wavelength of 780 nm at an irradiation dose of 25 erg/cm$^2$ on the surface of the light-sensitive element based on an information for yellow color separation of digital image data same as those described in Example 1. The residual potential of the exposed areas was −120 V. Then, the exposed light-sensitive element was subjected to development using a liquid developer prepared by diluting a yellow toner for an electrostatic color plotter (Versateck 3000 manufactured by Xerox Corp.) with 50-fold Isopar H (manufactured by Esso Standard Oil Co.) while a bias voltage of 200 V was applied to a development electrode to thereby electrodeposit toner particles on the unexposed areas. The light-sensitive element was then rinsed in a bath of Isopar H alone to remove stains in the non-image areas.

The above procedure was repeated using each information for magenta, cyan and black in place of the information for yellow.

On the surface of light-sensitive element bearing the toner images thereon installed on a drum, whose surface temperature was adjusted at 60° C. and which was rotated at a circumferential speed of 100 mm/sec, Dispersion of Resin (A) (L-3) containing positively charged resin grains shown below was supplied using a slit electrodeposition device, while putting the light-sensitive element to earth and applying an electric voltage of 130 V to an electrode of the slit electrodeposition device, whereby the resin grains were electrodeposited and fixed. Thus, a transfer layer having a thickness of 2 μm was formed.

| Dispersion of Resin (A) (L-3) | |
|---|---|
| Resin Grain (ARW-12) | 20 g (solid basis) |
| Charge Control Agent (D-1) | 0.07 g |
| Charge Adjuvant (AD-1) (dodecyl methacrylate/acrylic acid (95/5 by weight) copolymer) | 2 g |
| Isopar G | up to make 1 liter |

A primary receptor was prepared in the following manner. On a hollow roller, a sheet of natural rubber having a rubber hardness of 75 degree and a thickness of 4 mm (manufactured by Kokugo Co., Ltd.) was fixed, and a layer of methoxymethyl-modified nylon resin (Diamide MX-100 manufactured by Daicel Co., Ltd.) having a thickness of 2 μm was provided thereon. To the surface thereof was applied the composition shown below and heated at 120° C. for 2 hours to form the cured uppermost layer having a thickness of 3 μm. The adhesive strength of the surface of the resulting primary receptor was 120 g·f.

Composition for Uppermost Layer

Resin (a) — 100 parts by weight

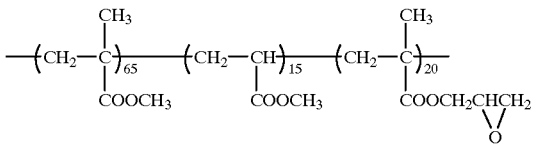

Mw $5 \times 10^4$

Resin (b) — 1 part by weight

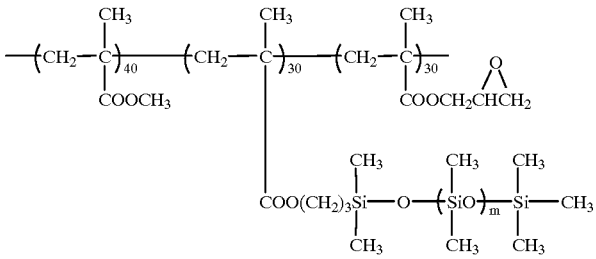

Mw $6 \times 10^4$ (Mw of dimethylsiloxane portion: $5 \times 10^3$)

| | |
|---|---|
| Phthalic anhydride | 2 parts by weight |
| o-Chlorophenol | 0.2 parts by weight |
| Tetrahydrofuran | 700 parts by weight |

The primary receptor on a drum, whose surface temperature had been adjusted at 110° C. was brought into contact with the light-sensitive element having the toner images and transfer layer thereon on a drum, whose surface temperature had been maintained at 60° C. after the formation of transfer layer and subjected to heating and pressing under the condition of a nip pressure of 3 kgf/cm$^2$ and a drum circumferential speed of 100 mm/sec, whereby the color toner images were wholly transferred onto the transfer layer on the primary receptor.

Then, a coated paper used for printing was introduced as a receiving material between the drum of primary receptor, the surface temperature of which had been adjusted at 60° C. by the temperature controller, and a back-up roller for transfer adjusted at 130° C. and a back-up roller for release adjusted at 10° C., and subjected to heating and pressing under a nip pressure of 5 Kgf/cm$^2$ and at a drum circumferential speed of 100 mm/sec. The color toner images were wholly transferred onto the coated paper and thus clear color images of good image quality were obtained.

EXAMPLES 20 TO 30

A mixture of 3.5 g of X-form metal-free phthalocyanine, 10 g of Binder Resin (B-8) having the structure shown below and 80 g of tetrahydrofuran was put in a 500 ml-volume glass container together with glass beads and dispersed in a paint shaker (manufactured by Toyo Seiki Seisakusho Co.) for 60 minutes. To the dispersion were added each of the resins (P) or resin grains (PL) shown in Table L below and the compounds for crosslinking shown in Table L below, followed by further dispersing for 10 minutes. The glass beads were separated by filtration to prepare a dispersion for a light-sensitive layer.

Binder Resin (B-8)

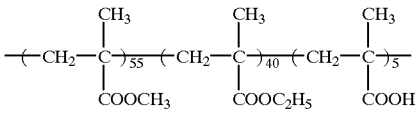

Mw $7 \times 10^4$

TABLE L

| Example | Resin (P) or Resin Grain (PL) | Compound for Crosslinking | Amount |
|---|---|---|---|
| 20 | P-30 | Phthalic anhydride | 0.2 g |
| | | Zirconium acetylacetone | 0.01 g |
| 21 | P-22 | Gluconic acid | 0.008 g |
| 22 | P-25 | N-Methylaminopropanol | 0.25 g |
| | | Dibutyltin dilaurate | 0.001 g |
| 23 | P-9 | N,N'-Dimethylpropanediamine | 0.3 g |
| 24 | P-7 | Propylene glycol | 0.2 g |
| | | Tetrakis(2-ethylhexane-diolato)titanium | 0.008 g |
| 25 | PL-18 | — | |
| 26 | PL-15 | N,N-Dimethylpropanediamine | 0.25 g |
| 27 | P-13 | Divinyl adipate | 0.3 g |
| | | 2,2'-Azobis(isobutyronitrile) | 0.001 g |
| 28 | P-14 | Propyltriethoxysilane | 0.01 g |
| 29 | PL-21 | N,N-Diethylbutanediamine | 0.3 g |
| 30 | P-5 | Ethylene diglycidyl ether | 0.2 g |
| | | o-Chlorophenol | 0.001 g |

The resulting dispersion was coated on base for a paper master having a thickness of 0.2 mm, had been subjected to electrically conductive treatment and solvent-resistant treatment, by a wire bar at a dry thickness of 8 $\mu$m, set to touch, dried in a circulating oven at 110° C. for 30 seconds and then heated at 140° C. for one hour.

The same procedure as in Example 3 was conducted except for using each of the resulting light-sensitive elements in place of the light-sensitive element employed in Example 3 to prepare transferred images. The color duplicates obtained on coated paper had clear images free from background stain and good image strength.

EXAMPLE 31

An amorphous silicon electrophotographic light-sensitive element (manufactured by KYOSERA Corp.) was installed in an apparatus as shown in FIG. 2 as a light-sensitive element 11. In order to impart the desired releasability onto the surface of light-sensitive element, the light-sensitive element was brought into contact with a solution containing 1.5 g of a polyether-modified silicone oil (Compound (S-1)) having the structure shown below dissolved in one liter of Isopar G for 10 seconds while the light-sensitive element was rotated at a circumferential speed of 30 mm/sec, squeezed by a squeezing roll and dried by a heating means 16. As a result, the adhesive strength of the surface of light-sensitive element was reduced from 203 g·f to 5 g·f.

Compound (S-1)

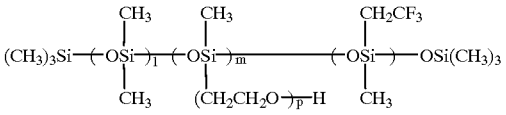

Using the resulting light-sensitive element, color images were formed on a coated paper in the same manner as in Example 2.

For comparison, the same procedure as above was repeated except for eliminating the treatment with Compound (S-1). Color images obtained on the coated paper were very poor due to inferior transfer and the color duplicate was unuseful. As a result of investigation of the surface of light-sensitive element, a large amount of toner image and transfer layer remained irregularly. This results from insufficient releasability on the surface of light-sensitive element.

On the contrary, the toner images were sufficiently released from the light-sensitive element and transferred completely from the primary receptor onto the receiving material according to the method of the present invention. Therefore, the superior color duplicate was obtained without causing the problem described above.

From these results, it can be seen that the light-sensitive element was imparted with the releasability sufficient for transfer of the toner image and transfer layer by the application of compound (S).

EXAMPLES 32 TO 37

Color images were formed on a coated paper in the same manner as in Example 31, except for using each of the solutions containing the compound (S) shown in Table M below dissolved in one liter of Isopar G in place of the solution of Compound (S-1) as the means for imparting releasability to the surface of amorphous silicon light-sensitive element used in Example 31. The adhesive strength of the surface of each of the light-sensitive element thus-treated was in a range of from 3 to 20 g·f. The color images obtained on a coated paper were clear and free from background stain and had good image strength similar to those in Example 31.

TABLE M

| Example | Compound (S) containing Fluorine and/or Silicon | Amount (g/l) |
|---|---|---|
| 32 | (S-2) Higher fatty acid-modified silicone (TSF 411 manufactured by Toshiba Silicone Co., Ltd.) | 1.0 |

TABLE M-continued

| Example | Compound (S) containing Fluorine and/or Silicon | Amount (g/l) |
|---|---|---|
| | 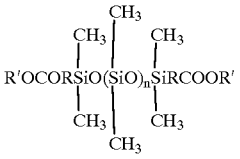 (presumptive structure) | |
| 33 | (S-3) Carboxy-modified silicone (X-22-3701E manufactured by Shin-Etsu Silicone Co., Ltd.) 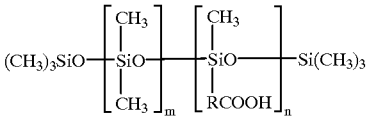 (presumptive structure) | 0.5 |
| 34 | (S-4) Carbinol-modified silicone (X-22-176B manufactured by Shin-Etsu Silicone Co., Ltd.) 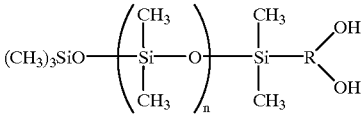 (presumptive structure) | 1.0 |
| 35 | (S-5) Mercapto-modified silicone (X-22-167B manufactured by Shin-Etsu Silicone Co., Ltd.) 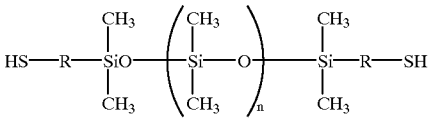 (presumptive stucture) | 2 |
| 36 | (S-6) 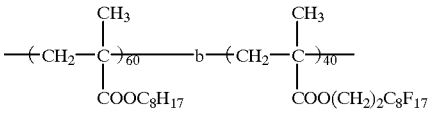 Mw: $6 \times 10^3$ | 1.5 |
| 37 | (S-7) 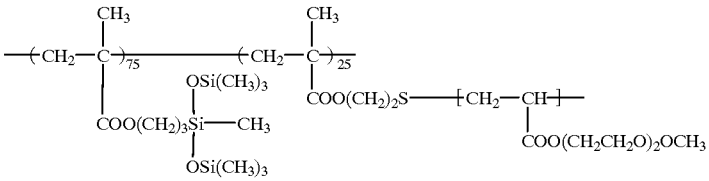 Mw: $8 \times 10^3$ (Mw of graft portion $3 \times 10^3$) | 2 |

EXAMPLE 38

A mixture of 2 g of X-form metal-free phthalocyanine (manufactured by Dainippon Ink and Chemicals, Inc.), 8.5 g of Binder Resin (B-9) having the structure shown below, 1.5 g of Binder Resin (B-10) having the structure shown below, 0.15 g of Compound (D) having the structure shown below and 80 g of tetrahydrofuran was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

Binder Resin (B-9)

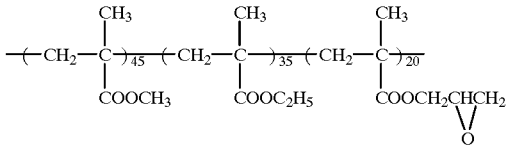

Mw $8 \times 10^4$

-continued

Binder Resin (B-10)

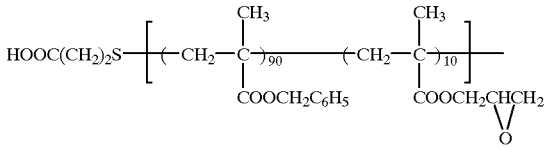

Mw 7 × $10^3$

Compound (D)

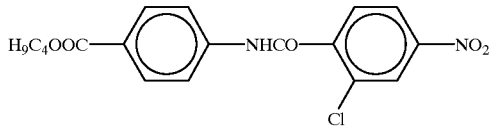

The resulting dispersion was coated on base paper for a paper master having a thickness of 0.2 mm, which had been subjected to electrically conductive treatment and solvent-resistant treatment, by a wire bar, set to touch, and heated in a circulating oven at 120° C. for 2 hours to form a light-sensitive layer having a thickness of 8 $\mu$m.

The resulting light-sensitive element was installed in an apparatus as shown in FIG. 2 as a light-sensitive element 11. In order to impart the desired releasability onto the surface of light-sensitive element, a metering roll having a silicone rubber layer on the surface thereof was brought into contact with a bath containing a carboxy-modified silicone oil (TSF 4446 manufactured by Toshiba Silicone Co., Ltd.) (Compound (S-8)) on one side and with the light-sensitive element on the other side and they were rotated at a circumferential speed of 15 mm/sec for 20 seconds. As a result, the adhesive strength of the surface of light-sensitive element was reduced from 400 g·f to 5 g·f.

Further, a transfer roll having a styrene-butadiene layer on the surface thereof was placed between the metering roll dipped in the silicone oil bath of Compound (S-8) and the light-sensitive element, and the treatment was conducted in the same manner as above. Good releasability of the surface of light-sensitive element similar to the above was obtained.

Moreover, Compound (S-8) 113 was supplied between the metering roll 112 and the transfer roll 111 in a device applying of compound (S) as shown in FIG. 7 and the treatment was conducted in the same manner as above. Again, good result similar to the above was obtained.

Using each of the resulting light-sensitive elements, color images were formed on a coated paper in the same manner as in Example 2. The color images thus-obtained were good similar to those in Example 2.

EXAMPLE 39

Color images were formed on a coated paper in the same manner as in Example 38, except for replacing the means for imparting releasability to the surface of light-sensitive element with the following method. Specifically, a rubber roller having a heating means integrated therein and covered with cloth impregnated with Compound (S-9), i.e., fluorine-containing surface active agent (Sarflon S-141 manufactured by Asahi Glass Co., Ltd.) was heated to a surface temperature of 60° C., then brought into contact with the light-sensitive element and they were rotated at a circumferential speed of 20 mm/sec for 30 seconds. The adhesive strength of the surface of light-sensitive element thus-treated was 12 g·f. The color images obtained on a coated paper were good similar to those in Example 38.

EXAMPLE 40

Color images were formed on a coated paper in the same manner as in Example 38, except for replacing the means for imparting releasability to the surface of light-sensitive element with the following method. Specifically, a silicone rubber roller comprising a metal axis covered with silicone rubber (manufactured by Kinyosha K.K.) was pressed on the light-sensitive element at a nip pressure of 500 gf/$cm^2$ and rotated at a circumferential speed of 15 mm/sec for 10 seconds. The adhesive strength of the surface of light-sensitive element thus-treated was 15 g·f. The color images obtained on a coated paper were good similar to those in Example 38.

While the invention has been described in detail and with reference to specific embodiments thereof , it will be apparent to one skilled in the art that various changes and modifications can be made therein without departing from the spirit and scope thereof.

What is claimed is:

1. A method of forming a color image comprising forming at least one color toner image on an electrophotographic light-sensitive element whose surface has releasability by an electrophotographic process, forming a peelable transfer layer on the electrophotographic light-sensitive element bearing the toner image by an electrodeposition coating method, said transfer layer being formed from thermoplastic resin grains each containing a resin (AH) having a glass transition point of from 10° C. to 140° C. or a softening point of from 35° C. to 180° C. and a resin (AL) having a glass transition point of not more than 45° C. or a softening point of not more than 60° C. and its glass transition point or softening point is at least 2° C. lower than that of the resin (AH), transferring the toner image together with the transfer layer onto a primary receptor, and then transferring the toner image together with the transfer layer from the primary receptor onto a receiving material, wherein the thermoplastic resin grains which form the transfer layer have a core/shell structure.

2. A method of forming a color image as claimed in claim 1, wherein a weight ratio of resin (AH)/resin (AL) is in a range of from 10/90 to 95/5.

3. A method of forming a color image as claimed in claim 1, wherein the thermoplastic resin grains are in the form of a dispersion thereof in an electrically insulating solvent having an electric resistance of not less than $10^8$ Ω·cm and a dielectric constant of not more than 3.5.

4. A method of forming a color image as claimed in claim 1, which comprises supplying the thermoplastic resin grains between the electrophotographic light-sensitive element and an electrode placed in face of the light-sensitive element, said grains migrating by electrophoresis according to a potential gradient applied from an external power source to cause the grains to adhere to or electrodeposit on the electrophotographic light-sensitive element, to thereby form a film.

5. A method of forming a color image as claimed in claim 1, wherein the surface of electrophotographic light-sensitive element has an adhesive strength of not more than 100 gram·force, which is measured according to JIS Z 0237-1980 "Testing methods of pressure sensitive adhesive tapes and sheets".

6. A method of forming a color image as claimed in claim 5, wherein the electrophotographic light-sensitive element comprises amorphous silicon as a photoconductive substance.

7. A method of forming a color image as claimed in claim 5, wherein the electrophotographic light-sensitive element contains a polymer having a polymer component containing at least one of a silicon atom and a fluorine atom in the region near to the surface thereof.

8. A method of forming a color image as claimed in claim 7, wherein the polymer is a block copolymer comprising at least one polymer segment (α) containing at least 50% by weight of a fluorine atom and/or silicon atom-containing polymer component and at least one polymer segment (β) containing 0 to 20% by weight of a fluorine atom and/or silicon atom-containing polymer component, the polymer segments (α) and (β) being bonded in the form of blocks.

9. A method of forming a color image as claimed in claim 8, wherein the polymer segment (β) further contains a polymer component containing a photo- and/or heat-curable group.

10. A method of forming a color image as claimed in claim 7, wherein the electrophotographic light-sensitive element further contains a photo- and/or heat-curable resin.

11. A method of forming a color image as claimed in claim 5, wherein the electrophotographic light-sensitive element is an electrophotographic light-sensitive element to the surface of which a compound (S) which contains a fluorine atom and/or a silicon atom is applied.

12. A method of forming a color image as claimed in claim 1, wherein the electrophotographic process comprises scanning exposure by a laser beam based on digital information and development by a liquid developer.

13. A method of forming a color image as claimed in claim 1, wherein a surface of the primary receptor has a releasability less than the releasability of the surface of the light-sensitive element.

14. A method of forming a color image as claimed in claim 1, wherein a surface of the primary receptor has an average roughness of 0.01 mm or below.

* * * * *